US011780253B2

(12) United States Patent
Yajima

(10) Patent No.: US 11,780,253 B2
(45) Date of Patent: Oct. 10, 2023

(54) PRINTER AND CONTROL METHOD OF PRINTER

(71) Applicant: SEIKO EPSON CORPORATION, Tokyo (JP)

(72) Inventor: Yasushi Yajima, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 109 days.

(21) Appl. No.: 17/215,548

(22) Filed: Mar. 29, 2021

(65) Prior Publication Data

US 2021/0300092 A1 Sep. 30, 2021

(30) Foreign Application Priority Data

Mar. 30, 2020 (JP) ..... 2020-060132

(51) Int. Cl.
*B41J 15/08* (2006.01)
*B41J 11/00* (2006.01)
*B41J 13/00* (2006.01)

(52) U.S. Cl.
CPC ..... *B41J 15/08* (2013.01); *B41J 11/0095* (2013.01); *B41J 13/0009* (2013.01)

(58) Field of Classification Search
CPC .... B41J 11/007; B41J 11/009; B41J 13/0009; B41J 15/08; B41J 15/048; B41J 15/04; B41J 2/51; B41J 15/16; B41J 3/60
See application file for complete search history.

(56) References Cited

U.S. PATENT DOCUMENTS

2002/0051669 A1* 5/2002 Otsuka ..... B41J 11/70 400/619
2006/0024109 A1* 2/2006 Morikawa ..... B41J 29/393 400/283
2018/0326764 A1* 11/2018 Shinjo ..... B41J 11/0085
2019/0030924 A1 1/2019 Takahashi
2019/0283399 A1* 9/2019 Arakane ..... B41J 2/04586

FOREIGN PATENT DOCUMENTS

JP 2017-177582 10/2017

* cited by examiner

*Primary Examiner* — Jannelle M Lebron
(74) *Attorney, Agent, or Firm* — WORKMAN NYDEGGER

(57) ABSTRACT

Included are a transport unit, a printing unit, and a control unit. In inner circumferential surface printing for performing printing on an inner circumferential surface of a medium, which is positioned inside in the state of being wound up in a roll shape, the control unit causes the transport unit to position a leading end of the medium at a printing start position being a position downstream of a position facing a most downstream nozzle of a nozzle surface in a transport direction, in a state in which the printing unit is at a position at which the nozzle surface does not face the medium being transported by the transport unit, and causes the printing unit to start formation of a printing region on the medium having the leading end positioned at the printing start position.

8 Claims, 22 Drawing Sheets

PRINTER AND CONTROL METHOD OF PRINTER

The present application is based on, and claims priority from JP Application Serial Number 2020-060132, filed Mar. 30, 2020, the disclosure of which is hereby incorporated by reference herein in its entirety.

BACKGROUND

1. Technical Field

The present disclosure relates to a printer that performs printing by jetting liquid onto a medium and a control method of the printer.

2. Related Art

Hitherto, as a device that performs printing and cutting with respect to roll paper, there has been known a configuration of performing printing on an inner surface of a roll body. JP-A-2017-177582 describes a printer, and discloses a configuration in which, at the time of duplex printing, printing is performed while an inner surface of an elongated medium that is wound up in a roll shape is dealt with as a back surface.

In the printer described in JP-A-2017-177582, the medium has an elongated shape that is wound up in a roll shape. Thus, when the inner surface is positioned on a side of a printing unit, a curl in a direction of approaching the printing unit is formed at a leading end of the medium. This is because of curling caused when the medium is wound up in a roll shape. In an ink-jet type printer, it is assumed that a gap is formed between a printing unit and a medium. Thus, a carriage equipped with a liquid jetting head as one example of the printing unit scans on the medium, a nozzle surface of a liquid jetting unit included in the liquid jetting head and a leading end of the medium, which approaches the printing unit, contact with each other. With this, there may be a risk of degrading printing quality.

SUMMARY

In order to solve the above-mentioned problem, a printer includes a transport unit configured to transport a medium in a transport direction, the medium being fed from a state of being wound up in a roll shape, a printing unit configured to move to a position at which a nozzle surface does not face the medium being transported by the transport unit, and a control unit configured to control the transport unit and the printing unit, wherein, during inner circumferential surface printing for performing printing on an inner circumferential surface of the medium positioned inside when the medium is in the state of being wound up in a roll shape, the control unit causes the transport unit to position a leading end of the medium at a printing start position being a position downstream of a position facing a most downstream nozzle of the nozzle surface in the transport direction, in a state in which the printing unit is at a position at which the nozzle surface does not face the medium being transported by the transport unit, and causes the printing unit to start formation of a printing region on the medium having the leading end positioned at the printing start position.

In order to solve the above-mentioned problem, a control method of a printer is a control method of a printer including a transport unit configured to transport a medium in a transport direction, the medium being fed from a state of being wound up in a roll shape, a printing unit configured to move to a position at which a nozzle surface does not face the medium being transported by the transport unit, and a control unit configured to control the transport unit and the printing unit. In inner circumferential surface printing for performing printing on an inner circumferential surface of the medium positioned inside when the medium is in the state of being wound up in a roll shape, the control method includes positioning a leading end of the medium at a printing start position being a position downstream of a position facing a most downstream nozzle of the nozzle surface in the transport direction, in a state in which the printing unit is at a position at which the nozzle surface does not face the medium being transported by the transport unit, and starting formation of a printing region by the printing unit, on the medium having the leading end positioned at the printing start position.

DESCRIPTION OF EXEMPLARY EMBODIMENTS

Figure 1:
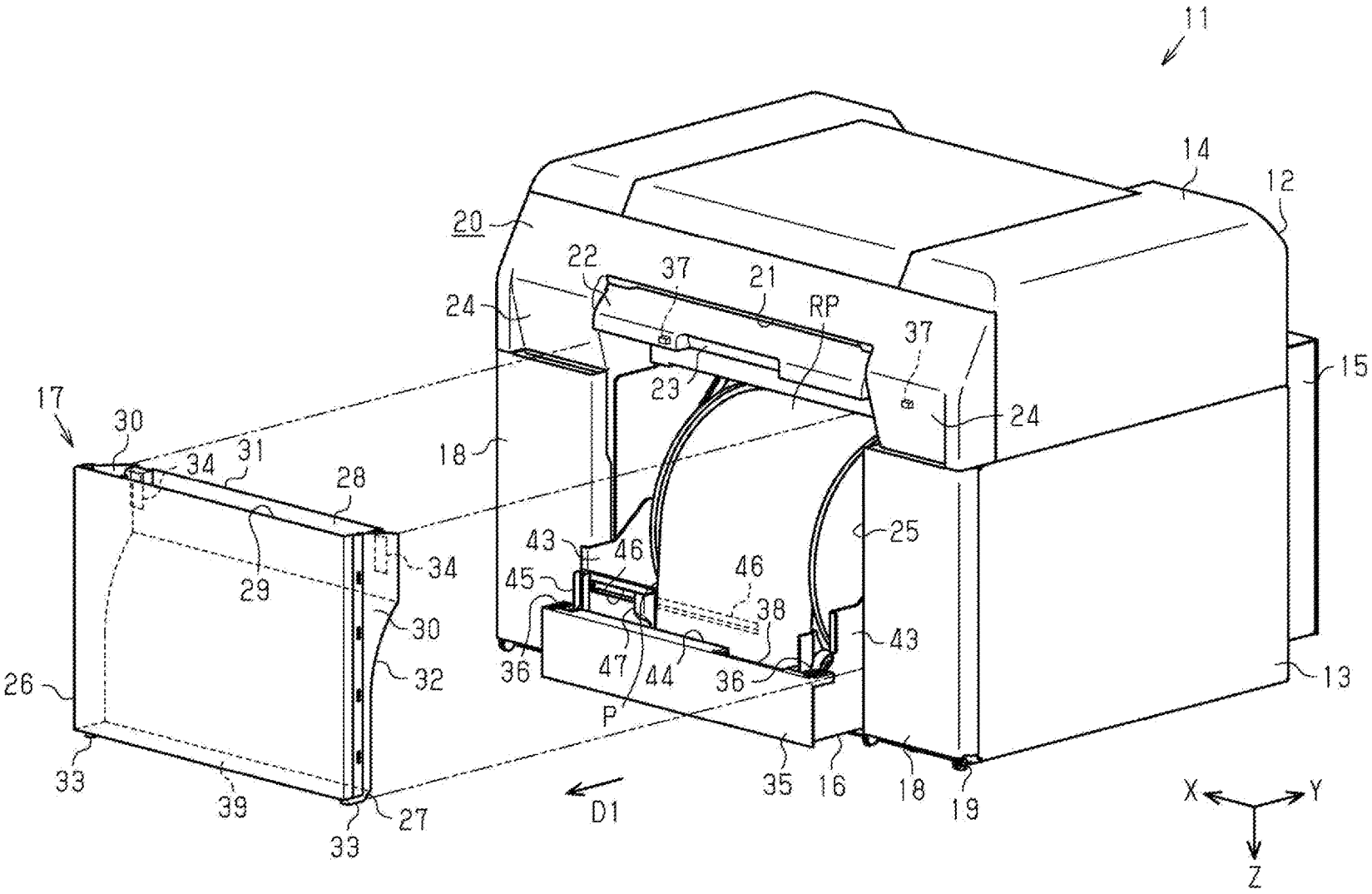
FIG. 1 is an external view illustrating a printer of a first exemplary embodiment.

In the drawings, the direction of gravity is indicated by a Z axis while assuming that a printer 11 is placed on a horizontal surface, and directions along a plane intersecting the Z axis are indicated by an X axis and a Y axis. The X axis, the Y axis, and the Z axis are preferably orthogonal to one another, and the X axis and the Y axis preferably follow the horizontal plane. In the following description, the X axis direction is also referred to as a width direction X, the Y axis direction as a depth direction Y, and the Z axis direction as a vertical direction Z.

First Exemplary Embodiment

With reference to the drawings, a printer according to a first exemplary embodiment is described.

As illustrated in FIG. 1, the printer 11 of the present exemplary embodiment includes a housing unit 12 having a substantially rectangular box-like shape. The housing unit 12 includes a first accommodation part 13, a second accommodation part 14 arranged on the −Z side of the first accommodation part 13 in the vertical direction Z, and a third accommodation part 15 arranged on a rear side of the first accommodation part 13.

The housing unit 12 accommodates a drawer unit 16 that is drawable through an opening portion 25 formed in the vicinity of the center of the first accommodation part 13 in the width direction X. The drawer unit 16 includes a front plate portion 35 having an outer surface being a front surface in the present exemplary embodiment, which is exposed when the drawer unit 16 is accommodated in the housing unit 12.

On the −Z side of the front plate portion 35 of the drawer unit 16 accommodated in the housing unit 12 in the vertical direction Z, an accommodation container 17 is removably attached at a position that is aligned with the front plate portion 35 and above the front plate portion 35. The accommodation container 17 includes an outer wall portion 26 that covers the opening portion 25 when being attached to the housing unit 12, and an inner wall portion 27 that forms an accommodation portion 28 with the outer wall portion 26. When the accommodation container 17 is attached to the housing unit 12, the inner wall portion 27 is arranged in the housing unit 12.

The drawer unit 16 includes a hand grip portion 38 arranged on an inner surface side of the front plate portion 35, which enables the drawer unit 16 to be gripped by a hand when being pulled out from the housing unit 12. For example, the hand grip portion 38 is a recessed portion formed on the −X side of the front plate portion 35 in the width direction X.

The accommodation container 17 covers the hand grip portion 38 of the drawer unit 16 accommodated in the housing unit 12 when being attached to the housing unit 12. Meanwhile, the accommodation container 17 exposes the hand grip portion 38 of the drawer unit 16 accommodated in the housing unit 12 when being removed from the housing unit 12.

When the accommodation container 17 is attached, the opening portion 25 is covered with the outer wall portion 26 and the front plate portion 35. The outer wall portion 26 of the accommodation container 17 and the front plate portion 35 of the drawer unit 16 function as a housing of the printer 11.

The outer wall portion 26 and the front plate portion 35 have the same length in the width direction X intersecting both the vertical direction Z and a drawing direction D1 being the −Y side of the drawer unit 16 in the depth direction Y. Further, the outer wall portion 26 has a length in the vertical direction Z, which is longer than the front plate portion 35.

As illustrated in FIG. 1, the inner wall portion 27 of the accommodation container 17 includes a pair of side walls 30 joined to the outer wall portion 26 at both ends in the width direction X, a substantially rectangular plate-like inner wall 31 that forms a reception port 29 with an upper end of the outer wall portion 26, a curved wall 32 that is curved downward from a lower end of the inner wall 31 in a direction of approaching the outer wall portion 26, a bottom wall 39 joined to a lower end of the outer wall portion 26. Further, the accommodation container 17 includes a pair of metal pieces 34 attached to both ends of the inner wall 31 in the width direction X.

On both ends of the bottom wall 39 in the width direction X, the accommodation container 17 includes a pair of engaging projection portions 33 that protrude downward. Meanwhile, on both ends in the width direction X, the front plate portion 35 of the drawer unit 16 includes a pair of supporting recess portions 36 that are opened upward. When being removed from the housing unit 12, the accommodation container 17 is supported by the front plate portion 35 in a state in which the engaging projection portions 33 are engaged with the supporting recess portions 36.

The drawer unit 16 supports a path formation member 45 that forms an insertion port 44 with the front plate portion 35. The path formation member 45 has a guide hole 46 that extends from the +X side to the −X side in the width direction X. A first sensor 71 is positioned before a transport roller pair 51 behind the insertion port 44. When the first sensor 71 detects a leading end of a medium P, the transport roller pair 51 is slightly rotated, the leading end of the medium P is drawn in by the transport roller pair 51, and hence the leading end of the medium P is nipped.

The path formation member 45 supports a positioning member 47 that is movable along the guide hole 46 in the width direction X. The positioning member 47 includes a protruding portion that protrudes in the drawing direction D1 with respect to the guide hole 46. Note that, in the drawer unit 16, the hand grip portion 38 is arranged on the −X side in the width direction X with respect to a movable range of the protruding portion of the positioning member 47.

When a user takes out the accommodation container 17 from the housing unit 12, grips the hand grip portion 38 with a hand, and pulls out the drawer unit 16 in the drawing direction D1, a pair of side wall portions 43 of the drawer unit 16 come to the outside of the housing unit 12. The side wall portions 43 supports a roll body RP in a rotatable manner. For example, the roll body RP is obtained by winding up the medium P being sheet-like paper in a cylindrical shape. Note that the front plate portion 35 is positioned at the front of the roll body RP and the side wall portions 43 in the drawing direction D1 from the housing unit 12. Further, in the present exemplary embodiment, the medium P that is wound up in a cylindrical shape is referred to as the roll body RP.

One of a plurality of roll bodies RP having different winding numbers and widths being lengths in the width direction X is loaded in the drawer unit 16 in a replaceable manner, in a state of being positioned on the −X side in the width direction X. Further, the length in the guide hole 46 in the width direction X and the movable range of the positioning member 47 are set in accordance with a minimum width of the roll body RP loadable in the drawer unit 16.

As illustrated in FIG. 1, on both ends of the first accommodation part 13 in the width direction X, an opening/closing cover 18 is attached in a turnable manner. When an upper end turns about a turning shaft 19 provided to a lower end, the opening/closing cover 18 is arranged at a closing position illustrated in FIG. 1 and an opening position at which the upper end turns frontward to expose the inside. Further, when the opening/closing cover 18 is arranged at the opening position, a cartridge holder (not illustrated) is exposed. An ink cartridge (not illustrated) that accommodates ink being one example of liquid is removably installed in the cartridge holder.

At the front of the second accommodation part 14, a frame member 20 constituting the housing unit 12 is arranged at a position above the accommodation container 17 and the opening/closing cover 18. In the vicinity of the center of the frame member 20 in the width direction X, a discharge port 21 that is opened obliquely downward is formed. Below the discharge port 21 in the frame member 20, a guide portion 22 is formed. The guide portion 22 is curved to be recessed inward and upward from the lower end toward the discharge port 21. Further, at positions below the guide portion 22 and on an inner far side of the housing unit 12 with respect to the guide portion 22, a pair of magnets 37 are attached to the frame member 20.

When the drawer unit 16 is accommodated in the housing unit 12, and the accommodation container 17 is attached to the housing unit 12, the engaging projection portions 33 formed on the lower end are engaged with the supporting recess portions 36 of the drawer unit 16. After that, the upper end of the accommodation container 17 is tilted toward the frame member 20 with the engaging projection portions 33 as a supporting point. With this, the accommodation container 17 is supported by the front plate portion 35 through intermediation of the engaging projection portions 33. At the same time, the metal pieces 34 are attracted by the magnets 37, and hence a self-standing state in which the reception port 29 is oriented to the −Z side in the vertical direction Z is retained.

In the vicinity of the center in the width direction X, a lower end of the guide portion 22 has a lower end-side recess portion 23 that is opened downward and frontward. Further, when the accommodation container 17 is attached to the housing unit 12, the upper end of the outer wall portion 26 is exposed through the lower end-side recess portion 23.

On both ends in the width direction X, the frame member 20 has a pair of recessed portions 24 that are opened frontward and inward, that is, toward the accommodation container 17, to be recessed to the inside of the housing unit 12 as approaching the lower end. Further, the upper end of the opening/closing cover 18, which is on both ends of the accommodation container 17 attached to the housing unit 12 in the width direction X and is at the closing position, is exposed through the recessed portions 24.

Figure 2:
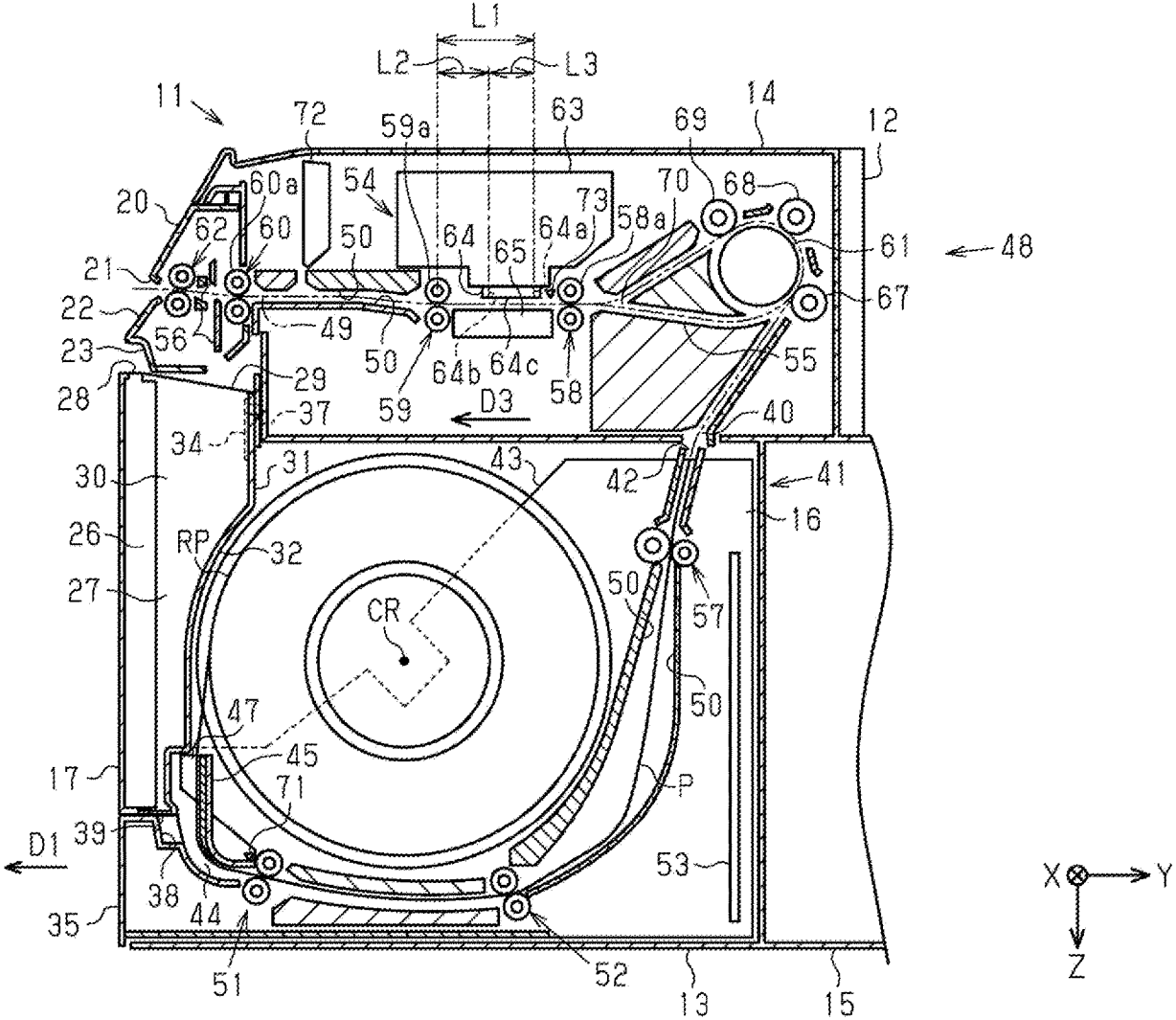
FIG. 2 is a schematic cross-sectional view illustrating a standby state of a medium before the printer of the first exemplary embodiment starts an operation.

As illustrated in FIG. 2, the printer 11 includes a feeding unit 41 that transports, to the second accommodation part 14, the leading end of the medium P fed out from a state of being wound up in a roll shape accommodated in the first accommodation part 13. The feeding unit 41 includes a roller group including transport roller pairs 51, 52, and 57 and a plurality of transport surfaces 50 in a transport path 49 from the roll body RP to an outlet 42 of the first accommodation part 13. The transport roller pairs 51, 52, and 57 have a configuration of being rotatable in synchronization and rotatable in both forward and backward directions. Specifically, in this configuration, the elongated medium P can be fed out from the roll body RP, and the elongated medium P that is fed out can be re-wound back to the roll body RP. In the following description, the "elongated medium P" is described as the "medium P" in some cases.

The drawer unit 16 of the first accommodation part 13 supports the transport roller pairs 51, 52, and 57 that transport the medium P, which is fed out from the roll body RP, in a transport direction toward the second accommodation part 14. Note that the front plate portion 35 and the transport roller pairs 51 and 52 are arranged below a rotation center CR of the roll body RP in the vertical direction Z.

As illustrated in FIG. 2, in the second accommodation part 14, the printer 11 includes a transport unit 48 that transports the medium P, a printing unit 54 that performs printing on the transported medium P by jetting ink being one example of liquid, a cutting unit 56 that cuts the medium P on which printing is performed by the printing unit 54 in the housing unit 12, and a control unit 53 that controls the transport unit 48, the printing unit 54, and the cutting unit 56. The printing unit 54 of the present exemplary embodiment is an ink-jet head.

The transport unit 48 transports the medium P, which is fed out from a state of being wound up in a roll shape, in the transport direction D3. The transport unit 48 includes a roller group including a second nipping roller pair 58, a first nipping roller pair 59, a transport roller pair 60, an intermediation roller 61, pinch rollers 67, 68, and 69, and a discharge roller pair 62, and the plurality of transport surfaces 50 in the transport path 49 from an inlet 40 of the second accommodation part 14 to the discharge port 21.

In the first accommodation part 13 and the second accommodation part 14, the transport surfaces 50 are arranged both sides of the transport path 49, and angles of the transport surfaces 50 vary in accordance with positions in the transport path 49. A direction along the transport path 49 and a direction in which the medium P is transported when printing is performed on the medium P are also referred to as a transport direction D3. The transport direction D3 is a direction in which the medium P is transported along the transport path 49, and varies in accordance with positions in the transport path 49.

The medium P that is fed out from a state of being wound up in a roll shape is transported toward the discharge port 21 through which the medium P is discharged. In the transport path 49 in which the medium P is transported, a direction from the discharge port 21 to the roll body RP is referred to as an upstream direction, and a direction from the roll body RP to the discharge port 21 is referred to as a downstream direction.

The second nipping roller pair 58, the first nipping roller pair 59, and the transport roller pair 60 have a configuration of rotating in synchronization and rotating in both forward and backward directions. Specifically, in this configuration, the medium P can be transported downstream when printing is to be performed on the medium P, and the medium P after printing can be transported upstream.

In the present exemplary embodiment, the second nipping roller pair 58 includes a second nipping roller 58*a*. The second nipping roller 58*a* nips the medium P with the other roller constituting the second nipping roller pair 58. The first nipping roller pair 59 includes a first nipping roller 59*a*. The first nipping roller 59*a* nips the medium P with the other roller constituting the first nipping roller pair 59. The transport roller pair 60 includes a transport roller 60*a*. The transport roller 60*a* nips the medium P with the other roller constituting the transport roller pair 60. Note that, in the present exemplary embodiment, each of the second nipping roller 58*a*, the first nipping roller 59*a*, and the transport roller 60*a* nips the medium P with a roller, but may have a configuration of nipping the medium P with the transport surfaces 50.

Meanwhile, independently from the second nipping roller pair 58, the first nipping roller pair 59, and the transport roller pair 60, the intermediation roller 61 solely rotates in both forward and backward directions. Specifically, when printing is performed on the medium P fed out from the roll body RP or cutform paper CP described later, the medium P or the cutform paper CP described later is transported in a counter-clockwise direction about the intermediation roller 61. Further, when the medium P fed out from the roll body RP is re-wound back to the roll body RP, the medium P is transported in a clockwise direction about the intermediation roller 61. Thus, at a branched path 70 upstream of the second nipping roller pair 58, the transport surfaces 50 of the branched path 70 are formed into such shapes that, when the cutform paper CP described later is transported from the downstream, the leading end is transported to a switchback transport path 55 below the intermediation roller 61.

As illustrated in FIG. 2, the printer 11 includes the printing unit 54 and a support unit 65. The printing unit 54 includes a carriage 63 that is reciprocally movable in the width direction X, and a liquid jetting unit 64 arranged in a lower part of the carriage 63. The support unit 65 supports the medium P transported by the transport unit 48.

The liquid jetting unit 64 includes a plurality of nozzles that jet liquid. In FIG. 2, among the plurality of nozzles, positions of a most upstream nozzle 64*a* and a most downstream nozzle 64*b* are illustrated. A nozzle surface 64*c* corresponds to a surface range of a surface on which the nozzles are arranged in the liquid jetting unit 64. The surface range has an inter-nozzle distance L3 from the most upstream nozzle 64*a* to the most downstream nozzle 64*b*, which is illustrated in FIG. 2. The printing unit 54 has a configuration of being movable to a position at which the nozzle surface 64*c* does not face the medium P transported by the transport unit 48, by reciprocally moving in the width direction X.

The printing unit 54 performs printing on the elongated medium P that is fed out from the roll body RP obtained by winding up the elongated medium P. The printer 11 is configured to perform simplex printing and duplex printing. In simplex printing, printing is performed only on a first surface of the medium P, and a printed object subjected to printing only on the first surface is output. In duplex printing, printing is performed on the first surface of the medium P and a second surface being an opposite surface thereof, and a printed object subjected to printing on the first surface and the second surface is output. Note that, in the present exemplary embodiment, with regard to the transport direction D3, a part of the medium P on which printing is performed has the transport direction D3 that is parallel to the Y axis when printing is performed on the medium P.

The medium P has a multi-layer structure including a base material and an ink reception layer. The medium P of the present exemplary embodiment includes an ink reception layer on each of the first surface and the second surface. The ink reception layer is a coating layer formed on the base material in an ink-jet recording medium, for the purpose of absorbing ink and fixing a color material such as dye and pigment. Note that the medium P may have a configuration of including the ink reception layer only on one surface. When the medium P has the ink reception layer, a restriction on a direction in which the medium P can be bent and a degree of the bending is caused to a certain extent. Thus, even when duplex printing is performed, the medium P including the ink reception layer only on one surface may be used.

The leading end of the medium P is a downstream end. Further, the rear end of the medium P is an upstream end. Therefore, in cases of the cutform paper CP described later, a cut piece WP, and a shredded piece SP, a lower end is a leading end, and an upstream end is a rear end.

As illustrated in FIG. 2, at a position between the second nipping roller pair 58 and the liquid jetting unit 64 of the printing unit 54, and in the vicinity of the second nipping roller pair 58, the printer 11 includes a second sensor 73 that detects passing of the medium P or the cutform paper CP described later. The second sensor 73 is arranged in the vicinity of the second nipping roller pair 58, and hence the second sensor 73 detects passing of the leading end of the medium P in a state with less influence of a curl of the medium P. In accordance with a detection result of the second sensor 73, the control unit 53 controls the transport unit 48.

In the present exemplary embodiment, the control unit 53 executes duplex printing by causing the printing unit 54 to perform printing on the first surface of the medium P and causing the printing unit 54 to perform printing on the second surface of the medium P after printing is performed on the first surface. In this case, the first surface is an outer circumferential surface, and the second surface is an inner circumferential surface. Specifically, with respect to the medium P or the cutform paper CP described later, which has a leading end positioned at a printing start position P1, the control unit 53 causes the printing unit 54 to perform printing on the first surface as outer circumferential surface printing, and to perform printing on the second surface as inner circumferential surface printing.

When the printer 11 starts printing on the first surface, the printing unit 54 is at the position at which the nozzle surface

64*c* does not face the medium P transported by the transport unit 48. In the present exemplary embodiment, as printing on the first surface, printing is performed on the outer circumferential surface of the roll body RP, which is positioned on the outside. When the medium P is supported by the support unit 65, the first surface of the medium P, which is the outer circumferential surface of the roll body RP, faces upward in the vertical direction Z. In other words, the first surface of the medium P supported by the support unit 65 faces the printing unit 54. Therefore, when the nozzle surface 64*c* in the printing unit 54 is at the position facing the medium P, the first surface of the roll body RP faces the nozzle surface 64*c*. Specifically, the end of the medium P is to be curled toward the support unit 65 due to curling of the roll body RP.

Figure 3:
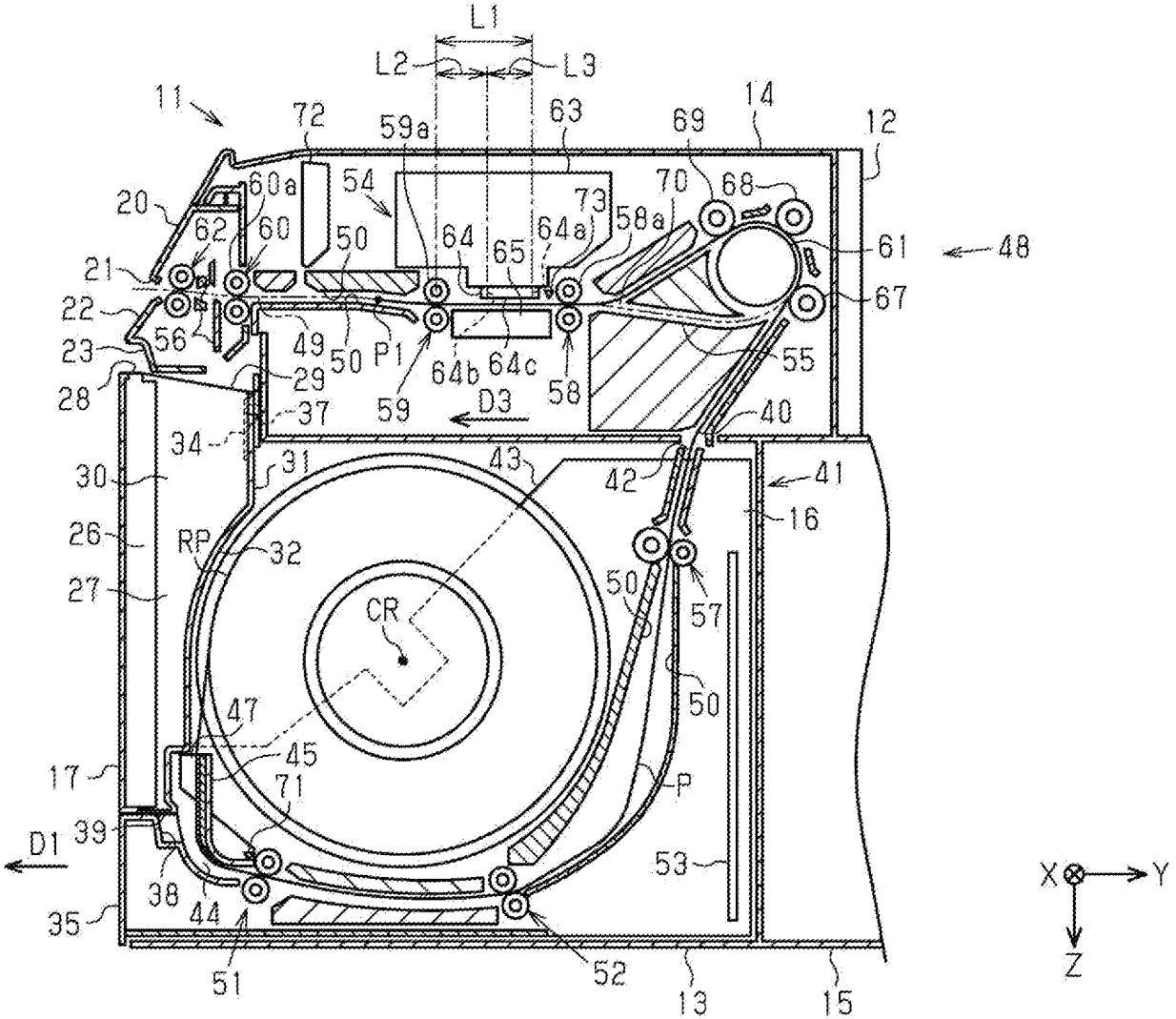
FIG. 3 is a schematic cross-sectional view illustrating a nipped state of a first surface of the medium subjected to duplex printing in the first exemplary embodiment.

As illustrated in FIG. 3, before starting printing on the first surface, the control unit 53 positions the leading end of the medium P at the printing start position P1. The printing start position P1 is present downstream of a position facing the most downstream nozzle 64*b* of the nozzle surface 64*c*, in the transport direction D3. Note that FIG. 3 illustrates the transport path 49 through which the medium P passes. In the path, the solid part indicates a part in which the medium P is actually present, and the two-dot chain part indicates a part in which the medium P is not actually present.

More specifically, a detected position at which the second sensor 73 detects passing of the leading end of the medium P and a transport amount M corresponding to a length from the printing start position P1 are set in advance. After the second sensor 73 detects passing of the leading end of the medium P, the control unit 53 transports the medium P by the set transport amount. In this manner, the leading end of the medium P is transported to the printing start position P1.

The length of the medium P downstream of the second nipping roller pair 58 when the second sensor 73 detects passing of the leading end of the medium P varies in accordance with curling orientation of the medium P or a curl amount of the medium P. Thus, when the control unit 53 transports the medium P by the transport amount M after the second sensor 73 detects passing of the leading end of the medium P, a position of the leading end of the medium P at the time of completion of transporting by the transport amount M differs in accordance with curling orientation of the medium P or a curl amount of the medium P. Therefore, the transport amount M is preferably set to such transport amount M that enables the leading end of the medium P to be positioned at the printing start position P1 regardless of curling orientation of the medium P or a curling amount of the medium P.

Note that the control unit 53 develops received printing image data, and thus causes the printing unit 54 to perform printing on the medium after the leading end of the medium P is positioned at the printing start position P1. More specifically, a position at which the printing image data is developed is preferably changed in accordance with a margin included in a printing image region based on the received printing image data. For example, a margin length on the leading end side in the printing image region is equal to or longer than the length between the most upstream nozzle 64*a* and the printing start position P1, the printing image data is developed while regarding the leading end of the medium P as a reference. Further, when the margin length is shorter than the length between the most upstream nozzle 64*a* and the printing start position P1, the printing image data is developed while regarding a position upstream of the leading end of the medium P as a reference. Such control can be performed.

The second nipping roller pair 58 nips the medium P at a second nipping position upstream of the printing unit 54 in the transport direction D3 in which the medium P is transported. Further, the first nipping roller pair 59 nips the medium P at a first nipping position downstream of the printing unit 54 in the transport direction D3 in which the medium P is transported.

As illustrated in FIG. 3, in the present exemplary embodiment, the printing start position P1 is a position downstream of the first nipping position in the transport direction D3, at which the first nipping roller pair 59 nips the medium P. Therefore, before the printing unit 54 starts printing, the medium P is in a nipped state of being nipped between the first nipping roller pair 59 and being nipped between the second nipping roller pair 58. When the medium P is in the nipped state, the control unit 53 causes the printing unit 54 to start printing on the first surface of the medium P. Note that, in the present exemplary embodiment, the printing start position P1 being the leading end position of the medium P at the time of starting printing is a position downstream of the first nipping position, but may be a position downstream of the position facing the most downstream nozzle 64*b* and upstream of the first nipping position.

The printer 11 may include a heater 72 at a position downstream of the printing unit 54. For example, the heater 72 is an infrared ray heater. In the infrared ray heater, a heat generating member emits radiant heat being heat of an infrared ray or the like. The printer 11 causes the infrared ray heater to dry the surface of the medium P having a moisture content increased due to printing performed by jetting liquid onto the surface. In the present exemplary embodiment, the heater 72 is provided between the first nipping roller pair 59 and the transport roller pair 60.

Figure 4:
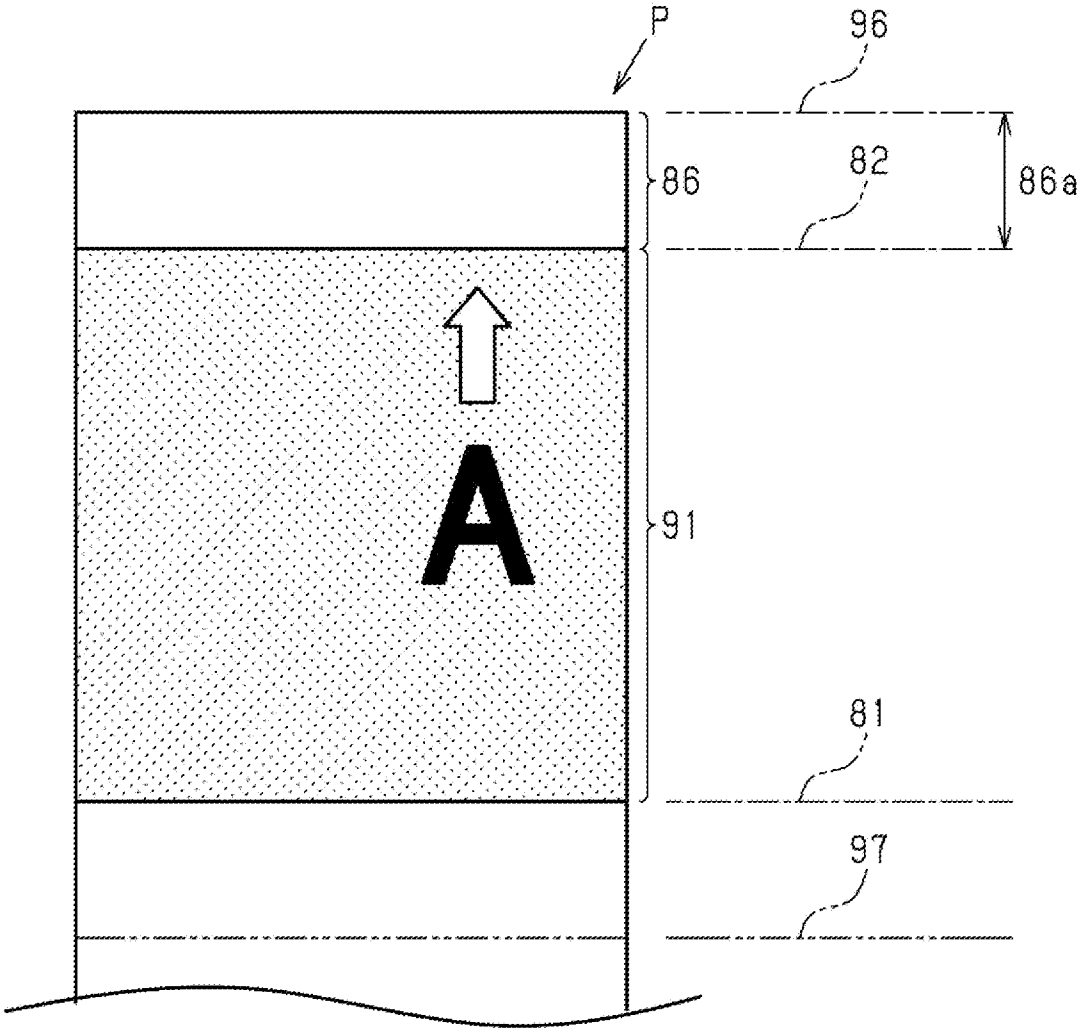
FIG. 4 is a schematic view illustrating a leading end margin and a printing region after printing is performed on the first surface of the medium subjected to duplex printing.

FIG. 4 illustrates a printing region and a margin on the medium P after printing is performed on the first surface of the medium P. As illustrated in FIG. 4, the first surface of the medium P has a leading end margin 86 in a part between a reference end 96 and a first printing region 91. Note that, in the present exemplary embodiment, the reference end 96 is the leading end of the elongated medium P unwound from the roll body RP. Further, the reference end 96 is an end of a leading end of the roll body RP, which is formed when the cutform paper CP described later is cut from the roll body RP in a previous operation of outputting a printed object OP.

The first printing region 91 has a first end 81 and a second end 82. The first end 81 is an upstream end when printing is performed on the first surface. The second end 82 is a downstream end when printing is performed on the first surface. In printing on the first surface, the control unit 53 causes the printing unit 54 to form the first printing region 91 having the second end 82 at the position away from the reference end 96 of the medium P.

The reference end 96 being the leading end in printing on the first surface is the rear end of the medium P in printing on the second surface. The control unit 53 causes the printing unit 54 to form the first printing region 91 in such a way that the distance between the second end 82 and the reference end 96 is greater than the inter-nozzle distance L3. Further, the control unit 53 may cause the printing unit 54 to form the first printing region 91 in such a way that the distance between the second end 82 and the reference end 96 is greater than the distance between the position of the second nipping roller pair 58 and the most downstream nozzle 64*b* in the transport direction D3.

Figure 5:
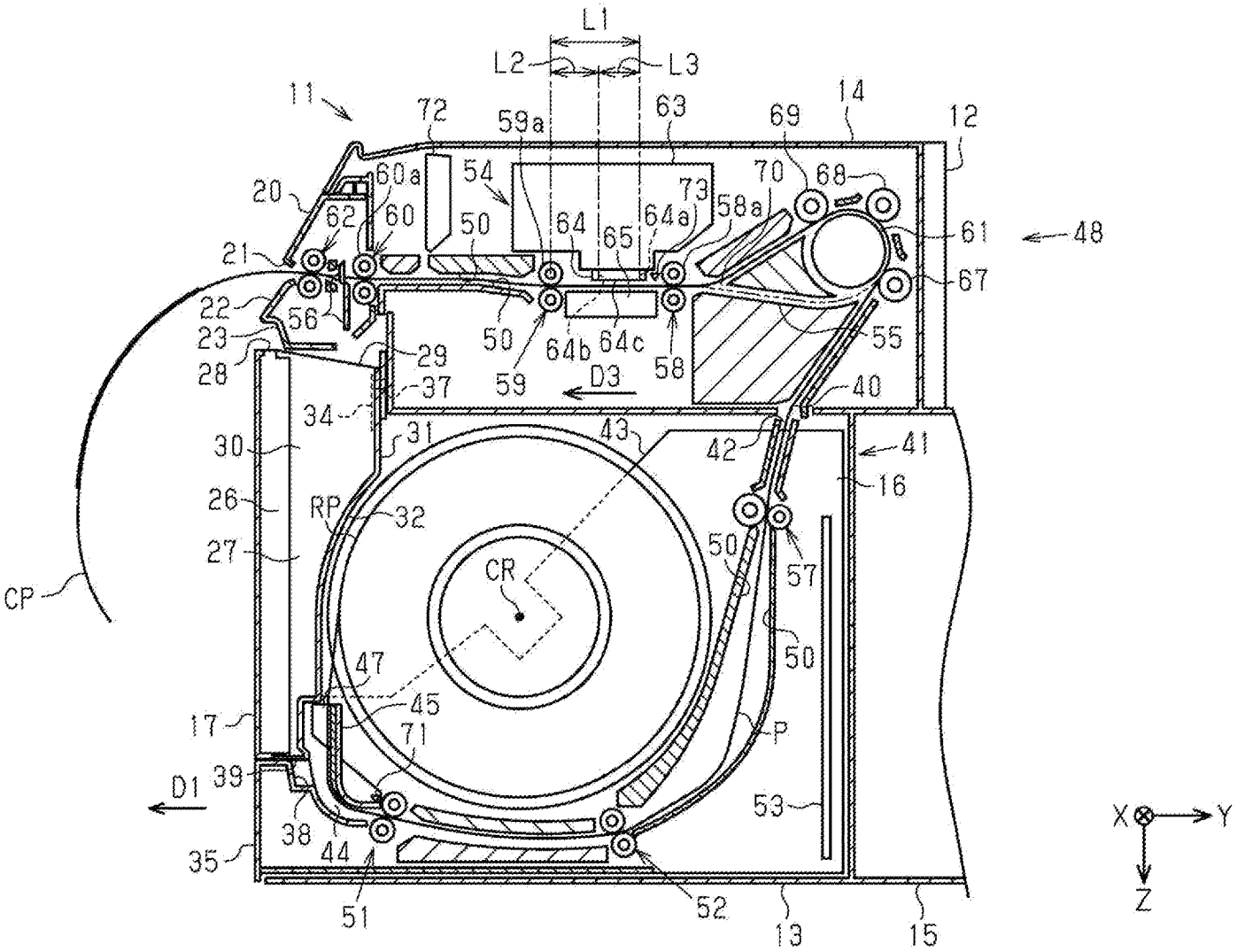
FIG. 5 is a schematic cross-sectional view illustrating a cut state of a rear end on the first surface of the medium subjected to duplex printing in the first exemplary embodiment.

As illustrated in FIG. 5, the cutting unit 56 includes a lower blade being a fixed blade and an upper blade being a movable blade. The lower blade being a fixed blade is fixed in such a way that an edge thereof is positioned on the +Z side with respect to a position of the transport surface 50 on the +Z side in the transport path 49. The upper blade being a movable blade has an edge positioned on the +Z side with respect the edge of the lower blade, and moves in the width direction X. When the movable blade is at a retraction position deviated from the transport path 49 in the width direction X, the medium P passes through the −Z side of the lower blade. The control unit 53 causes the upper blade being a movable blade to move and cut the medium P in a state in which the medium P is positioned on the −Z side of the lower blade.

Figure 6:
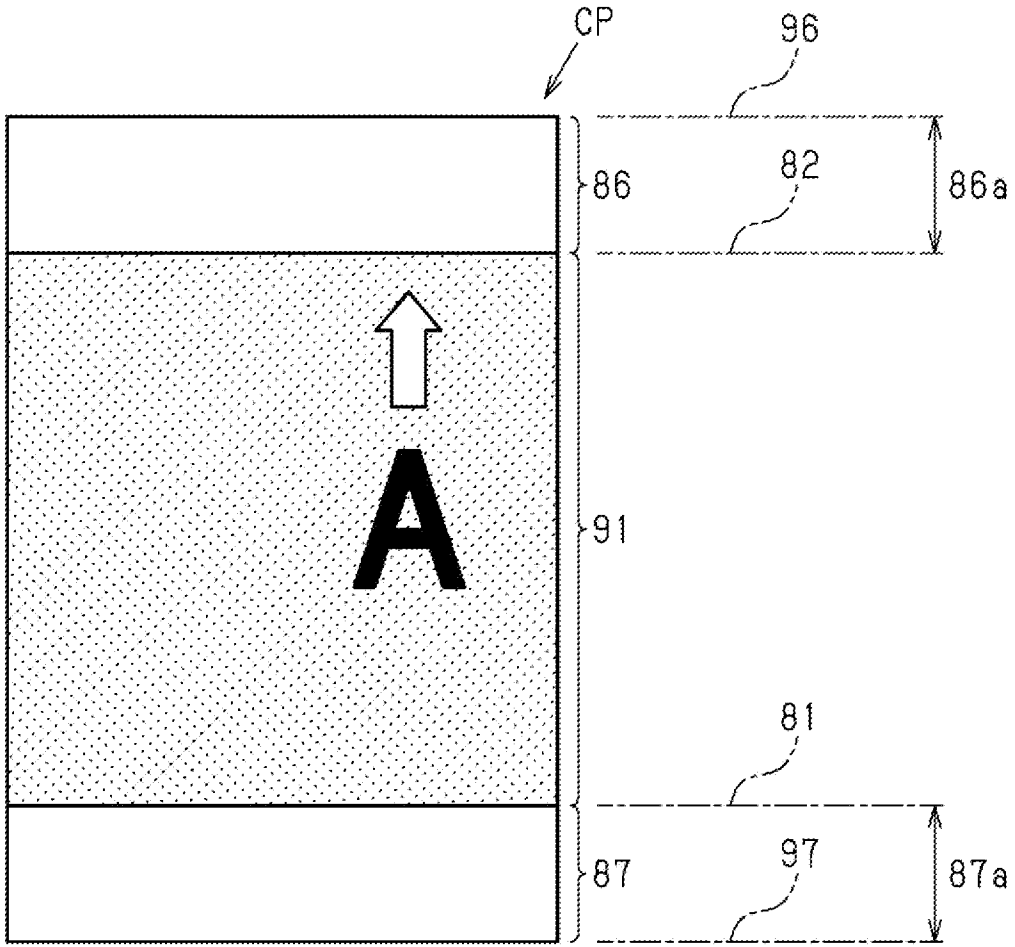
FIG. 6 is a schematic view illustrating the leading end margin, the printing region, and a rear end margin after cutting the rear end on the first surface of the medium subjected to duplex printing.

More specifically, the control unit 53 causes the upper blade being a movable blade to move in the width direction X in a state in which the cut position 97 on the medium P illustrated in FIG. 6 is positioned on the −Z side of the lower blade. The cutting unit 56 has a configuration of cutting the medium P when the movable blade moves to both the +X side and the −X side along the width direction X. Note that, in the present exemplary embodiment, the upper blade being a movable blade has a configuration of scanning in the width direction X, but the upper blade being a movable blade may have a configuration of moving from a position on the −Z side with respect to the medium P to a position on the +Z side with respect to the edge of the lower blade.

The discharge roller pair 62 and the discharge port 21 are arranged downstream of the cutting unit 56. The discharge roller pair 62 is driven by a transport motor independent from a driving source that drives the other roller pairs. Thus, the discharge roller pair 62 solely rotates in both forward and backward directions and stops.

The cutform paper CP illustrated in FIG. 6 is a part cut off from the roll body RP when the cutting unit 56 cuts the medium P on which the printing unit 54 performs printing. Specifically, the cutform paper CP is included in the medium P. Thus, hereinafter, the cutform paper CP may be replaced with the "medium P".

The reference end 96 being the leading end in printing on the first surface is the rear end of the cutform paper CP in printing on the second surface.

After causing the printing unit 54 to perform printing on the first surface of the medium P, the control unit 53 causes the cutting unit 56 to cut the medium P at the cut position 97 positioned upstream of the first end 81 being an upstream end of the first printing region 91 that is formed on the first surface by the printing unit 54. In this manner, the rear end of the cutform paper CP, which corresponds to the cut position 97, and the first end 81 are away from each other. Thus, a rear end margin 87 is formed on the cutform paper CP. Specifically, a region between the first end 81 and the cut position 97 on the first surface of the medium P is the rear end margin.

More specifically, in the present exemplary embodiment, when the control unit 53 causes the printing unit 54 to start printing on the second surface of the medium P, a second printing region 92 is formed at the same position as the first printing region 91 in the transport direction D3. At this moment, the rear end margin 87 is formed in such a way that the leading end of the medium P is positioned downstream of the first nipping position in the transport direction D3.

Note that, in the present exemplary embodiment, the leading end of the medium P at the time of starting printing on the second surface is positioned downstream of the first nipping position, but may be positioned downstream of the position facing the most downstream nozzle 64*b* and upstream of the first nipping position. When the control unit 53 causes the printing unit 54 to start printing on the second surface of the medium P, the rear end margin 87 may be formed in such a way that the leading end of the medium P is positioned downstream of the position facing the most downstream nozzle 64*b* in the transport direction D3.

Figure 7:
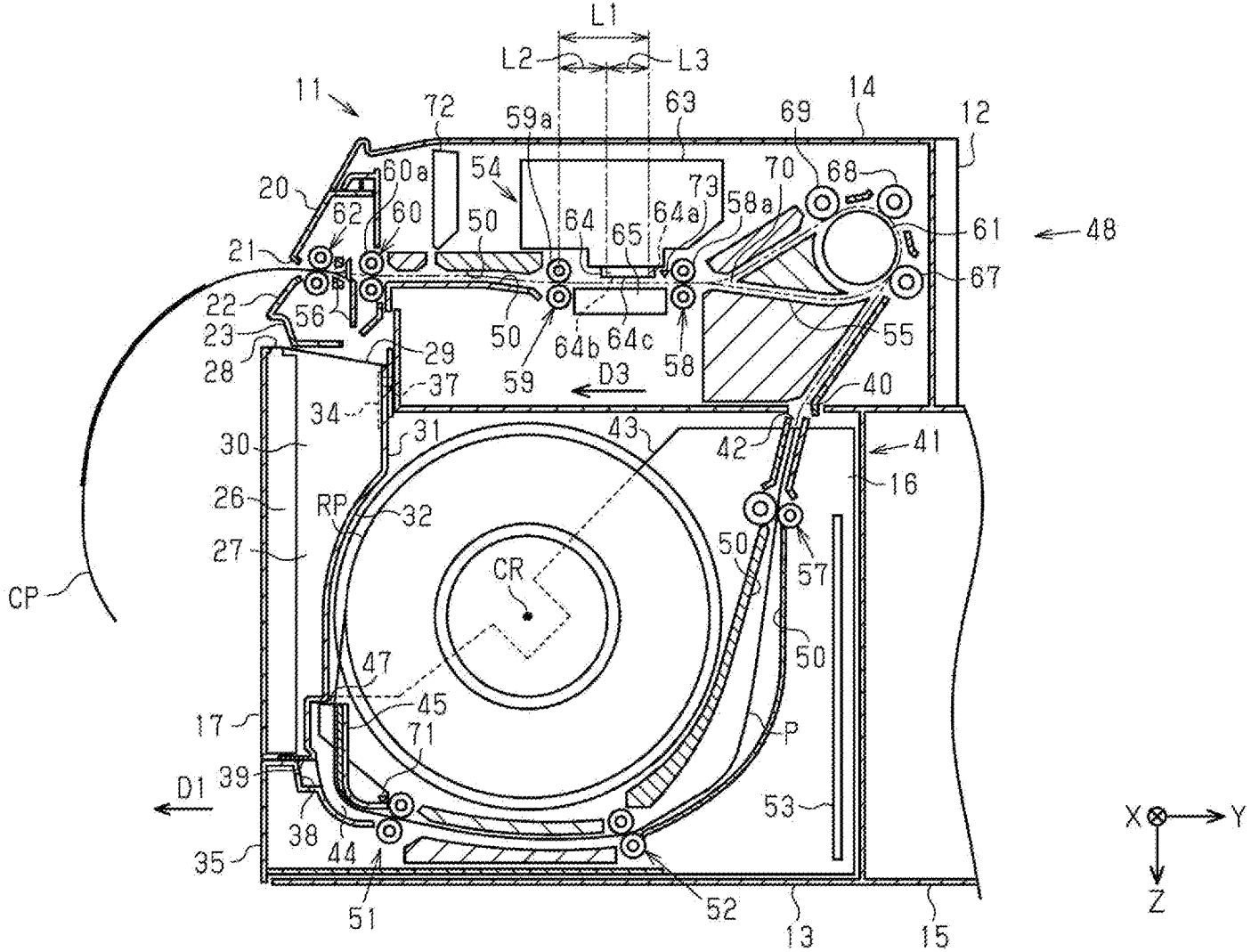
FIG. 7 is a schematic cross-sectional view illustrating a state in which a leading end of a roll body returns to a standby position after cutting the rear end on the first surface of the medium subjected to duplex printing in the first exemplary embodiment.

FIG. 7 illustrates a state of the medium P after the cutting unit 56 performs cutting at the cut position 97. As illustrated in FIG. 7, of the medium P after the cutting unit 56 performs cutting, a part including the roll body RP is transported in a clockwise direction about the intermediation roller 61, and is re-wound back to the roll body RP to a position of being nipped between the transport roller pair 57 and a position at which the leading end is accommodated in the first accommodation part 13.

In duplex printing, after the medium P is cut at the cut position 97, the control unit 53 causes the discharge roller pair 62 to transport the cutform paper CP, which is cut off from the roll body RP, upstream. Further, the transport roller pair 60, the first nipping roller pair 59, and the second nipping roller pair 58 transport the cutform paper CP toward the intermediation roller 61 that reverses the cutform paper CP inside out.

Figure 8:
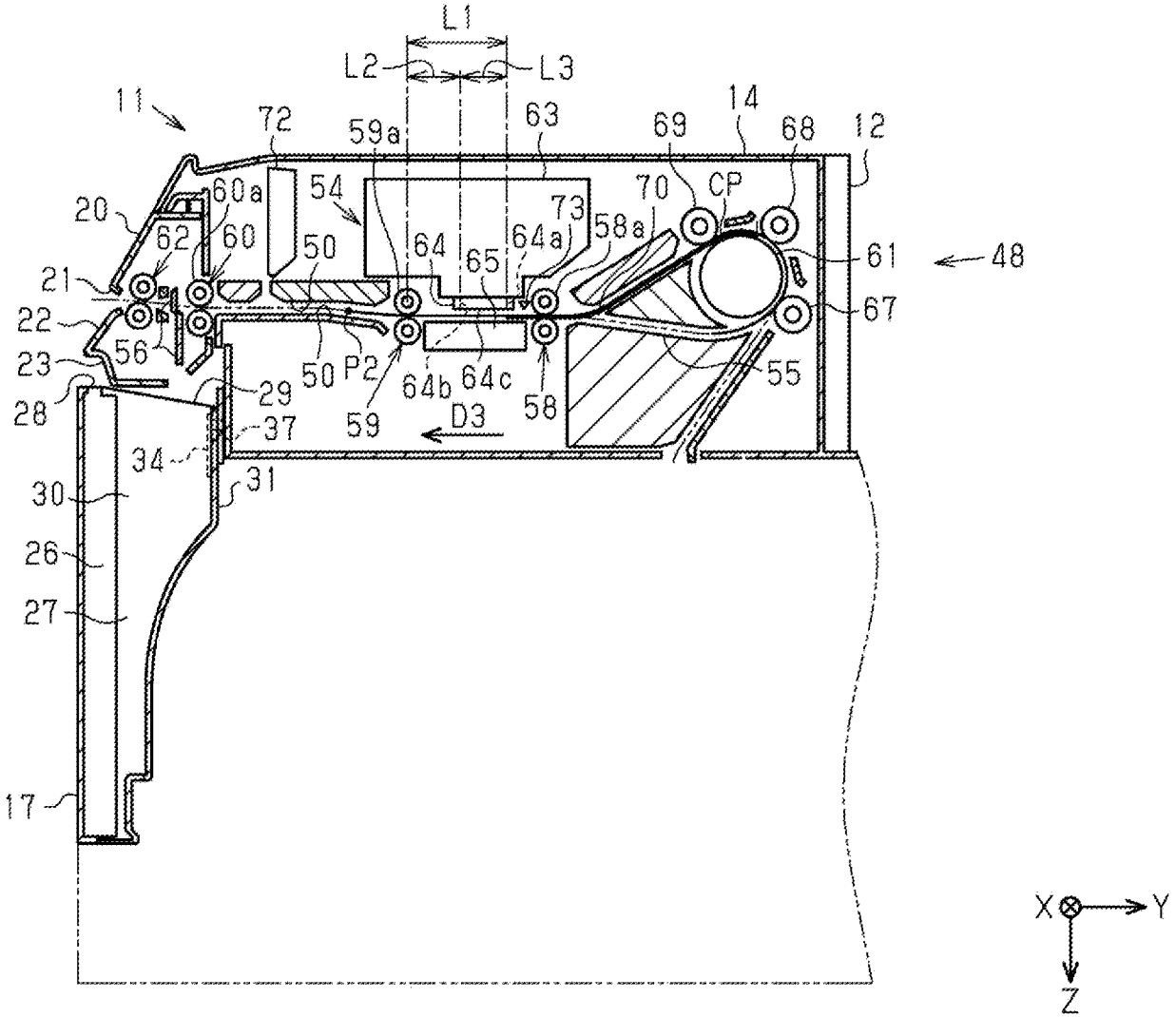
FIG. 8 is a schematic cross-sectional view illustrating a nipped state of a second surface during duplex printing.

FIG. 8 illustrates a state in which the cut position 97 is at a printing start position P2 described later. In the present exemplary embodiment, the cutting unit 56 cuts the medium P in such a way that the length of the cutform paper CP in the transport direction D3 is shorter than a length of a transport path extending from the second nipping roller pair 58, going around the intermediation roller 61, and then arriving at the second nipping roller pair 58 again. In this manner, the second nipping roller pair 58 can transport the cutform paper CP upstream, and can transport the cutform paper CP, which is reversed by the intermediation roller 61, downstream.

The cutform paper CP that is transported upstream is transported in the switchback transport path 55, is nipped between the intermediation roller 61, and the pinch rollers 67, 68, and 69, and is transported in the counter-clockwise direction about the intermediation roller 61. Specifically, the intermediation roller 61 reverses the cutform paper CP inside out, and the cutform paper CP is transported with the reference end 96, which is the leading end at the time of performing printing on the first surface, as a rear end and the cut position 97 as a leading end. The cutform paper CP reversed by the intermediation roller 61 is transported in a state in which the second surface faces upward in the vertical direction Z, in other words, a state in which the second surface faces the printing unit 54. In the present exemplary embodiment, as printing on the second surface, the control unit 53 executes printing on the inner circumferential surface of the roll body RP, which is positioned inside.

The control unit 53 controls the transport unit 48, and thus positions the cut position 97, which corresponds to the leading end of the cutform paper CP, at the printing start position P2. As illustrated in FIG. 8, the printing start position P2 is present downstream of the first nipping position in the transport direction D3, at which the first nipping roller pair 59 nips the medium P. Similarly to the control for positioning the reference end 96 at the printing start position P1, the control unit 53 positions the cut position 97 at the printing start position P2 at the time of performing printing on the first surface. More specifically, after the second sensor 73 detects that the cutform paper CP passes through the cut position 97, the cutform paper CP is transported by a set transport amount. With this, the cut position 97 is positioned at the printing start position P2. The control unit 53 starts printing on the second surface of the cutform paper CP having the cut position 97 positioned at the printing start position P2. In this case, the cutform paper CP is nipped between the second nipping roller pair 58, and is transported by the second nipping roller pair 58. Therefore, the control unit 53 starts printing on the second surface when the cutform paper CP is in the nipped state of being nipped between the first nipping roller pair 59 and nipped between the second nipping roller pair 58. When printing is performed on the second surface of the cutform paper CP, the second printing region 92 illustrated in FIG. 9 is formed on the cutform paper CP.

Figure 9:
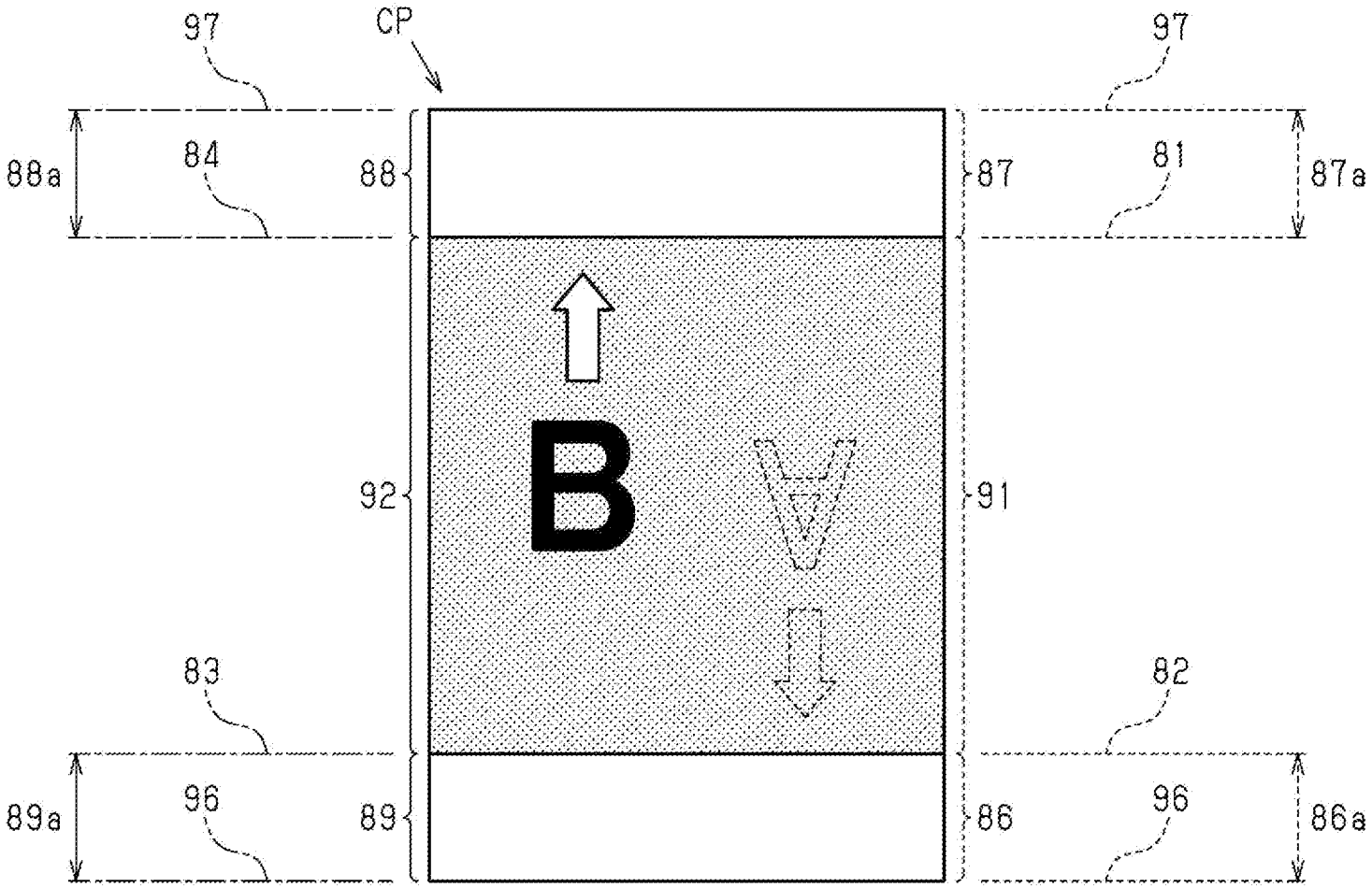
FIG. 9 is a schematic view illustrating a leading end margin, a printing region, and a rear end margin after printing is performed on the second surface of the medium subjected to duplex printing.

The rear end margin 87 illustrated in FIG. 9 is a region between the cut position 97 and the first end 81. Therefore, due to the position of the cut position 97, a margin distance 87*a* of the rear end margin 87 in the transport direction D3 is a distance between the first end 81 and the cut position 97 in the transport direction D3. In the present exemplary embodiment, the position of the cut position 97 on the medium P is set in such a way that the margin distance 87*a* is greater than a most upstream nozzle distance L1 illustrated in FIG. 8. The most upstream nozzle distance L1 is a transport direction distance in the transport direction D3 between a position at which the first nipping roller pair 59 nips the cutform paper CP and the most upstream nozzle 64*a* of the printing unit 54.

The rear end margin 87 illustrated in FIG. 9 is the region between the cut position 97 and the first end 81. Therefore, the margin distance 87*a* of the rear end margin 87, which is a dimension in the transport direction D3, is the distance between the first end and the cut position 97 in the transport direction D3. In printing on the second surface, the control unit 53 causes the printing unit 54 to form the second printing region 92. From the time of forming the first printing region 91 to the time of forming the second printing region, the cutform paper CP is reversed in the transport direction D3. Thus, in printing on the second surface, a leading end margin 88 between the cut position 97, which corresponds to the leading end of the cutform paper CP, and the second printing region 92 is positioned at a position corresponding to the rear end margin 87. Similarly, in printing on the second surface, a rear end margin 89 between the reference end 96, which corresponds to the rear end of the cutform paper CP, and the second printing region 92 is positioned at a position corresponding to the leading end margin 86. In the present exemplary embodiment, the position of the cut position 97 on the medium P is set in such a way that the margin distance 87*a* is greater than the most upstream nozzle distance L1 illustrated in FIG. 8. The most upstream nozzle distance L1 is the transport direction distance in the transport direction D3 between the position at which the first nipping roller pair 59 nips the cutform paper CP and the most upstream nozzle 64*a* of the printing unit 54.

Note that, in the present exemplary embodiment, the printing start position P2 is a position downstream of the first nipping position, but may be a position downstream of the position facing the most downstream nozzle 64*b* and upstream of the first nipping position.

More specifically, through setting of the cut position 97 described above, the range in which the printing start position P2 is set is limited. First, when a fourth end 84 of the second printing region 92 is formed at a position corresponding to the position of the first end 81 on the inside and the outside of the medium, the margin distance 87*a* and a margin distance 88*a* being the distance between the cut position 97 and the fourth end 84 in the transport direction D3 are the same. In a case where the margin distance 88*a* is greater than the most upstream nozzle distance L1 illustrated in FIG. 8, even when the control unit 53 transports the cut position 97 downstream of the first nipping position, the first end 81 is positioned upstream of the position facing the most upstream nozzle 64*a*, in the transport direction D3. Thus, even when liquid for forming the fourth end 84 is jetted from any one of the nozzles provided on the nozzle surface 64*c*, the fourth end 84 can be formed at the position corresponding to the position of the first end 81 on the inside and the outside. Therefore, even when liquid for forming the fourth end 84 is jetted from any one of the nozzles on the nozzle surface 64*c*, the printing start position P2 can be set downstream of the first nipping position.

Further, in a case where the margin distance 88*a* is greater than the inter-nozzle distance L3 illustrated in FIG. 8, which is the transport direction distance between the most upstream nozzle 64*a* and the most downstream nozzle 64*b*, even when the control unit 53 transports the cut position 97 downstream of the position facing the most downstream nozzle 64*b*, the first end 81 is positioned upstream of the position facing the most upstream nozzle 64*a*. Thus, even when the fourth end 84 is formed by jetting liquid from any one of the nozzles from the most downstream nozzle 64*b* illustrated in FIG. 8 to the most upstream nozzle 64*a* illustrated in FIG. 8, the fourth end 84 can be formed at the position corresponding to the position of the first end 81 on the inside and the outside of the medium. Therefore, even when liquid for forming the fourth end 84 is jetted from any one of the nozzles on the nozzle surface 64*c*, the printing start position P2 can be set downstream of the position facing the most downstream nozzle 64*b*, in the transport direction D3.

Further, when printing on the second surface is started from the fourth end 84 of the second printing region 92 of the cutform paper CP, the control unit 53 sets the printing start position P2 on the second surface in such a way that the margin distance 88*a* and the margin distance 87*a* are the same distance.

In printing on the second surface in the present exemplary embodiment, the end of the medium P is curled toward the liquid jetting unit 64 due to curling of the roll body RP, and a deformation amount in the Z direction is largest at the leading end and the rear end of the medium P. The leading end of the medium P in printing on the second surface corresponds to the cut position 97 illustrated in FIG. 9 in printing on the first surface.

When the printer 11 starts printing on the second surface, the printing unit 54 is at the position at which the nozzle surface 64*c* does not face the medium P transported by the transport unit 48. In the present exemplary embodiment, as printing on the second surface, printing is performed on the inner circumferential surface being an inner surface of the roll body RP. When the medium P is supported by the support unit 65, the inner circumferential surface of the roll body RP faces upward in the vertical direction Z. In other words, the second surface of the medium P supported by the support unit 65 faces the printing unit 54. Therefore, when the nozzle surface 64*c* in the printing unit 54 is at the position facing the medium P, the second surface after printing is performed on the first surface faces the nozzle surface 64*c*.

In the present exemplary embodiment, in printing on the first surface, the control unit 53 forms the first printing region 91 in such a way that the distance between the second end 82 and the reference end 96 is greater than the distance between the position of the second nipping roller pair 58 and the most downstream nozzle 64*b* in the transport direction D3. Further, in printing on the second surface, the control unit 53 terminates printing on the second surface that is performed by the printing unit 54 with respect to the medium P in the state of being nipped between the first nipping roller pair 59 downstream of the printing unit 54 and being nipped between the second nipping roller pair 58 upstream of the printing unit 54.

Further, the distance between the second end 82 and the reference end 96 is greater than the inter-nozzle distance L3. In this case, in printing on the second surface, the control unit 53 terminates printing on the second surface that is performed by the printing unit 54 in a state in which the rear end position of the medium P, which is the reference end 96, is positioned upstream of the most upstream nozzle 64*a* in the transport direction D3.

Figure 10:
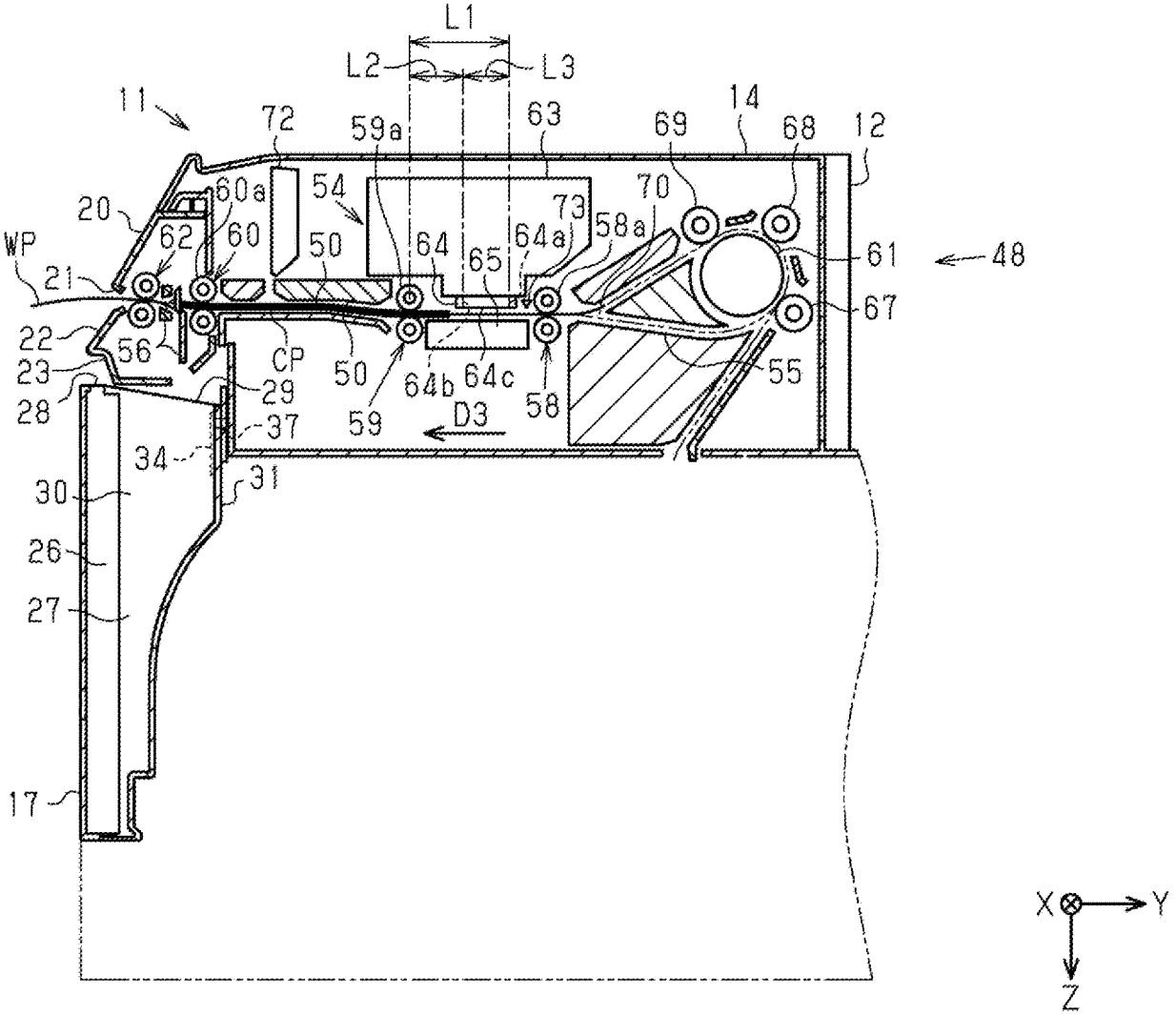
FIG. 10 is a schematic cross-sectional view illustrating a cut state of the leading end margin on the second surface of the medium subjected to duplex printing.

FIG. 10 illustrates a state in which the cutting unit 56 cuts the cutform paper CP at the first end 81. In the present exemplary embodiment, the cutform paper CP cut in FIG. 10 is the cutform paper CP after printing on the second surface is completed.

In the present exemplary embodiment, the leading end margin 88 and the rear end margin 89 of the cutform paper CP are cut off in the stated order. After causing the printing unit 54 to perform printing on the second surface of the cutform paper CP, the control unit 53 causes the cutting unit 56 to cut the cutform paper CP at the first end 81 and at the second end 82 positioned on the opposite side of the first end 81 of the first printing region 91 across the first printing region 91 in the transport direction D3.

Figure 11:
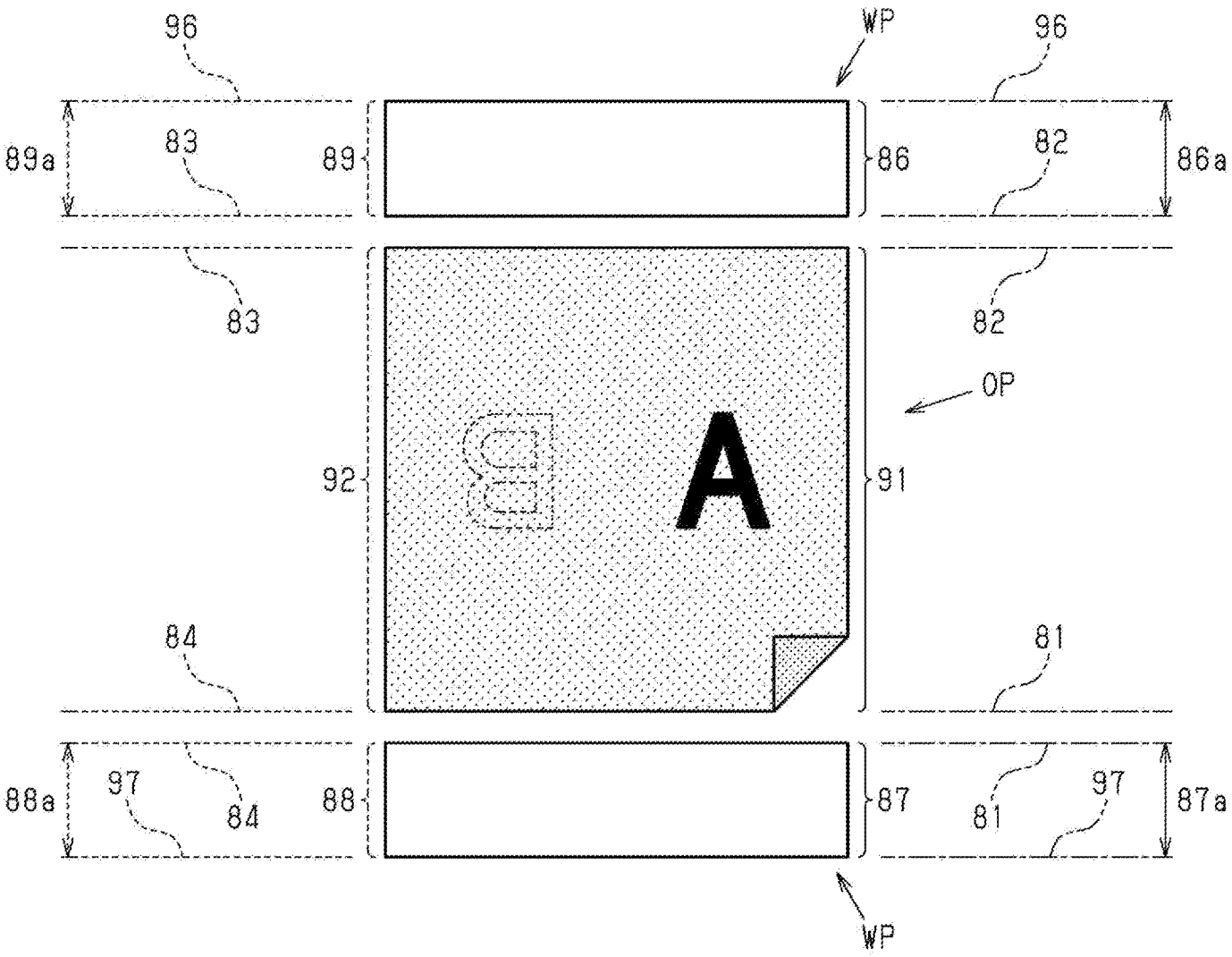
FIG. 11 is a schematic view illustrating a printed object output from the printer and cut pieces accommodated in an accommodation unit.

FIG. 11 illustrates the cutform paper CP after the cutting unit 56 performs cutting. As illustrated in FIG. 11, the control unit 53 causes the cutting unit 56 to cut the cutform paper CP at the first end 81 and the second end 82. The cutform paper CP after cutting is referred to as the cut piece WP. When the cutting unit 56 cuts the cutform paper CP at the first end 81, the cut piece WP corresponding to the rear end margin 87 is cut off from the part in which the first printing region 91 is formed. Further, when the cutting unit 56 cuts the cutform paper CP at the second end 82, the cut piece WP corresponding to the leading end margin 86 is cut off from the part in which the first printing region 91 is formed.

In the present exemplary embodiment, the cutting unit 56 cuts off the cut piece WP corresponding to the rear end margin 87 of the cutform paper CP, which is illustrated in FIG. 11, at a time. After cutting off the cut piece WP corresponding to the rear end margin 87, only the cut piece WP including the first printing region 91 is transported upstream by the transport roller pair 60 that is driven independently from the discharge roller pair 62 that nips the cut piece WP. In this manner, in the transport direction D3, the cut piece WP including the first printing region 91 is separated from the cut piece WP corresponding to the rear end margin 87. When the cut piece WP is transported upstream in an operation of cutting the cut piece WP or the like, which is described later, a risk that the end of the cut piece WP including the first printing region 91 is deformed due to the cut piece WP corresponding to the rear end margin 87 is suppressed.

A piece obtained by further shredding the cut piece WP is referred to as the shredded piece SP. The cut piece WP and the shredded piece SP are included in the medium P. Thus, hereinafter, the description of the cut piece WP may be replaced with the "medium P", and the description of the shredded piece SP may be replaced with the "medium P".

Figure 12:
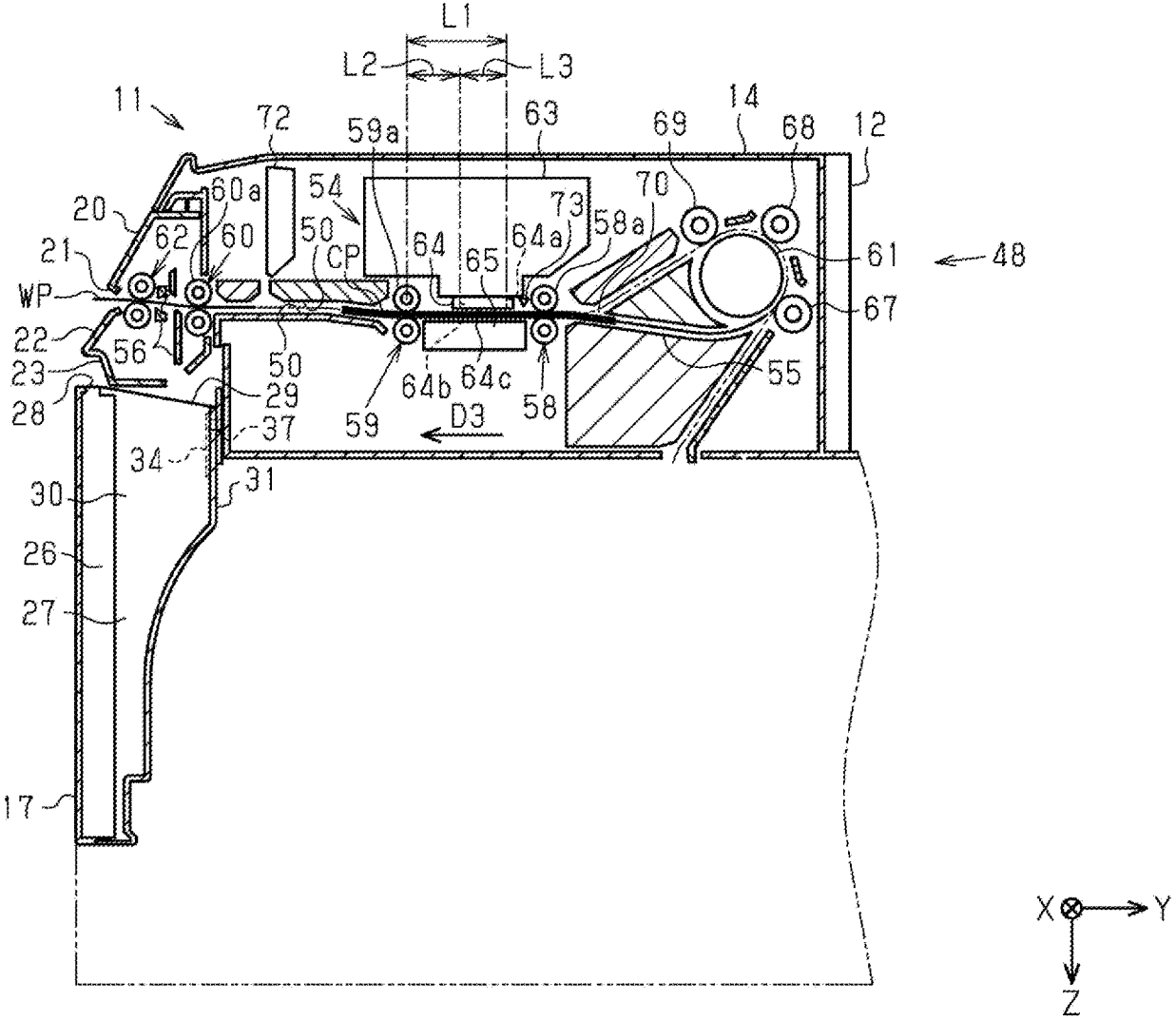
FIG. 12 is a schematic cross-sectional view illustrating a stopping state at a shredding position at which a cut piece on the second surface of the medium subjected to duplex printing is shredded.

As illustrated in FIG. 12, the leading end margin 88 illustrated in FIG. 11 may further be shredded. In the present exemplary embodiment, after cutting off the leading end margin 88 of the cutform paper CP, which is illustrated in FIG. 11, the control unit 53 causes the cutting unit 56 to shred the leading end margin 88 formed into the cut piece WP illustrated in FIG. 11. Specifically, the control unit 53 causes the medium P to be cut between the cut position 97 and the first end 81. The cut position 97 is the downstream end of the cutform paper CP in the transport direction D3 before cutting the leading end margin 88. The control unit 53 may cause the cutting unit 56 to shred the cut piece WP by performing cutting a plurality of times.

The rear end margin 87 illustrated in FIG. 11 may be shredded. As illustrated in FIG. 12, in the present exemplary embodiment, after cutting off the cut piece WP corresponding to the rear end margin 87, the control unit 53 causes the cutting unit 56 to cut the cut piece WP at a position between the cut position 97 being an end of the cut piece WP and the first end 81. In this manner, the cut piece WP corresponding to the rear end margin 87 that is cut off from the cut piece WP including the first printing region 91 is cut at the position between the cut position 97 and the first end 81. With this, the rear end margin 87 is shredded. Note that, of the part that is cut off by cutting the medium P at the position between the cut position 97 and the first end 81, a part in which the first printing region 91 is not formed is referred to as the shredded piece SP. Further, when shredding the rear end margin 87, the cutting unit 56 may cut the cut piece WP at a plurality of positions between the cut position 97 and the first end 81.

Note that, as shredding of the rear end margin 87, the cutting unit 56 may have a configuration of cutting the cutform paper CP at the position between the cut position 97 and the first end 81 before cutting the cutform paper CP at the first end 81. In this case, the cutting unit 56 may also cut the cutform paper CP at the plurality of positions between the cut position 97 and the first end 81.

Figure 13:
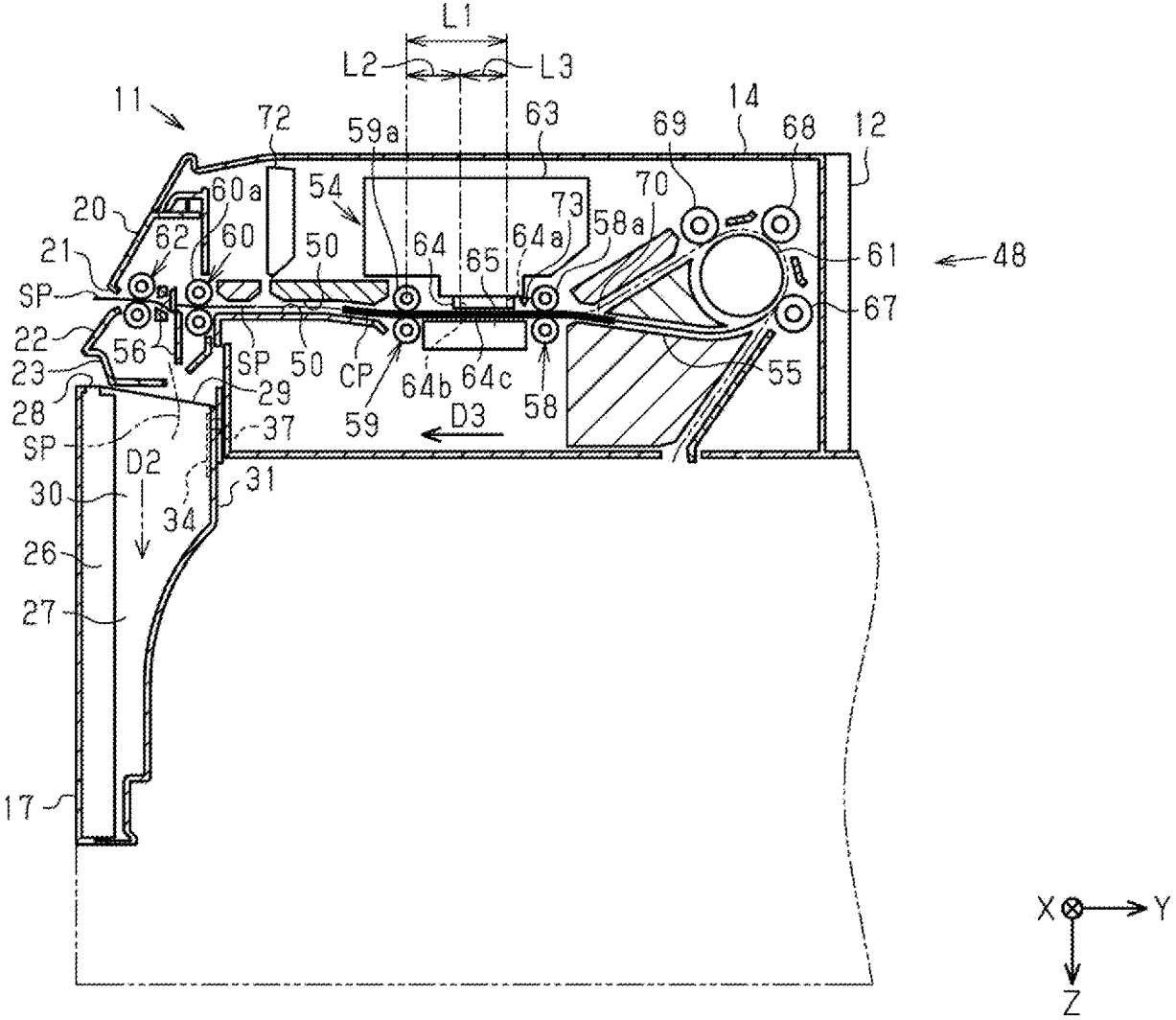
FIG. 13 is a schematic cross-sectional view illustrating a state in which a downstream shredded piece falls down after shredding the leading end margin on the second surface of the medium subjected to duplex printing.

As illustrated in FIG. 13, in the present exemplary embodiment, the control unit 53 causes the cutting unit 56 to cut the cut piece WP in a state in which the transport roller pair 60 and the discharge roller pair 62 nip the cut piece WP corresponding to the rear end margin 87. With this, the rear end margin 87 is shredded. Further, the transport roller pair 60 transports the shredded piece SP downstream from the upstream of the cutting unit 56.

As illustrated in FIG. 13, the printer 11 includes the accommodation portion 28 that accommodates the cut pieces WP being cutting chips generated by cutting the cutform paper CP. When the cutting unit 56 cuts off the leading end margin 86 and the rear end margin 87 of the cutform paper CP, the cut pieces WP falls down as cutting chips. In this case, the reception port 29 and the accommodation portion 28 of the accommodation container 17 are arranged below the cutting unit 56. Thus, the accommodation container 17 is configured to accommodate the cut pieces WP generated when the cutting unit 56 cuts the medium P. Note that cutting chips accommodated in the accommodation container 17 include the shredded pieces SP generated at the time of shredding the rear end margin 87 and the leading end margin 86.

The cut piece WP and the shredded piece SP preferably fall down with an own weight thereof, and then is accommodated in the accommodation container 17. However, a configuration in which the movable blade and the discharge roller pair 62 are controlled to guide the cut piece WP and the shredded piece SP into the accommodation container 17 may be adopted. For example, in a state in which the upper blade being a movable blade is positioned in a region that the medium P passes through in the width direction X, the discharge roller pair 62 rotates backward, and thus the shredded piece SP nipped between the discharge roller pair 62 is transported upstream. At this moment, the shredded piece SP falls down in the accommodation container 17. The discharge roller pair 62 has a configuration of performing nipping at an angle with respect to the vertical direction Z. Thus, when the discharge roller pair 62 transports the nipped shredded piece SP upstream, and the shredded piece SP falls down in the accommodation container 17, the upstream end of the shredded piece SP abuts from obliquely above on the surface of the upper blade at the cutting position. With this, the shredded piece SP falls down along the surface of the upper blade. The similar control is performed for the shredded piece SP positioned upstream of the movable blade after the shredded piece SP is transported downstream of the movable blade in a state in which the movable blade is positioned at the retraction position. With this, the shredded piece SP can be guided into the accommodation container 17.

After causing the cutting unit 56 to cut the cutform paper CP at the position between the cut position 97 and the first end 81, the control unit 53 causes the cutting unit 56 to cut the cutform paper CP at a position between the reference end 96 and the second end 82. Specifically, after cutting off the cut piece WP corresponding to the rear end margin 87, the cut piece WP corresponding to the leading end margin 86 is cut off.

As illustrated in FIG. 11, in the present exemplary embodiment, the cut piece WP corresponding to the leading end margin 86 of the cutform paper CP is cut off at a time. A part from which the cut piece WP corresponding to the leading end margin 86 and the cut piece WP corresponding to the rear end margin 87 are cut off is referred to as the "printed object OP". The discharge roller pair 62 illustrated in FIG. 2 discharges the printed object OP to the outside of the housing unit 12 illustrated in FIG. 2.

Figure 16:
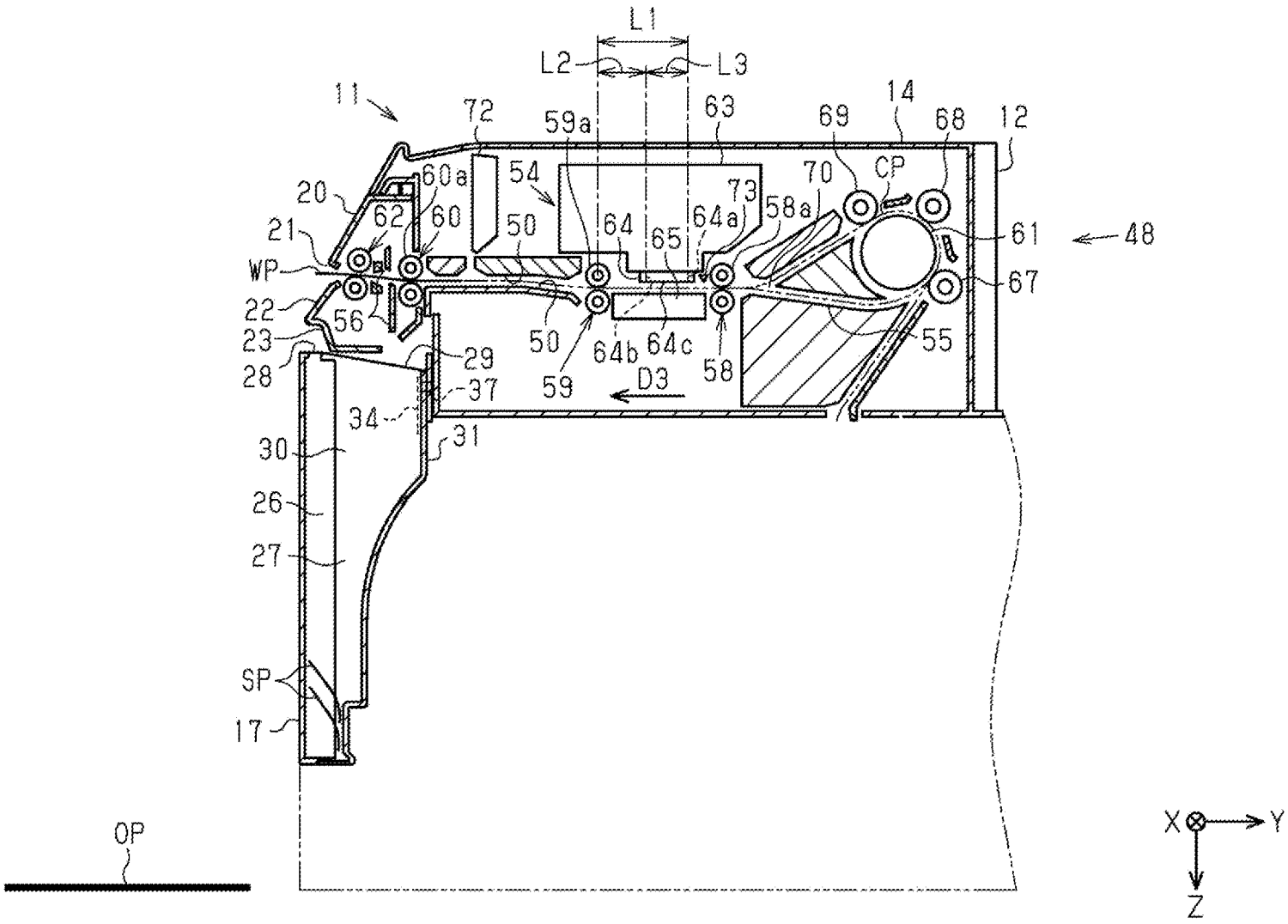
FIG. 16 is a schematic cross-sectional view illustrating a state in which a downstream shredded piece falls down after shredding the rear end margin on the second surface of the medium subjected to duplex printing.

As illustrated in FIG. 16, the leading end margin 86 illustrated in FIG. 11 may be shredded. In the present exemplary embodiment, after cutting off the cut piece WP corresponding to the leading end margin 86, the control unit 53 causes the cutting unit 56 to cut the cut piece WP at the position between the reference end 96 being an end of the cut piece WP and the second end 82. In this manner, the cut piece WP corresponding to the leading end margin 86 that is cut off from the cut piece WP including the first printing region 91 is cut at the position between the reference end 96 and the second end 82. With this, the leading end margin 86 is shredded. Note that, of the part that is cut off by cutting the medium P at the position between the reference end 96 and the second end 82, a part in which the first printing region 91 is not formed is referred to as the shredded piece SP. Further, when shredding the leading end margin 86, the cutting unit 56 may cut the cut piece WP at a plurality of positions between the reference end 96 and the second end 82.

Note that, as shredding of the leading end margin 86, the cutting unit 56 may have a configuration of cutting the cutform paper CP at the position between the reference end 96 and the second end 82 before cutting the cutform paper CP at the second end 82. In this case, the cutting unit 56 may also cut the cutform paper CP at the plurality of positions between the reference end 96 and the second end 82.

Figure 17:
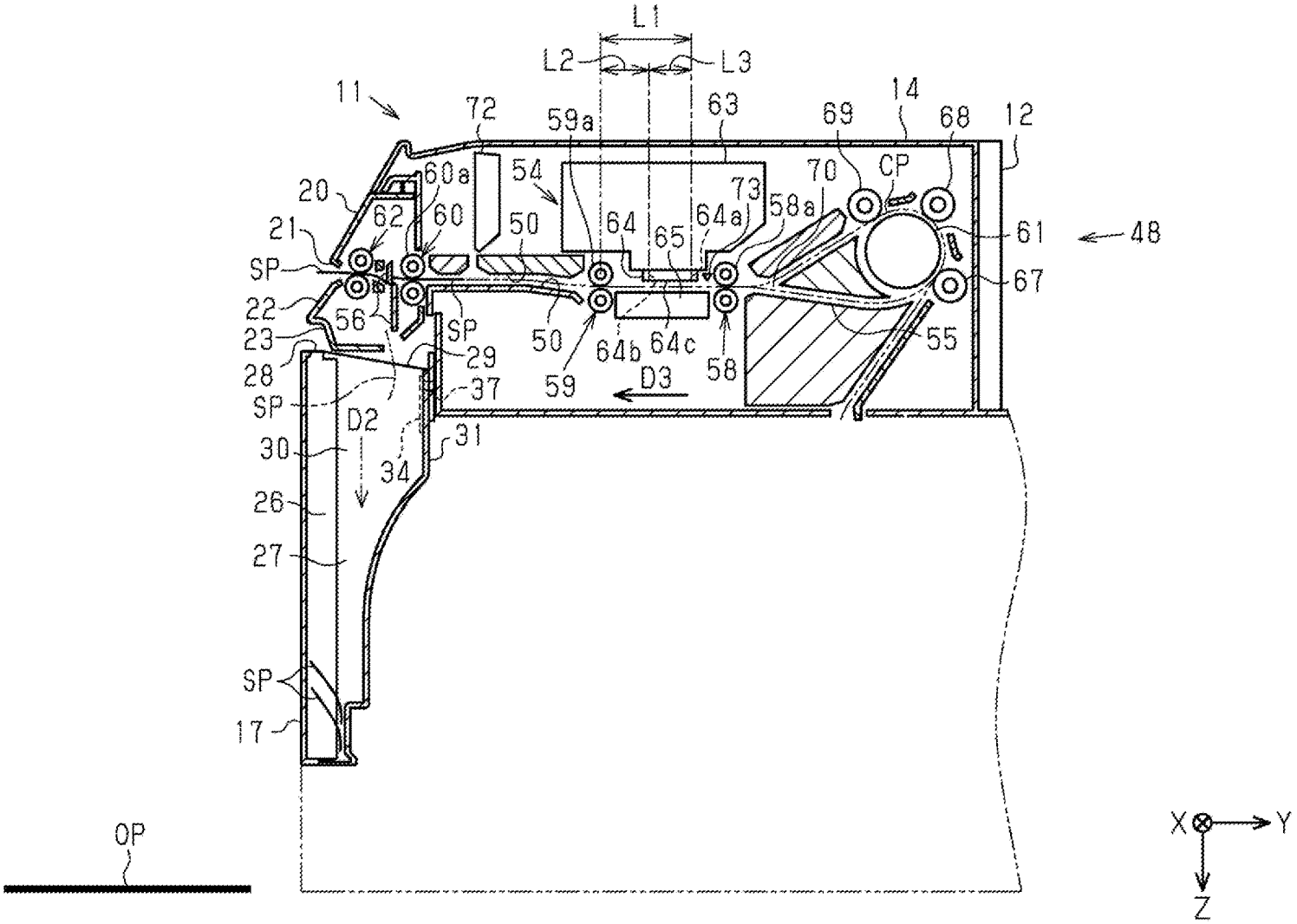
FIG. 17 is a schematic cross-sectional view illustrating a state in which an upstream shredded piece falls down after shredding the rear end margin on the second surface of the medium subjected to duplex printing.

As illustrated in FIG. 17, in the present exemplary embodiment, the control unit 53 causes the cutting unit 56 to cut the cut piece WP in a state in which the transport roller pair 60 and the discharge roller pair 62 nip the cut piece WP corresponding to the leading end margin 86. With this, the leading end margin 86 is shredded.

Note that, in simplex printing, the cutform paper CP and the medium P are in the state illustrated in FIG. 5, and then the medium P is transported upstream to the position illustrated in FIG. 7. After that, in duplex printing, the control unit 53 executes the same operation as the operation of sequentially cutting the leading end margin 88 and the rear end margin 89 being two positions of the cutform paper CP, which are illustrated in FIG. 9. The cutform paper CP from which the leading end margin 86 and the rear end margin 87 illustrated in FIG. 6 are sequentially cut is discharged to the outside of the housing unit 12.

In the present exemplary embodiment, a configuration in which the cutting unit 56 cuts the leading end margin 86 and the rear end margin 87, which are illustrated in FIG. 6, from the cutform paper CP is adopted. However, the printer 11 may not include the cutting unit 56. Specifically, in a state in which the elongated medium P is fed from the roll body in a state of being wound up in a roll shape, a part of the medium P subjected to printing at least on the first surface is discharged to the outside of the housing unit 12. A user cuts off the rear end of the discharged medium P at a freely-selected position, and thus the cutform paper CP is formed. Then, a user cuts off a margin of the cutform paper CP. Such a configuration may be adopted.

In this case, there may be adopted a configuration in which the printer 11 does not include the switchback transport path 55 illustrated in FIG. 2 that transports the cutform paper CP below the printing unit 54 in a state in which the second surface thereof faces the printing unit 54 after the transport unit 48 transports the cutform paper CP upstream after printing is performed on the first surface.

Further, in this case, the printer 11 may include a manual insertion supply path that communicate the upstream of the printing unit 54 and the housing unit 12 with each other. To an inserter capable of suppling the cutform paper CP to the manual insertion supply path, a user may set the cutform paper CP after printing is performed on the first surface and with a margin which is not cut out, in such a way that the reference end 96 illustrated in FIG. 6 is positioned downstream in the transport direction D3 and that the second surface of the cutform paper CP after printing is performed on the first surface is transported below the printing unit 54 in a state of facing the printing unit 54. When printing is performed on the first surface of the cutform paper CP, the control unit 53 determines a distance from the reference end 96 illustrated in FIG. 6 to the second end 82 illustrated in FIG. 6. Thus, the control unit 53 can match a position of a third end 83 of the second surface of the cutform paper CP with the position of the second end 82 illustrated in FIG. 9.

Further, as illustrated in FIG. 9, in a state in which the leading end margin 88 and the rear end margin 89 of the cutform paper CP are left, the cutform paper CP after printing is performed on both the surfaces is discharged to the outside of the housing unit 12. Then, a user cuts off the leading end margin 88 and the rear end margin 89 of the discharged cutform paper CP. In this manner, the printed object OP illustrated in FIG. 11 is output. Such a configuration may be adopted.

Next, actions of the present exemplary embodiment are described.

As illustrated in FIG. 1, when the roll body RP is loaded in the drawer unit 16, the drawer unit 16 is pulled out, and the roll body RP is set to the side wall portions 43. Further, the leading end of the medium P unwound from the roll body RP is manually inserted into the insertion port 44. Subsequently, the positioning member 47 moves, and the medium P is positioned on the −X side in the width direction X.

As illustrated in FIG. 2, the leading end of the medium P advances further behind the insertion port 44, and contacts with the transport roller pair 51. Then, the first sensor 71 detects the leading end of the medium P, the transport roller pair 51 slightly rotates, and thus the leading end of the medium P is drawn in and nipped between the transport roller pair 51. When the drawer unit 16 is restored from the pulled-out state to the original state illustrated in FIG. 2, the medium P is transported downstream by the transport roller pairs 51, 52, and 57, the roll body RP rotates in the counter-clockwise direction, and the leading end of the medium P is transported to the standby position illustrated in FIG. 2 before the printer 11 starts an operation. Thus, preparation for printing is completed.

Figure 19:
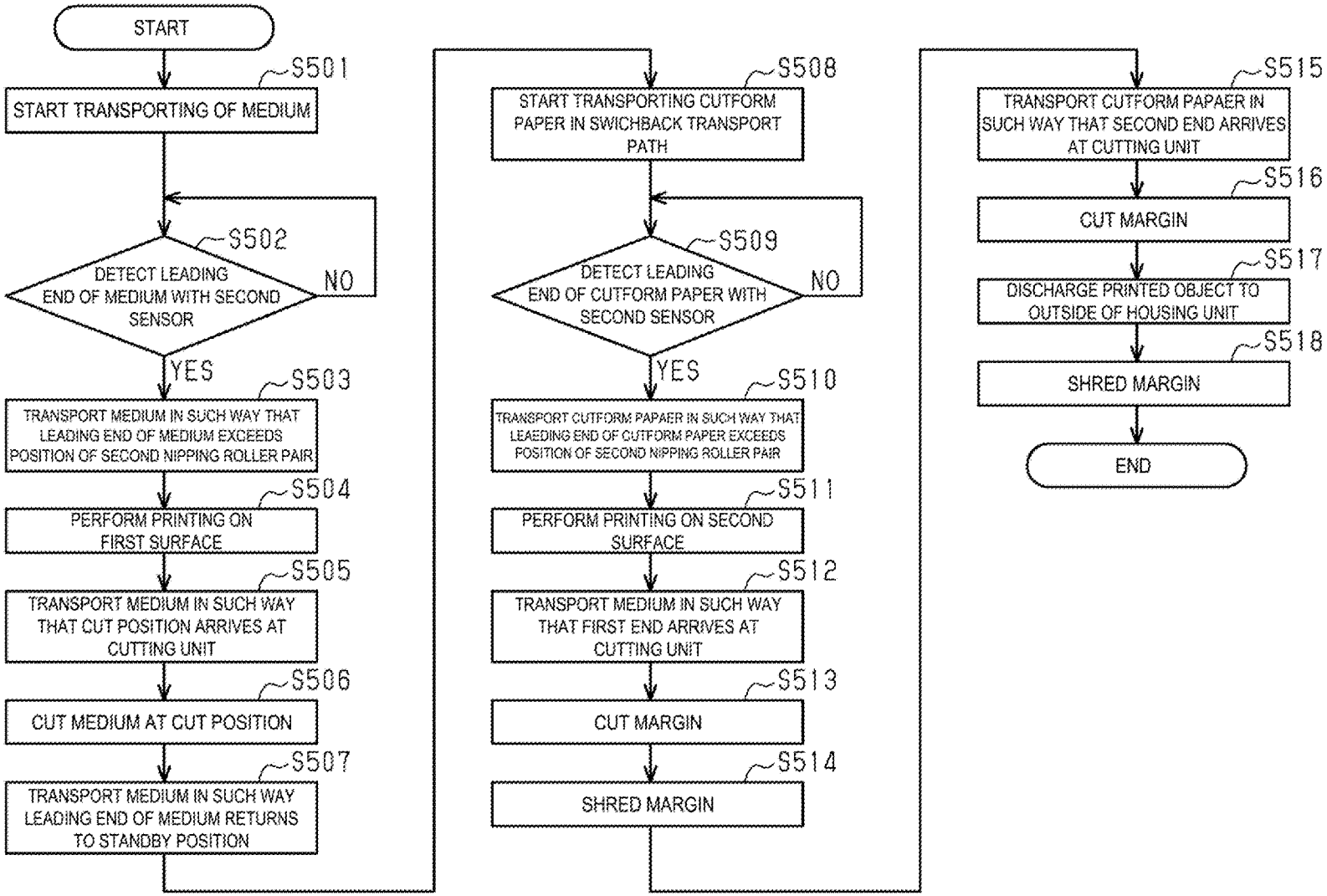
FIG. 19 is a flowchart illustrating a flow of control during duplex printing.

Hereinafter, with reference to the flowchart in FIG. 19, a flow of control in duplex printing and an effect in each operation are described.

In Step S501, the control unit 53 controls the transport unit 48, and starts transporting the medium P, which is fed from a state of being wound up in a roll shape, downstream.

In Step S502, the control unit 53 determines whether the second sensor 73 detects passing of the leading end of the medium P. As illustrated in FIG. 3, when the second sensor 73 detects passing of the leading end of the medium P, as Step S503, the control unit 53 causes the transport unit 48 to transport the medium P by the transport amount M. With this, the leading end of the medium P is positioned at the printing start position P1.

As illustrated in FIG. 3, in a state in which the leading end of the medium P is nipped between the first nipping roller pair 59, the control unit 53 starts printing on the first surface of the medium P, as Step S504. In Step S504, the first printing region 91 is formed on the first surface of the medium P. In the present exemplary embodiment, when the printing unit 54 starts formation of the first printing region 91, printing on the first surface in Step S504 is started. Further, in the present exemplary embodiment, when the printing unit 54 terminates formation of the first printing region 91, printing on the first surface in Step S504 is terminated. Further, the control unit 53 causes the printing unit 54 to form the first end 81 on the medium P, and then terminates printing on the first surface as Step S504.

In the present exemplary embodiment, the first surface of the medium P is the outer circumferential surface of the roll body RP. When the medium P is nipped between the second nipping roller pair 58, and the reference end 96 being the leading end of the medium P passes on the support unit 65 toward the first nipping roller pair 59, the inner circumferential surface of the medium P faces the support unit 65.

Due to Step S503, the leading end of the medium P is positioned at the printing start position P1 downstream of the first nipping position. Thus, in a state in which the medium P is nipped between the first nipping roller pair 59, printing on the first surface in Step S504 is started. Therefore, even when curling caused in the roll body RP still remains on the medium P, a deformation amount of the leading end of the medium P is limited within a certain range. However, curling of the roll body RP is strong, and a curl at the leading end of the medium P is large, the curl makes the leading end of the medium P to have a shape protruding toward the liquid jetting unit 64. Thus, the leading end of the medium P is easily lifted up from the support unit 65. In a case where the medium P is lifted up from the support unit 65, when the carriage 63 scans in the width direction X, the leading end of the medium P may contact with the nozzle surface 64*c* of the liquid jetting unit 64 in some cases. In the present exemplary embodiment, the leading end of the medium P is nipped between the first nipping roller pair 59, and hence a curl at the leading end of the medium P can be suppressed. Therefore, a risk that the leading end of the medium P contacts with the nozzle surface 64*c* when the carriage 63 scans in the width direction X can be lowered.

In the present exemplary embodiment, the second printing region that is formed on the second surface of the medium P in Step S511 described later is formed correspondingly to the first printing region 91 on the inside and the outside. Thus, when formation of the second printing region 92 is terminated, a range in which the reference end 96 being the rear end of the medium P can be positioned varies depending on a positional relationship between the second end 82 of the first printing region 91 formed on the first surface in Step S504 and the reference end 96.

The control unit 53 may set the printing start position P1 on the first surface in such a way that the distance between the second end 82 and the reference end 96 is greater than the distance between the position of the second nipping roller pair 58 and the most downstream nozzle 64*b* in the transport direction D3. With this setting, when the second surface faces vertically upward, and the second end 82 is at the position corresponding to the most downstream nozzle 64*b* in the transport direction D3, the reference end 96 is positioned upstream of the second nipping roller pair 58. Thus, even when the third end 83 being the termination position of the printing region on the second surface is formed by jetting liquid from any one of the nozzles from the most downstream nozzle 64*b* to the most upstream nozzle 64*a*, the third end 83 can be formed at the position corresponding to the position of the second end 82 on the inside and the outside of the medium P, in a state in which the reference end 96 is positioned upstream of the second nipping roller pair 58. With this, in printing on the second surface, a risk that the rear end of the medium P contacts with the nozzle surface 64*c* when the carriage 63 scans in the width direction X is lowered.

The control unit 53 may set the printing start position P1 on the first surface in such a way that the distance between the second end 82 and the reference end 96 is greater than the inter-nozzle distance L3 illustrated in FIG. 3. With this setting, when the second surface faces vertically upward, and the second end 82 is at the position corresponding to the most downstream nozzle 64*b* in the transport direction D3, the reference end 96 is positioned upstream of the position corresponding to the most upstream nozzle 64*a*. Thus, even when the third end 83 being the termination position of the printing region on the second surface is formed by jetting liquid from any one of the nozzles from the most downstream nozzle 64*b* to the most upstream nozzle 64*a*, the third end 83 can be formed at the position corresponding to the position of the second end 82 on the inside and the outside of the medium, in a state in which the reference end 96 is positioned upstream of the most upstream nozzle 64*a*. With this, a risk that the rear end of the medium P contacts with the nozzle surface 64*c* when the carriage 63 scans in the width direction X is lowered.

In Step S505, after printing on the first surface is terminated, the control unit 53 causes the transport unit 48 to transport the medium P in such a way that the cut position 97 arrives at the cutting unit 56.

In the present exemplary embodiment, the second printing region 92 that is formed on the second surface of the medium P in Step S511 described later is formed correspondingly to the first printing region 91 on the inside and the outside of the medium P. Thus, when formation of the second printing region 92 is started, a range in which the cut position 97 being the leading end of the medium P can be positioned varies depending on a positional relationship between the first end 81 of the first printing region 91 that is formed on the first surface in Step S504 and the cut position 97 that is cut by the cutting unit 56 in Step S505.

The control unit 53 sets the cut position 97 in such a way that the distance between the first end 81 and the cut position 97 is greater than the most upstream nozzle distance L1 being the distance between the position of the first nipping roller pair 59 and the most upstream nozzle 64*a* in the transport direction D3. With this setting, when the first end 81 is positioned at the position corresponding to the most upstream nozzle 64*a* in the transport direction D3, the cut position 97 being the leading end of the medium P when the second surface faces vertically upward is positioned downstream of the first nipping position. Specifically, while positioning the cut position 97 downstream of the first nipping position, the control unit 53 can position the first end 81 upstream of the position corresponding to the most upstream nozzle 64*a*. Thus, in a state in which the cut position 97 is positioned downstream of the first nipping position, in other words, in the nipped state, the fourth end 84 can be formed at the position corresponding to the position of the first end 81 on the inside and the outside of the medium P. Therefore, in the nipped state, the control unit 53 can start printing on the second surface, that is, form the second printing region 92 at the position corresponding to the first printing region 91 on the inside and the outside of the medium P. With this, a deformation amount of the end of the medium P at the time of starting printing on the second surface is limited within a certain range.

The control unit 53 may set the cut position 97 in such a way that the distance between the first end 81 and the cut position 97 is greater than the inter-nozzle distance L3. With this setting, the first end 81 is positioned at the position corresponding to the most upstream nozzle 64*a* in the transport direction D3, the cut position 97 is positioned downstream of the position corresponding to the most downstream nozzle 64*b*. Thus, even when the fourth end 84 being the start position of the printing region on the second surface is formed by jetting liquid from any one of the nozzles from the most downstream nozzle 64*b* to the most upstream nozzle 64*a*, the fourth end 84 can be formed at the position corresponding to the position of the first end 81 on the inside and the outside of the medium, in a state in which the cut position 97 is positioned downstream of the position corresponding to the most downstream nozzle 64*b*. With this, in printing on the second surface, a risk that the leading end of the medium P contacts with the nozzle surface 64*c* when the carriage 63 scans in the width direction X is lowered.

As illustrated in FIG. 5, in Step S506, the control unit 53 causes the cutting unit 56 to cut the medium P at the cut position 97. The cutform paper CP is cut off from the medium P.

As illustrated in FIG. 7, in Step S507, the control unit 53 causes the transport unit 48 to position the leading end of the medium P at the standby position.

In Step S508, the control unit 53 causes the transport unit 48 to start transporting of the cutform paper CP in the switchback transport path 55. The cutform paper CP to be transported in the switchback transport path 55 moves toward the second sensor 73 via the intermediation roller 61.

In Step S509, the control unit 53 determines whether the second sensor 73 detects passing of the leading end of the cutform paper CP. As illustrated in FIG. 8, when the second sensor 73 detects passing of the leading end of the medium P, as Step S510, the control unit 53 causes the transport unit 48 to transport the cutform paper CP. With this, the leading end of the cutform paper CP is positioned at the printing start position P2. The printing start position P2 is downstream of the first nipping position. Further, in the present exemplary embodiment, the printing start position P2 is set within such a range that the first end 81 is positioned upstream of the most downstream nozzle 64*b* when the leading end of the cutform paper CP is positioned at the printing start position P2. Thus, in the nipped state, the fourth end 84 can be formed at the position corresponding to the first end 81 on the inside and the outside of the medium P.

In the present exemplary embodiment, the second surface is the inner circumferential surface of the roll body RP in a state of being wound up in a roll shape. When the medium P is nipped between the second nipping roller pair 58, and the leading end of the medium P passes on the support unit 65 toward the first nipping roller pair 59, the inner circumferential surface of the medium P faces the liquid jetting unit 64. Specifically, in Step S510, when the printing unit 54 is at the position at which the nozzle surface 64*c* does not face the medium P transported by the transport unit 48, the control unit 53 transports the medium P in a state in which the inner circumferential surface of the medium P faces upward, the inner circumferential surface positioned inside when the medium P is in a state of being wound up in a roll shape. Therefore, in printing on the inner circumferential surface, specifically, in a case where printing is performed on the inner circumferential surface of the medium P, when the printing unit 54 is at the position at which the nozzle surface 64*c* faces the medium, the inner circumferential surface faces the nozzle surface 64*c*.

In printing on the second surface of the medium P in the present exemplary embodiment, when the end of the medium P passes on the support unit 65, the end of the medium P is curled toward the liquid jetting unit 64 due to curling of the roll body RP, and a deformation amount in the Z direction is largest at the leading end and the rear end of the medium P. In a case where a deformation amount of the medium P in the Z direction is large, and the posture of the medium P is not corrected when printing is to be performed on the medium P, a predetermined gap between the surface of the liquid jetting unit 64 and the medium P is not generated in some cases.

As illustrated in FIG. 8, after Step S510, the printing start position P2 at which the cut position 97 being the leading end of the medium P is positioned is downstream of the first nipping position. In this case, due to setting of the cut position 97 in Step S505 described above, the first end 81 is positioned upstream of the most downstream nozzle 64*b*. Thus, in a state in which the medium P is pressed by the first nipping roller pair 59, printing on the second surface for forming the second printing region 92 corresponding the first printing region 91 can be started. Specifically, when the control unit 53 starts printing on the second surface as Step S511 described later, a curl at the leading end of the medium P is suppressed by the first nipping roller pair 59. Thus, a risk that the leading end of the medium P contacts with the nozzle surface 64*c* when the carriage 63 scans in the width direction X or the medium P is transported can be lowered.

In Step S511, the control unit 53 controls the printing unit 54, and performs printing on the second surface of the medium P in a state in which the leading end of the medium P is nipped between the first nipping roller pair 59. In Step S511, the second printing region 92 is formed on the medium P. Printing on the second surface in Step S511 is started when the printing unit 54 starts formation of the second printing region 92, and is terminated when formation of the second printing region 92 is terminated.

Note that, when printing on the second surface is started, the cutform paper CP is nipped between the second nipping roller pair 58. Thus, printing on the second surface is started in the nipped state in which the cutform paper CP is nipped between the first nipping roller pair 59 and nipped between the second nipping roller pair 58. Thus, a deformation amount at the end of the cutform paper CP in printing on the second surface is limited within a certain range. Therefore, even in a configuration in which printing on the second surface is performed with respect to the medium P having a moisture content changed after printing on the first surface, a deformation amount at the end of the cutform paper CP is limited within a certain range, and hence the second printing region 92 can be formed at a desired position corresponding to the first printing region 91.

Note that, in the present exemplary embodiment, the printing start position P2 being the leading end position of the medium P at the time of starting printing is a position downstream of the first nipping position, but may be a position downstream of the position facing the most downstream nozzle 64*b* and upstream of the first nipping position.

As illustrated in FIG. 8, due to setting of the cut position 97 in Step S505 described above, the control unit 53 causes the printing unit 54 to start printing on the second surface in Step S510, in a state in which the position of the leading end being the cut position 97 of the medium P is downstream of the position of the most downstream nozzle 64*b* in the transport direction D3. At this moment, even when liquid is jetted from any one of the nozzles from the most downstream nozzle 64*b* to the most upstream nozzle 64*a*, the liquid reaches the surface of the medium P, and the fourth end 84 is formed on the medium P. Further, the control unit 53 causes the printing unit 54 to start printing on the second surface in a state in which the leading end of the medium P having the largest deformation amount to the most Z side is positioned downstream of the position of the most downstream nozzle 64*b* in the transport direction D3. Thus, a risk that the leading end of the medium P contacts with the nozzle surface 64*c* when the carriage 63 scans in the width direction X is lowered.

Specifically, in Step S510, the control unit 53 causes the transport unit 48 to transport the leading end of the medium P to the printing start position P2 being the position downstream of the position facing the most downstream nozzle 64*b* of the nozzle surface 64*c*, in the transport direction D3. Further, in Step S511, the control unit 53 causes the printing unit 54 to start printing on the second surface, that is, printing on the inner circumferential surface with respect to the medium P having the leading end transported to the printing start position P2. Further, in Step S511, the first end 81 being the termination position of the printing region is formed on the medium P, and then the control unit 53 terminates printing on the first surface.

In printing on the second surface in the present exemplary embodiment, the reference end 96 being the rear end of the medium P passes on the support unit 65, the rear end of the medium P is curled toward the liquid jetting unit 64 due to curling of the roll body RP.

Printing on the second surface is started due to setting of the position of the reference end 96 of the first surface in Step S504 described above, and printing is terminated. During this period, in Step S511, the cutform paper CP may be controlled in such a way that the reference end 96 being the rear end of the medium P is positioned upstream of the position of the second nipping roller pair 58 in the transport direction D3. Specifically, a curl at the leading end of the medium P is suppressed by the second nipping roller pair 58. Thus, a risk that the reference end 96 being the rear end of the medium P, which is illustrated in FIG. 9, contacts with the nozzle surface 64*c* when the carriage 63 scans in the width direction X is lowered.

Note that, in the present exemplary embodiment, the rear end position of the medium P at the time of terminating printing is a position upstream of the second nipping position. However, the rear end position may be upstream of the position facing the most upstream nozzle 64*a* and downstream of the first nipping position.

Printing on the second surface is started due to setting of the position of the reference end 96 of the first surface in Step S504 described above, and printing is terminated. During this period, in Step S511, the cutform paper CP may be controlled in such a way that the reference end 96 being the rear end of the medium P is positioned upstream of the position of the most upstream nozzle 64*a* in the transport direction D3. With this, the reference end 96 of the medium P is upstream of the position of the most upstream nozzle 64*a* in the transport direction D3. Thus, a risk that the reference end 96 being the rear end of the medium P, which is illustrated in FIG. 9, contacts with the nozzle surface 64*c* when the carriage 63 scans in the width direction X is lowered.

Further, the control unit 53 terminates printing on the second surface in the nipped state. Thus, the second printing region 92 can be formed at a desired position corresponding to the first printing region 91.

As illustrated in FIG. 10, in Step S512, the control unit 53 causes the transport unit 48 to transport the cutform paper CP in such a way that the fourth end 84 of the second surface arrives at the cutting unit 56 after terminating printing on the second surface.

In Step S513, the control unit 53 causes the cutting unit 56 to cut the cutform paper CP at the fourth end 84 of the second surface. The cutform paper CP is cut in a state of being nipped between the transport roller pair 60 and the discharge roller pair 62 in an unmovable and fixed manner Thus, the cutform paper CP is cut accurately at the fourth end 84. Specifically, the cut piece WP is cut off from the cutform paper CP.

Further, as illustrated in FIG. 12, the control unit 53 causes the transport unit 48 to transport the cut piece WP in such a way that the center of the cut piece WP being the leading end margin 88 of the second surface and the rear end margin 87 of the first surface, which is illustrated in FIG. 11, arrives at the cutting unit 56, and to transport the cutform paper CP upward by a predetermined distance. As long as the cutform paper CP is away from the cut piece WP by a slight amount or more, the distance is not limited.

As illustrated in FIG. 13, in Step S514, the control unit 53 causes the cutting unit 56 to cut the cut piece WP in half. The cut piece WP is divided into two shredded pieces SP. With regard to one shredded piece SP nipped between the discharge roller pair 62, the discharge roller pair 62 is reversed in a state in which the upper blade of the cutting unit 56 is at the cutting position. With this, the upper end of the shredded piece SP abuts on the upper blade of the cutting unit 56, falls down in a falling direction D2 to the +Z side in the vertical direction Z, and is accommodated in the accommodation container 17.

Further, the control unit 53 causes the cutting unit 56 to position the upper blade at the retraction position. In this state, the control unit 53 causes the transport unit 48 to transport the other shredded piece SP, which is nipped between the transport roller pair 60, downstream of the cutting unit 56. Then, the shredded piece SP is nipped between the discharge roller pair 62. The distance between the transport roller pair 60 and the discharge roller pair 62 is smaller than at least a half of the margin distance 88*a*, that is, the length of the shredded piece SP in the transport direction D3. Thus, the shredded piece SP is transported downstream of the cutting unit 56.

Figure 14:
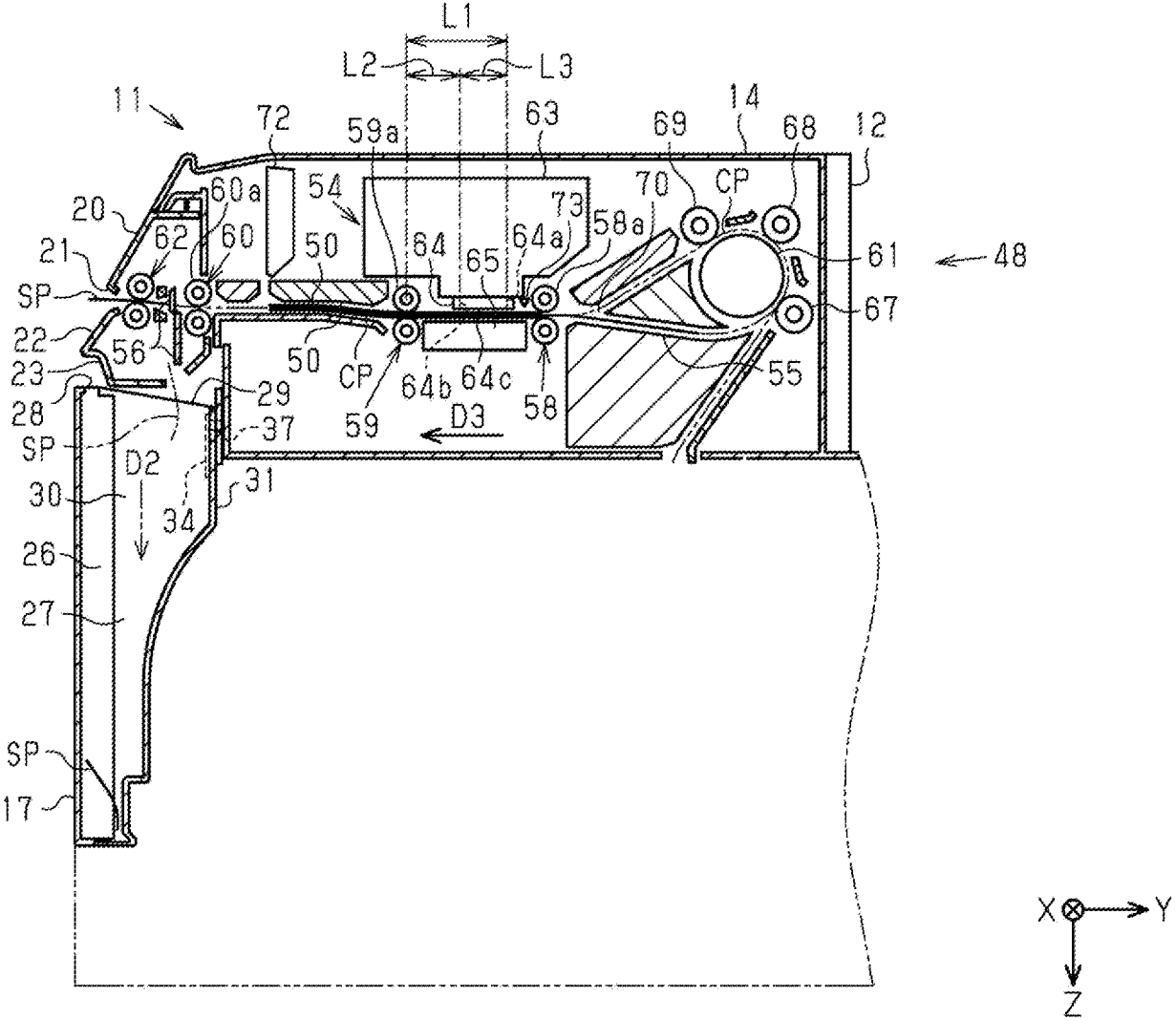
FIG. 14 is a schematic cross-sectional view illustrating a state in which an upstream shredded piece falls down after shredding the leading end margin on the second surface of the medium subjected to duplex printing.

As illustrated in FIG. 14, the control unit 53 causes the cutting unit 56 to move the upper blade to the cutting position again, and the discharge roller pair 62 is reversed in this state. With this, the upper end of the shredded piece SP abuts on the upper blade of the cutting unit 56, falls down in the falling direction D2 to the +Z side in the vertical direction Z, and is accommodated in the accommodation container 17.

Note that Step S514 may not be performed. Instead, in Step S513, with regard to the cut piece WP nipped between the discharge roller pair 62, when the discharge roller pair 62 is reversed in a state in which the upper blade of the cutting unit 56 is at the cutting position, the cut piece WP may be accommodated in the accommodation container 17.

Figure 15:
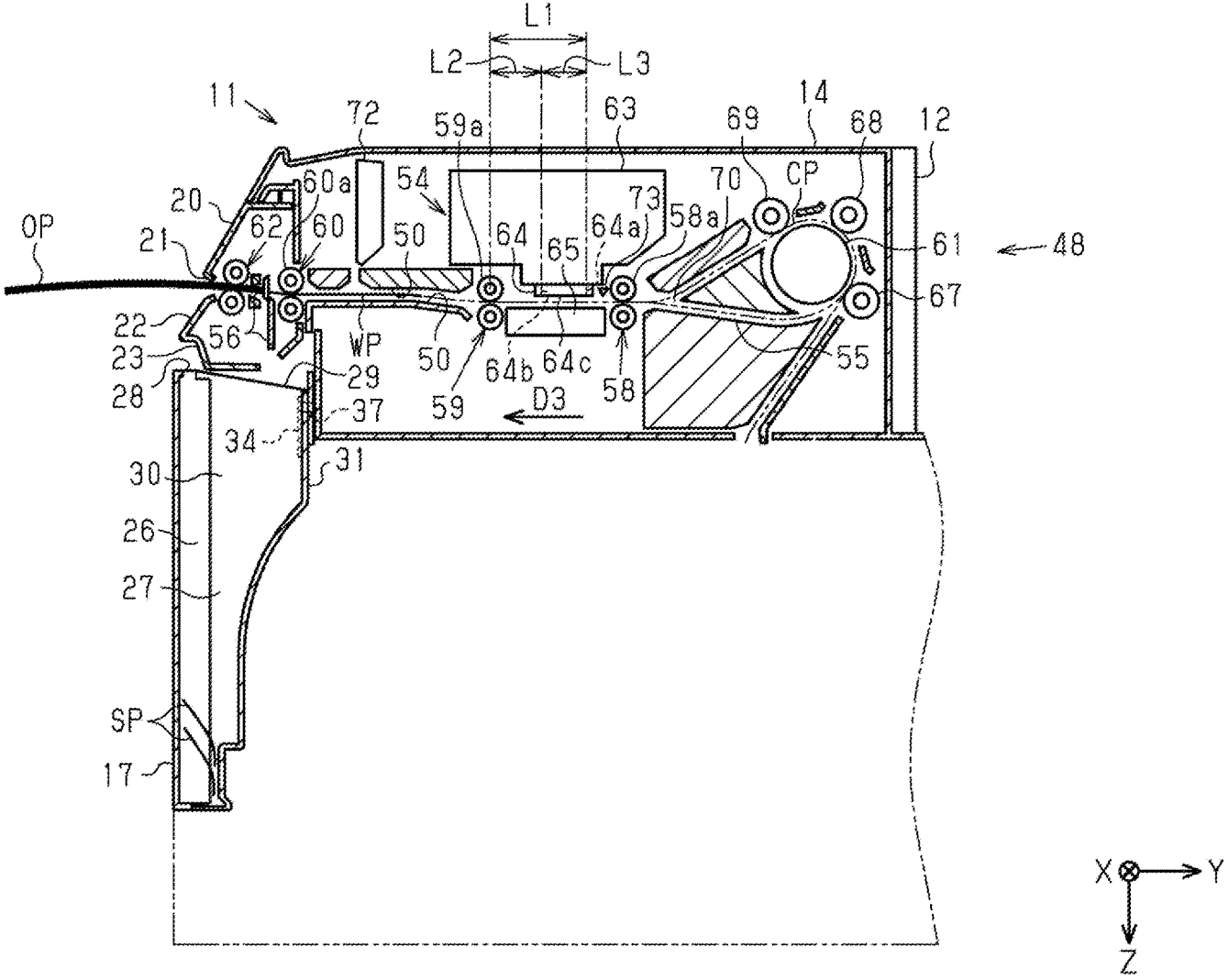
FIG. 15 is a schematic cross-sectional view illustrating a cut state of the rear end on the second surface of the medium subjected to duplex printing.

As illustrated in FIG. 15, in Step S515 and S516, the control unit 53 causes the transport unit 48 to transport the cutform paper CP in such a way that the third end 83 of the second surface arrives at the cutting unit 56. Further, the control unit 53 causes the cutting unit 56 to cut the cutform paper CP at the third end 83 of the second surface. The cutform paper CP is cut in a state of being nipped between the transport roller pair 60 and the discharge roller pair 62 in an unmovable and fixed manner Thus, the cutform paper CP is cut accurately at the third end 83. The cutform paper CP is divided into the printed object OP and the cut piece WP.

In Step S517, the discharge roller pair 62 discharged the printed object OP to the outside of the housing unit 12. Specifically, the printed object OP is output.

As illustrated in FIG. 16, in Step S518, the control unit 53 causes the transport unit 48 to transport the cut piece WP in such a way that the center of the cut piece WP being the rear end margin 89 of the second surface and the leading end margin 86 of the first surface arrives at the cutting unit 56.

Further, as illustrated in FIG. 17, the control unit 53 causes the cutting unit 56 to cut the cut piece WP into half. The cut piece WP is divided into two shredded pieces SP. With regard to one shredded piece SP nipped between the discharge roller pair 62, the discharge roller pair 62 is reversed in a state in which the upper blade of the cutting unit 56 is at the cutting position. With this, the upper end of the shredded piece SP abuts on the upper blade of the cutting unit 56, falls down in a falling direction D2 to the +Z side in the vertical direction Z, and is accommodated in the accommodation container 17.

Further, the control unit 53 causes the cutting unit 56 to position the upper blade at the retraction position. In this state, the control unit 53 causes the transport unit 48 to transport the other shredded piece SP, which is nipped between the transport roller pair 60, downstream of the cutting unit 56. Then, the shredded piece SP is nipped between the discharge roller pair 62. The distance between the transport roller pair 60 and the discharge roller pair 62 is smaller than at least a half of the margin distance 89*a*, that is, the length of the shredded piece SP in the transport direction D3. Thus, the shredded piece SP is transported downstream of the cutting unit 56.

Figure 18:
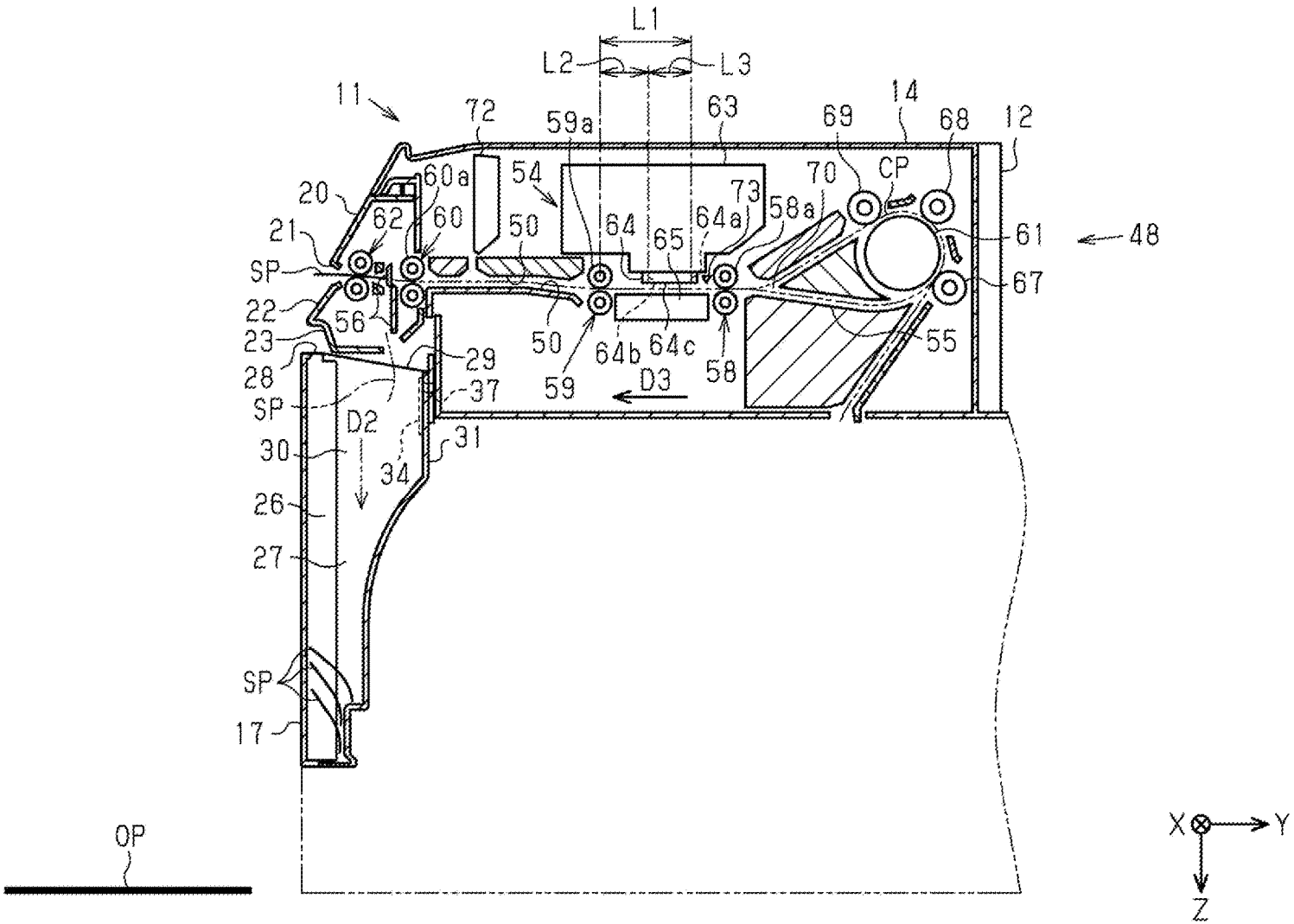
FIG. 18 is a schematic cross-sectional view illustrating a state in which a printed object is output to an outside of a housing unit.

As illustrated in FIG. 18, the control unit 53 causes the cutting unit 56 to move the upper blade to the cutting position again, and the discharge roller pair 62 is reversed in this state. With this, the upper end of the shredded piece SP abuts on the upper blade of the cutting unit 56, falls down in the falling direction D2 to the +Z side in the vertical direction Z, and is accommodated in the accommodation container 17.

Note that, instead of performing Step S518, in Step S517, the control unit 53 may causes the transport unit 48 to transport the cut piece WP, which is nipped between the transport roller pair 60, downstream of the cutting unit 56 in a state in which the upper blade of the cutting unit 56 is positioned at the retraction position, and the cut piece WP may be nipped between the discharge roller pair 62. Further, with regard to the cut piece WP nipped between the discharge roller pair 62 in a state in which the control unit 53 causes the cutting unit 56 to move the upper blade at the cutting position, when the discharge roller pair 62 is reversed in a state in which the upper blade of the cutting unit 56 is at the cutting position, the cut piece WP may be accommodated in the accommodation container 17.

In the present exemplary embodiment, a decurler that corrects a curl of the medium P, which is caused by curling of the roll body RP, is not included in the configuration of the printer 11. The medium P in a curled state is used in the printer 11. As described above, the printer 11 of the present exemplary embodiment is configured to perform printing with the ink-jet type printing unit 54 even when a curl is formed on the medium P at a certain degree. Thus, the printer 11 of the present exemplary embodiment can be used for a medium including an ink reception layer in which a crack is easily generated when spreading the medium outward of a curl curve in order to correct the curl. The ink reception layer fixes dye near the surface of the medium, and hence a printed object excellent in color development can be output. Note that a decurler having a curling correction force that is weak enough to prevent breakage of the ink reception layer can be included in the configuration.

The flow of control in duplex printing and the effect in each operation in the present exemplary embodiment are described above.

Effects of the present exemplary embodiment are described.

(1) In printing on the second surface, the control unit 53 causes the transport unit 48 to position the leading end of the medium P at the printing start position P2 being the position downstream of the position facing the most downstream nozzle 64*b* of the nozzle surface 64*c* in the transport direction D3, and causes the printing unit 54 to start formation of the printing region on the medium P having the leading end positioned at the printing start position P2. The second surface is the inner circumferential surface of the roll body RP. In printing on the second surface, the end of the medium P is curled toward the liquid jetting unit 64 due to curling of the roll body RP when the medium P passes on the support unit 65, and a deformation amount in the Z direction is largest at the leading end and the rear end of the medium P. In a state in which the leading end position of the medium P is positioned downstream of the position of the most downstream nozzle 64*b* in the transport direction D3, the printing unit 54 starts printing on the second surface. At this moment, even when liquid is jetted from any one of the nozzles from the most downstream nozzle 64*b* to the most upstream nozzle 64*a*, the liquid reaches the surface of the medium P, and the fourth end 84 being the start position of the printing region on the second surface can be formed on the medium P. Further, in a state in which the leading end of the medium P is positioned downstream of the most downstream nozzle 64*b* in the transport direction D3, the control unit 53 causes the printing unit 54 to start printing on the second surface. Thus, in printing on the second surface, when the carriage 63 scans in the width direction X, the leading end of the medium P is less likely to contact with the nozzle surface 64*c*. Thus, a risk of degrading printing quality can be lowered.

(2) The transport unit 48 includes the first nipping roller pair 59 that nips the medium P at the first nipping position downstream of the printing unit 54. In printing on the second surface, the printing start position P2 at which the leading end of the medium P is positioned is downstream of the nipping position. In printing on the second surface, the end of the medium P is curled toward the liquid jetting unit 64 due to curling of the roll body RP when the medium P passes on the support unit 65, and a deformation amount in the Z direction is largest at the leading end and the rear end of the medium P. The control unit 53 causes the transport unit 48 to position the leading end of the medium P at the printing start position P2 downstream of the first nipping position, and in this state, causes the printing unit 54 to start printing on the second surface. Specifically, a curl at the leading end of the medium P is suppressed by the first nipping roller pair 59. Thus, in printing on the second surface, when the carriage 63 scans in the width direction X, the leading end and the medium surface of the medium P is less likely to contact with the nozzle surface 64*c*. Thus, a risk of degrading printing quality can be lowered.

(3) The distance between the first end 81 and the cut position 97 is greater than the inter-nozzle distance L3. Thus, in printing on the second surface, a curl at the leading end of the medium P does not contact with the nozzle surface 64*c*. In printing on the second surface, the end of the medium P is curled toward the liquid jetting unit 64 due to curling of the roll body RP when the medium P passes on the support unit 65, and a deformation amount in the Z direction is largest at the leading end and the rear end of the medium P. The control unit 53 sets the cut position 97 in such a way that the distance between the first end 81 and the cut position 97 is greater than the inter-nozzle distance L3. With this setting, the first end 81 is positioned at the position corresponding to the most upstream nozzle 64*a* in the transport direction D3, the cut position 97 is positioned downstream of the position corresponding to the most downstream nozzle 64*b*. Thus, even when the fourth end 84 being the start position of the printing region on the second surface is formed by jetting liquid from any one of the nozzles from the most downstream nozzle 64*b* to the most upstream nozzle 64*a*, the fourth end 84 can be formed at the position corresponding to the position of the first end 81 of the first surface on the inside and the outside of the medium P, in a state in which the cut position 97 is positioned downstream of the position corresponding to the most downstream nozzle 64*b*. Further, in printing on the second surface, when the carriage 63 scans in the width direction X, the leading end of the medium P is less likely to contact with the nozzle surface 64*c*. Thus, a risk of degrading printing quality can be lowered.

(4) The distance between the first end 81 and the cut position 97 is greater than a most downstream nozzle distance L2. Thus, in printing on the second surface, a curl at the leading end of the medium P can be pressed by the first nipping roller pair 59. In printing on the second surface, the end of the medium P is curled toward the liquid jetting unit 64 due to curling of the roll body RP when the medium P passes on the support unit 65, and a deformation amount in the Z direction is largest at the leading end and the rear end of the medium P. The control unit 53 sets the cut position 97 in such a way that the distance between the first end 81 and the cut position 97 is greater than the most downstream nozzle distance L2. With this setting, when the first end 81 is positioned at the position corresponding to the most downstream nozzle 64*b* in the transport direction D3, the cut position 97 being the leading end of the medium P when the second surface faces vertically upward is positioned downstream of the first nipping position. Thus, even when the fourth end 84 being the start position of the printing region on the second surface is formed by jetting liquid from any one of the nozzles from the most downstream nozzle 64*b* to the most upstream nozzle 64*a*, the fourth end 84 can be formed at the position corresponding to the position of the first end 81 on the inside and the outside of the medium P, in a state in which the cut position 97 is positioned downstream of the first nipping position. Therefore, even when the second printing region 92 is formed at the position corresponding to the first printing region 91 on the inside and the outside of the medium P, formation of the second printing region 92 can be started in a state in which the leading end of the medium P is positioned downstream of the first nipping position. Specifically, a curl at the leading end of the medium P is suppressed by the first nipping roller pair 59. Thus, in printing on the second surface, when the carriage 63 scans in the width direction X, the leading end and the medium surface of the medium P is less likely to contact with the nozzle surface 64*c*. Thus, a risk of degrading printing quality can be lowered.

(5) The distance between the second end 82 and the reference end 96 is greater than the inter-nozzle distance L3. Thus, in printing on the second surface, printing on the second surface is terminated in a state in which the rear end of the medium P is positioned upstream of the most upstream nozzle 64*a* in the transport direction D3. In printing on the second surface, the end of the medium P is curled toward the liquid jetting unit 64 due to curling of the roll body RP when the medium P passes on the support unit 65, and a deformation amount in the Z direction is largest at the leading end and the rear end of the medium P. The rear end of the medium P in printing on the second surface is the reference end 96 being the leading end in printing on the first surface. The control unit 53 sets the printing start position P1 on the first surface in such a way that the distance between the second end 82 and the reference end 96 is greater than the inter-nozzle distance L3. With this setting, when the second surface faces vertically upward, and the second end 82 is at the position corresponding to the most downstream nozzle 64*b* in the transport direction D3, the reference end 96 is positioned upstream of the position corresponding to the most upstream nozzle 64*a*. Thus, even when the third end 83 being the termination position of the printing region on the second surface is formed by jetting liquid from any one of the nozzles from the most downstream nozzle 64*b* to the most upstream nozzle 64*a*, the third end 83 can be formed at the position corresponding to the position of the second end 82 on the inside and the outside of the medium, in a state in which the reference end 96 is positioned upstream of the most upstream nozzle 64*a*. Further, in printing on the second surface, the rear end of the medium P is less likely to contact with the nozzle surface 64*c* when the carriage 63 in the width direction X. Thus, a risk of degrading printing quality can be lowered.

(6) The distance between the second end 82 and the reference end 96 is greater than the distance between the position of the second nipping roller pair 58 and the most downstream nozzle 64*b* in the transport direction D3. Thus, in printing on the second surface, the rear end of a curl of the medium P is pressed by the second nipping roller pair 58. In printing on the second surface, the end of the medium P is curled toward the liquid jetting unit 64 due to curling of the roll body RP when the medium P passes on the support unit 65, and a deformation amount in the Z direction is largest at the leading end and the rear end of the medium P. The rear end of the medium P in printing on the second surface is the reference end 96 being the leading end in printing on the first surface. The control unit 53 sets the printing start position P1 on the first surface in such a way that the distance between the second end 82 and the reference end 96 is greater than the distance between the position of the second nipping roller pair 58 and the most downstream nozzle 64*b* in the transport direction D3. With this setting, when the second surface faces vertically upward, and the second end 82 is at the position corresponding to the most downstream nozzle 64*b* in the transport direction D3, the reference end 96 is positioned upstream of the second nipping roller pair 58. Thus, even when the third end 83 being the termination position of the printing region on the second surface is formed by jetting liquid from any one of the nozzles from the most downstream nozzle 64*b* to the most upstream nozzle 64*a*, the third end 83 can be formed at the position corresponding to the position of the second end 82 on the inside and the outside of the medium P, in a state in which the reference end 96 is positioned upstream of the second nipping roller pair 58. Further, in printing on the second surface, the rear end of the medium P is less likely to contact with the nozzle surface 64*c* when the carriage 63 in the width direction X. Thus, a risk of degrading printing quality can be lowered.

(7) The transport unit 48 includes the first nipping roller pair 59 that nips the medium P at the first nipping position downstream of the printing unit 54. In printing on the first surface, the printing start position P1 at which the leading end of the medium P is positioned is downstream of the nipping position. In printing on the first surface, when the leading end of the medium P passes on the support unit 65, the leading end of the medium P is to be curled toward the support unit 65 due to curling of the roll body RP, but a curl is pressed by the support unit 65. However, curling of the roll body RP is strong, and a curl at the leading end of the medium P is large, the curl makes the leading end of the medium P to have a shape protruding toward the liquid jetting unit 64. Thus, the leading end of the medium P is easily lifted up from the support unit 65. In a case where the medium P is lifted up from the support unit 65, when the carriage 63 scans in the width direction X, the leading end of the medium P may contact with the nozzle surface 64*c* of the liquid jetting unit 64 in some cases. The leading end of the medium P is nipped between the first nipping roller pair 59, and hence a curl at the leading end of the medium P can be suppressed. Thus, in printing on the first surface, when the carriage 63 scans in the width direction X, the leading end of the medium P is less likely to contact with the nozzle surface 64*c*. Thus, a risk of degrading printing quality can be lowered.

(8) The medium P is the medium including the ink reception layer on the inner circumferential surface. The present exemplary embodiment has a configuration in which the ink-jet type printing unit 54 can perform printing on the inner circumferential surface of the medium P even when a curl is formed on the medium P at a certain degree. Thus, the printer 11 of the present exemplary embodiment can use a medium having an inner circumferential surface provided with an ink reception layer in which a crack is easily generated when a curve is imparted. The ink reception layer fixes dye near the surface of the medium, and hence a printed object excellent in color development can be output.

(9) The present exemplary embodiment has a configuration in which the ink-jet type printing unit 54 can perform printing on the first surface and the second surface of the medium P even when a curl is formed on the medium P at a certain degree. Thus, the printer 11 of the present exemplary embodiment can use a medium having both surfaces each provided with an ink reception layer in which a crack is easily generated when a curve is imparted. The ink reception layer fixes dye and develops a color near the surface of the medium, and hence the color is developed vividly immediately after printing. As a result, a printed object excellent in color development can be output.

(10) In the control method of the printer 11 of the first exemplary embodiment, effects similar to the effects of the printer 11 described in the items (1) to (9) can also be obtained.

Second Exemplary Embodiment

Figure 20:
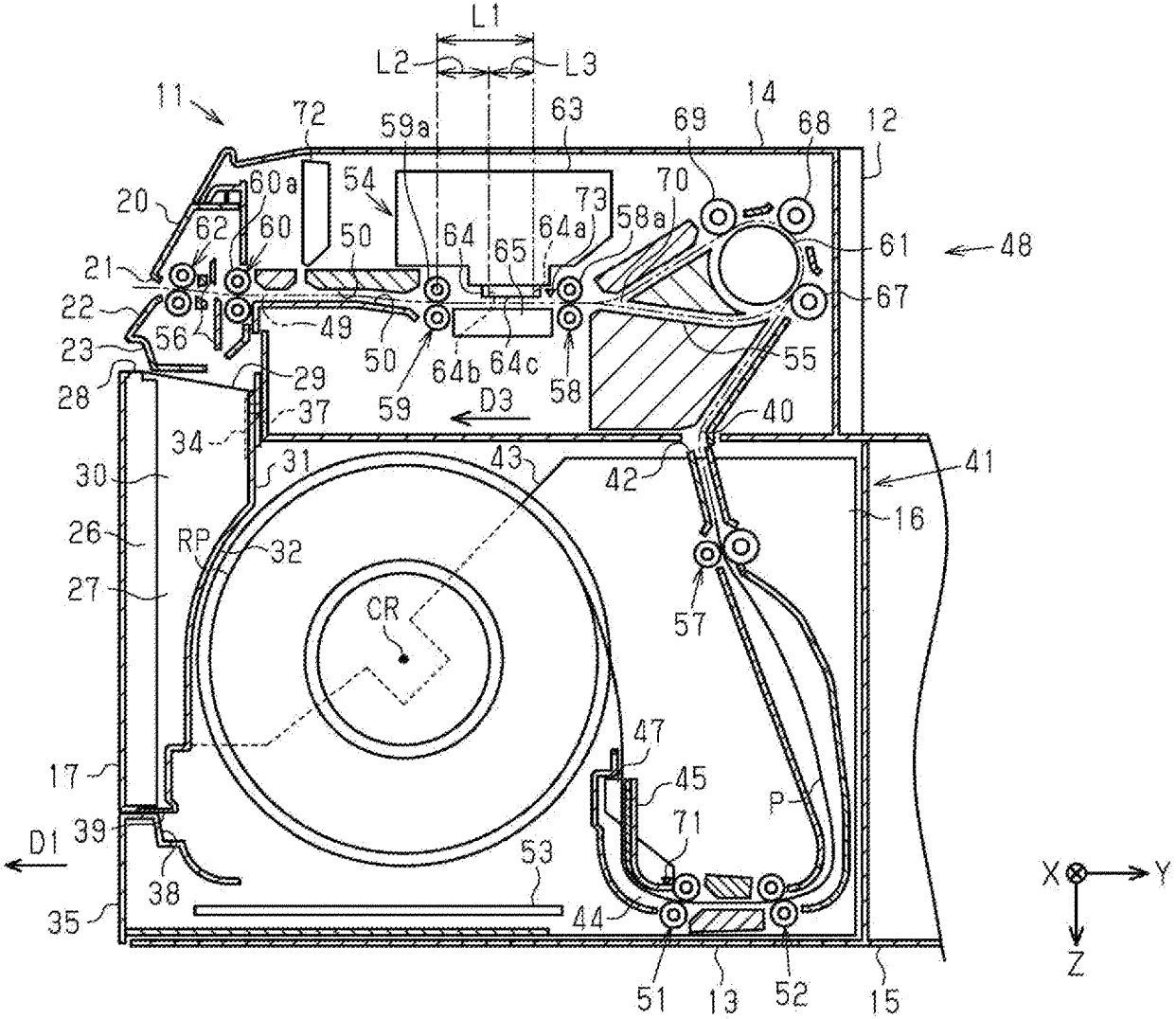
FIG. 20 is a schematic cross-sectional view illustrating a standby state of a medium before the printer of a second exemplary embodiment starts an operation.

With reference to the drawings, a printer according to a second exemplary embodiment is described. As illustrated in FIG. 2, in the first exemplary embodiment, the inner circumferential surface of the medium P is the second surface. In contrast, as illustrated in FIG. 20, the second exemplary embodiment is different from the first exemplary embodiment in that the inner circumferential surface of the medium P is the first surface. The second exemplary embodiment is substantially the same as the first exemplary embodiment with regard to the other points. Thus, the same configurations are denoted with the same reference symbols, and redundant description therefor is omitted.

As illustrated in FIG. 20, the path formation member 45 supports the positioning member 47 movable along a guide hole (not illustrated) in the width direction X. The positioning member 47 includes a protruding portion that protrudes in the drawing direction D1 with respect to a guide hole (not illustrated). Note that, unlike the first exemplary embodiment, the path formation member 45, the guide hole (not illustrated), and the positioning member 47 are arranged on the +Y side of the roll body RP in the depth direction Y of the drawer unit 16. Further, the transport roller pairs 51 and 52 is arranged on the +Z side of the rotation center CR of the roll body RP in the vertical direction Z and on the +Y side of the roll body RP in the depth direction Y.

Similarly to the first exemplary embodiment, the printer 11 includes the feeding unit 41 that transports, to the second accommodation part 14, the leading end of the medium P fed out from a state of being wound up in a roll shape accommodated in the first accommodation part 13. The feeding unit 41 includes the roller group including transport roller pairs 51, 52, and 57 and a plurality of transport surfaces 50 in the transport path 49 from the roll body RP to the outlet 42 of the first accommodation part 13.

The printer 11 starts printing on the first surface. At this moment, the printing unit 54 is at the position at which the nozzle surface 64*c* does not face the medium P transported by the transport unit 48. In the present exemplary embodiment, as printing on the first surface, printing is performed on the inner circumferential surface of the medium P, which is positioned inside in a state in which the medium P is wound up in a roll shape. When the medium P is supported by the support unit 65, the outer circumferential surface of the medium P faces upward in the vertical direction Z. Therefore, when the printing unit 54 is at the position at which the nozzle surface 64*c* faces the medium P, the outer circumferential surface of the medium P faces the nozzle surface 64*c*. Specifically, the leading end of the medium P is to be curled toward the liquid jetting unit 64 due to curling of the roll body RP.

Figure 21:
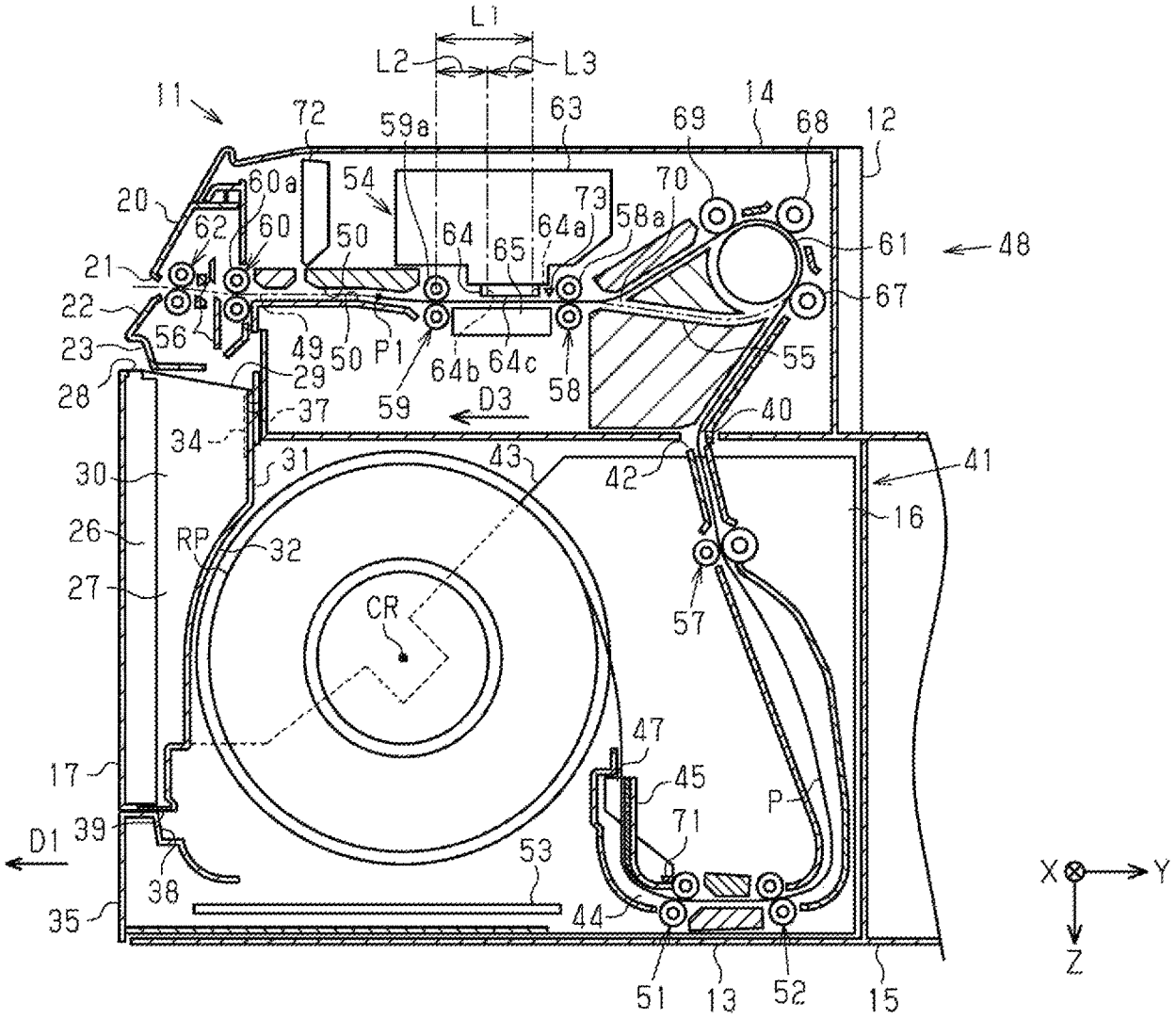
FIG. 21 is a schematic cross-sectional view illustrating a nipped state of a first surface of the medium subjected to duplex printing in the second exemplary embodiment.

As illustrated in FIG. 21, before starting printing on the first surface, the control unit 53 causes the transport unit 48 to position the leading end of the medium P at the printing start position P1. The printing start position P1 is a position downstream of the position facing the most downstream nozzle 64*b* of the nozzle surface 64*c*, in the transport direction D3.

In the present exemplary embodiment, the printing start position P1 to which the leading end of the medium P is transported is a position downstream of the first nipping position in the transport direction D3, at which the first nipping roller pair 59 nips the medium P. When the elongated medium P is in the nipped state, the control unit 53 causes the printing unit 54 to start printing on the first surface of the medium P. As illustrated in FIG. 4, as printing on the first surface, the control unit 53 causes the printing unit 54 to form the first printing region 91 having the second end 82 at the position away from the reference end 96 of the medium P.

Note that, in the present exemplary embodiment, the printing start position P1 being the leading end position of the medium P at the time of starting printing is a position downstream of the first nipping position, but may be a position downstream of the position facing the most downstream nozzle 64*b* and upstream of the first nipping position. More specifically, the control unit 53 may cause the printing unit 54 to form the first printing region 91 in such a way that the distance between the second end 82 illustrated in FIG. 4 and the reference end 96 illustrated in FIG. 4 is greater than the inter-nozzle distance L3.

The reference end 96 being the leading end in printing on the first surface is the rear end of the medium P in printing on the second surface. The control unit 53 may set the printing start position P1 on the first surface in such a way that the distance between the second end 82 and the reference end 96 is greater than the distance between the position of the second nipping roller pair 58 and the most downstream nozzle 64*b* in the transport direction D3. With this setting, when the second surface faces vertically upward, and the second end 82 is at the position corresponding to the most downstream nozzle 64*b* in the transport direction D3, the reference end 96 is positioned upstream of the second nipping roller pair 58.

As illustrated in FIG. 21, the control unit 53 causes the printing unit 54 to start printing on the first surface of the medium P when the medium P is in the nipped state. The first printing region 91 has the first end 81 and the second end 82. The first end 81 is an upstream end when printing is performed on the first surface. The second end 82 is a downstream end when printing is performed on the first surface. In printing on the first surface, the control unit 53 causes the printing unit 54 to form the first printing region 91 having the second end 82 at the position away from the reference end 96 of the medium P.

After that, as illustrated in FIG. 6, in duplex printing, after causing the printing unit 54 to perform printing on the first surface of the medium P, the control unit 53 causes the cutting unit 56 to cut the medium P at the cut position 97 positioned upstream of the first end 81 being the upstream end of the first printing region 91 that is formed on the first surface by the printing unit 54. In the present exemplary embodiment, the position of the cut position 97 on the medium P is set in such a way that the margin distance 87*a* is greater than the most upstream nozzle distance L1 illustrated in FIG. 21. The most upstream nozzle distance L1 is the transport direction distance in the transport direction D3 between the position at which the first nipping roller pair 59 nips the cutform paper CP and the most upstream nozzle 64*a* of the printing unit 54.

Figure 22:
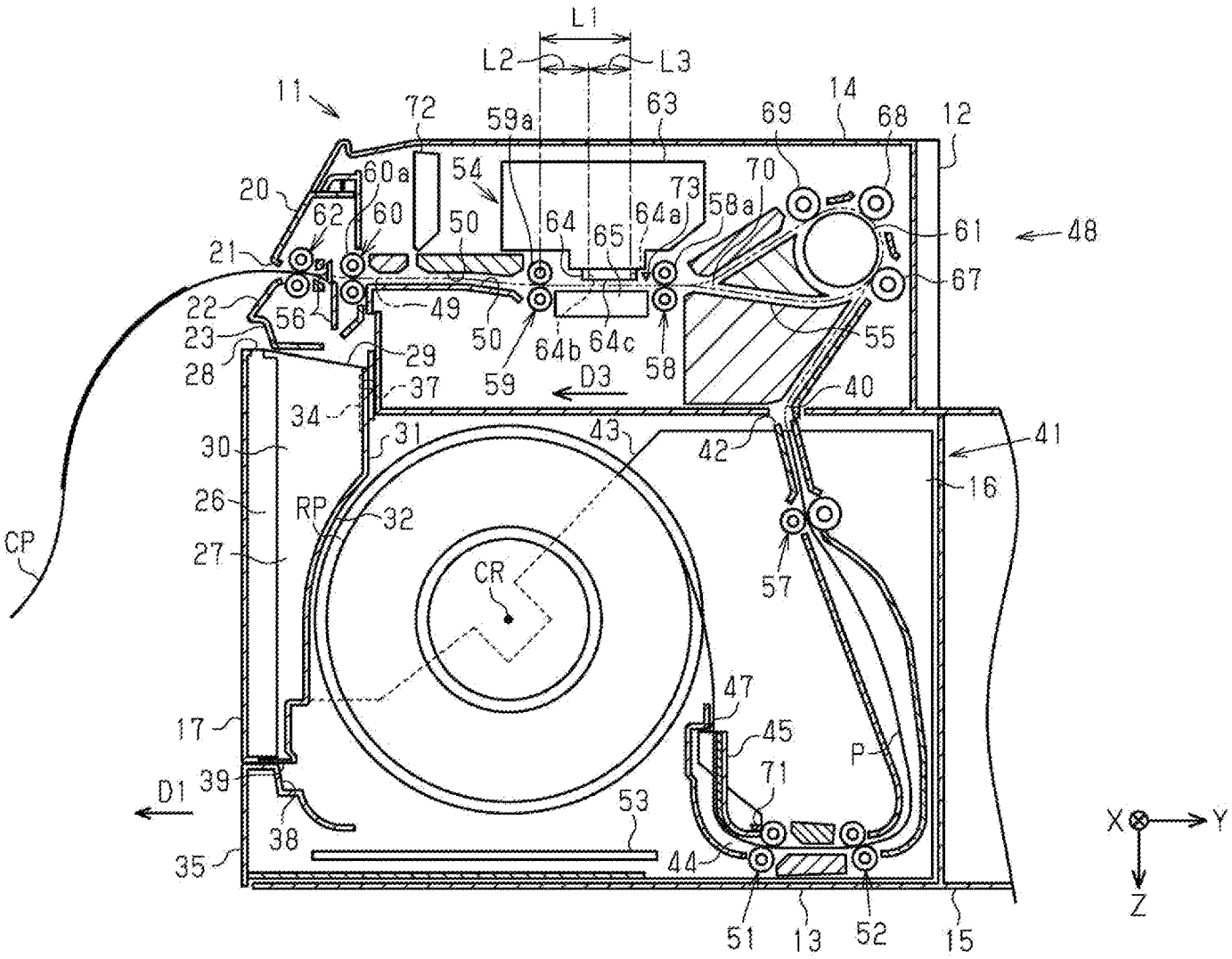
FIG. 22 is a schematic cross-sectional view illustrating a state in which a leading end of a roll body returns to a standby position after cutting the rear end on the first surface of the medium subjected to duplex printing in the second exemplary embodiment.

As illustrated in FIG. 22, of the medium P after the cutting unit 56 performs cutting, a part including the roll body RP is transported in a clockwise direction about the intermediation roller 61, and is re-wound back to the roll body RP to a position of not being deviated from the nipping position of the transport roller pair 57 and a position at which the leading end is accommodated in the first accommodation part 13.

As illustrated in FIG. 8, in duplex printing, the cutting unit 56 cuts the medium P at the cut position 97 after printing is performed on the first surface. Then, the control unit 53 causes the discharge roller pair 62 to transport the cutform paper CP upstream. Further, the control unit 53 causes the transport unit 48 to transport the leading end of the cutform paper CP to a position downstream of the position facing the most downstream nozzle 64*b* of the nozzle surface 64*c*, in the transport direction D3. Before starting printing on the second surface, the control unit 53 causes the transport unit to position the leading end of the medium P at the printing start position P2. The printing start position P2 is a position downstream of the position facing the most downstream nozzle 64*b* of the nozzle surface 64*c*, in the transport direction D3.

As illustrated in FIG. 8, in the present exemplary embodiment, the printing start position P2 is a position downstream of the first nipping position at which the first nipping roller pair 59 nips the medium P, in the transport direction D3. When the medium P is in the nipped state of being nipped between the second nipping roller pair 58 and the first nipping roller pair 59, the control unit 53 causes the printing unit 54 to start printing on the second surface of the medium P.

The printer 11 starts printing on the second surface. At this moment, the printing unit 54 is at the position at which the nozzle surface 64*c* does not face the medium P transported by the transport unit 48. In the present exemplary embodiment, as printing on the second surface, printing is performed on the outer circumferential surface being an outer surface of the roll body RP. When the medium P is supported by the support unit 65, the outer circumferential surface of the roll body RP faces upward in the vertical direction Z. Therefore, when the printing unit 54 is at the position at which the nozzle surface 64*c* faces the medium P, the inner circumferential surface of the roll body RP faces the nozzle surface 64*c*. Specifically, the end of the medium P is to be curled toward the support unit 65 due to curling of the roll body RP.

In the present exemplary embodiment, when duplex printing is performed, that is, the control unit 53 causes the printing unit 54 to perform printing on the first surface of the medium P and causes the printing unit 54 to perform printing on the second surface of the medium P after printing is performed on the first surface, the first surface is the inner circumferential surface, and the second surface is the outer circumferential surface. Specifically, with respect to the medium P or the cutform paper CP after the leading end is transported to the printing start position P1, the control unit 53 causes the printing unit 54 to start printing on the outer circumferential surface at the time of printing on the first surface and to start printing on the inner circumferential surface at the time of printing on the second surface.

In the present exemplary embodiment, in printing on the first surface, the control unit 53 forms the first printing region 91 in such a way that the distance between the second end 82 and the reference end 96 is greater than the distance between the position of the second nipping roller pair 58 and the most downstream nozzle 64*b* in the transport direction D3. Further, in printing on the second surface, the control unit 53 terminates printing on the second surface that is performed by the printing unit 54 with respect to the medium P in the state of being nipped between the first nipping roller pair 59 downstream of the printing unit 54 and being nipped between the second nipping roller pair 58 upstream of the printing unit 54.

Further, after causing the printing unit 54 to perform printing on the second surface of the cutform paper CP, the control unit 53 causes the cutting unit 56 to cut the cutform paper CP at the first end 81 and at the second end 82 positioned on the opposite side of the first end 81 of the first printing region 91 across the first printing region 91 in the transport direction D3.

Similarly to the first exemplary embodiment, the discharge roller pair 62 illustrated in FIG. 20 discharges the printed object OP illustrated in FIG. 11 to the outside of the housing unit 12, and the cut piece WP and the shredded piece SP as cutting chips are accommodated in the accommodation portion 28.

Next, actions of the present exemplary embodiment are described.

As illustrated in FIG. 20, when the roll body RP is loaded in the drawer unit 16, the drawer unit 16 is pulled out, and the roll body RP is set to the side wall portions 43. Further, the leading end of the medium P unwound from the roll body RP is manually inserted into the insertion port 44. Subsequently, the positioning member 47 moves, and the medium P is positioned on the −X side in the width direction X.

The leading end of the medium P advances further behind the insertion port 44, and contacts with the transport roller pair 51. Then, the first sensor 71 detects the leading end of the medium P, the transport roller pair 51 slightly rotates, and thus the leading end of the medium P is drawn in and nipped between the transport roller pair 51. When the drawer unit 16 is restored from the pulled-out state to the original state illustrated in FIG. 2, the medium P is transported downstream by the transport roller pairs 51, 52, and 57, the roll body RP rotates in the clockwise direction, and the leading end of the medium P is transported to the standby position illustrated in FIG. 2 before the printer 11 starts an operation. Thus, preparation for printing is completed.

Hereinafter, with reference to the flowchart in FIG. 19, a flow of control in duplex printing and an effect in each operation are described. Note that, in the description for the actions, description overlapping with that in the first exemplary embodiment is omitted.

In Step S501, the control unit 53 controls the transport unit 48, and starts transporting the medium P, which is fed from a state of being wound up in a roll shape, downstream.

In Step S502, the control unit 53 determines whether the second sensor 73 detects passing of the leading end of the medium P. As illustrated in FIG. 21, when the second sensor 73 detects passing of the leading end of the medium P, as Step S503, the control unit 53 causes the transport unit 48 to transport the medium P by the transport amount M. With this, the leading end of the medium P is positioned at the printing start position P1.

As illustrated in FIG. 21, in a state in which the leading end of the medium P is nipped between the first nipping roller pair 59, the control unit 53 starts printing on the first surface of the medium P, as Step S504. In Step S504, the first printing region 91 is formed on the first surface of the medium P. In the present exemplary embodiment, when the printing unit 54 starts formation of the first printing region 91, printing on the first surface in Step S504 is started. Further, in the present exemplary embodiment, when the printing unit 54 terminates formation of the first printing region 91, printing on the first surface in Step S504 is terminated. Further, the control unit 53 causes the printing unit 54 to form the first end 81 on the medium P, and then terminates printing on the first surface as Step S504.

In the present exemplary embodiment, the first surface of the medium P is the inner circumferential surface of the roll body RP. When the medium P is nipped between the second nipping roller pair 58, and the reference end 96 being the leading end of the medium P passes on the support unit 65 toward the first nipping roller pair 59, the inner circumferential surface of the medium P faces the liquid jetting unit 64.

In printing on the first surface of the medium P in the present exemplary embodiment, when the leading end of the medium P passes on the support unit 65, the leading end of the medium P is curled toward the liquid jetting unit 64 due to curling of the roll body RP, and a deformation amount in the Z direction is largest at the leading end of the medium P. In a case where a deformation amount of the medium P in the Z direction is large, and the posture of the medium P is not corrected when printing is to be performed on the medium P, a predetermined gap between the surface of the liquid jetting unit 64 and the medium P is not generated in some cases.

As illustrated in FIG. 21, the printing start position P1 at which the reference end 96 being the leading end of the medium P is positioned is downstream of the first nipping position. In this case, in a state in which the medium P is pressed by the first nipping roller pair 59, printing on the first surface for forming the first printing region 91 can be started. Specifically, when the control unit 53 starts printing on the first surface, a curl at the leading end of the medium P is suppressed by the first nipping roller pair 59. Thus, a risk that the leading end of the medium P contacts with the nozzle surface 64*c* when the carriage 63 scans in the width direction X can be lowered.

As illustrated in FIG. 21, the control unit 53 causes the printing unit 54 to start printing on the first surface in a state in which the position of the reference end 96 being the leading end of the medium P is positioned downstream of the position of the most downstream nozzle 64*b* in the transport direction D3. At this moment, even when liquid is jetted from any one of the nozzles from the most downstream nozzle 64*b* to the most upstream nozzle 64*a*, the liquid reaches the surface of the medium P, and the second end 82 is formed on the medium P. Further, the control unit 53 causes the printing unit 54 to start printing on the first surface in a state in which the leading end of the medium P having the largest deformation amount to the most Z side is positioned downstream of the position of the most downstream nozzle 64*b* in the transport direction D3. Thus, a risk that the leading end of the medium P contacts with the nozzle surface 64*c* when the carriage 63 scans in the width direction X is lowered.

Specifically, in Step S503, the control unit 53 causes the transport unit 48 to transport the leading end of the medium P to the printing start position P1 being the position downstream of the position facing the most downstream nozzle 64*b* of the nozzle surface 64*c*, in the transport direction D3. Further, in Step S504, the control unit 53 causes the printing unit 54 to start printing on the first surface, that is, printing on the inner circumferential surface with respect to the medium P having the leading end transported to the printing start position P1. Further, in Step S504, the first end 81 being the termination position of the printing region is formed on the medium P, and then the control unit 53 terminates printing on the first surface.

In Step S505, after printing on the first surface is terminated, the control unit 53 causes the transport unit 48 to transport the medium P in such a way that the cut position 97 arrives at the cutting unit 56.

In the present exemplary embodiment, the second printing region 92 that is formed on the second surface of the medium P in Step S511 described later is formed correspondingly to the first printing region 91 on the inside and the outside of the medium P. Thus, when formation of the second printing region 92 is started, a range in which the cut position 97 being the leading end of the medium P can be positioned varies depending on a positional relationship between the first end 81 of the first printing region 91 that is formed on the first surface in Step S504 and the cut position 97 that is cut by the cutting unit 56 in Step S505.

The control unit 53 sets the cut position 97 in such a way that the distance between the first end 81 and the cut position 97 is greater than the most downstream nozzle distance L2. With this setting, when the first end 81 is positioned at the position corresponding to the most downstream nozzle 64*b* in the transport direction D3, the cut position 97 being the leading end of the medium P when the second surface faces vertically upward is positioned downstream of the first nipping position. Thus, in a state in which the cut position 97 is positioned downstream of the first nipping position, the fourth end 84 can be formed at the position corresponding to the position of the first end 81 on the inside and the outside of the medium P. Therefore, even when the second printing region 92 is formed at the position corresponding to the first printing region 91 on the inside and the outside of the medium P, formation of the second printing region 92 can be started in a state in which the leading end of the medium P is positioned downstream of the first nipping position. With this, in printing on the second surface, a risk that the leading end of the medium P contacts with the nozzle surface 64*c* when the carriage 63 scans in the width direction X is lowered.

As illustrated in FIG. 5, in Step S506, the control unit 53 causes the cutting unit 56 to cut the medium P at the cut position 97. The cutform paper CP is cut off from the medium P.

As illustrated in FIG. 7, in Step S507, the control unit 53 causes the transport unit 48 to position the leading end of the medium P at the standby position.

In Step S508, the control unit 53 causes the transport unit 48 to start transporting of the cutform paper CP in the switchback transport path 55. The cutform paper CP to be transported in the switchback transport path 55 moves toward the second sensor 73 via the intermediation roller 61.

In Step S509, the control unit 53 determines whether the second sensor 73 detects passing of the leading end of the cutform paper CP. As illustrated in FIG. 8, when the second sensor 73 detects passing of the leading end of the medium P, as Step S510, the control unit 53 causes the transport unit 48 to transport the cutform paper CP. With this, the leading end of the cutform paper CP is positioned at the printing start position P2. In the present exemplary embodiment, the printing start position P2 is set within such a range that the first end 81 is positioned upstream of the most downstream nozzle 64*b* when the leading end of the cutform paper CP is positioned at the printing start position P2. Thus, the fourth end 84 can be formed at the position corresponding to the first end 81 on the inside and the outside of the medium P.

In the present exemplary embodiment, the second surface is the outer circumferential surface of the roll body RP in a state of being wound up in a roll shape. When the medium P is nipped between the second nipping roller pair 58, and the leading end of the medium P passes on the support unit 65 toward the first nipping roller pair 59, the inner circumferential surface of the medium P the support unit 65. Specifically, in Step S510, when the printing unit 54 is at the position at which the nozzle surface 64*c* does not face the medium P transported by the transport unit 48, the control unit 53 transports the medium P in a state in which the outer circumferential surface of the medium P faces upward, the outer circumferential surface positioned outside when the medium P is in a state of being wound up in a roll shape. Therefore, in printing on the outer circumferential surface, specifically, in a case where printing is performed on the outer circumferential surface of the medium P, when the printing unit 54 is at the position at which the nozzle surface 64*c* faces the medium, the outer circumferential surface faces the nozzle surface 64*c*.

In printing on the second surface, when the leading end of the medium P passes on the support unit 65, the leading end of the medium P is to be curled toward the support unit 65 due to curling of the roll body RP, but a curl is suppressed by the support unit 65. However, curling of the roll body RP is strong, and a curl at the leading end of the medium P is large, the curl makes the leading end of the medium P to have a shape protruding toward the liquid jetting unit 64. Thus, the leading end of the medium P is easily lifted up from the support unit 65. In a case where the medium P is lifted up from the support unit 65, when the carriage 63 scans in the width direction X, the leading end of the medium P may contact with the nozzle surface 64*c* of the liquid jetting unit 64 in some cases.

As illustrated in FIG. 8, after Step S510, the printing start position P2 at which the cut position 97 being the leading end of the medium P is positioned is downstream of the first nipping position. In this case, due to setting of the cut position 97 in Step S505 described above, the first end 81 is positioned upstream of the most downstream nozzle 64*b*. Thus, in a state in which the medium P is pressed by the first nipping roller pair 59, printing on the second surface for forming the second printing region 92 corresponding the first printing region 91 can be started. Specifically, when the control unit 53 starts printing on the second surface as Step S511 described later, a curl at the leading end of the medium P is suppressed by the first nipping roller pair 59. Therefore, a risk that the leading end of the medium P contacts with the nozzle surface 64*c* when the carriage 63 scans in the width direction X can be lowered.

Further, printing on the second surface is started due to setting of the position of the reference end 96 of the first surface in Step S504 described above, and printing is terminated. During this period, the cutform paper CP is controlled in such a way that the reference end 96 being the rear end of the medium P is positioned upstream of the position of the second nipping roller pair 58 in the transport direction D3. Specifically, a curl at the leading end of the medium P is suppressed by the second nipping roller pair 58. Thus, a risk that the reference end 96 being the rear end of the medium P, which is illustrated in FIG. 9, contacts with the nozzle surface 64*c* when the carriage 63 scans in the width direction X is lowered.

The control unit 53 causes the transport unit 48 to transport the medium P in such a way that the fourth end 84 is formed at the position corresponding to the first end 81, and causes the printing unit 54 to start printing on the second surface, in a state in which the medium P is nipped between the first nipping roller pair 59 and the second nipping roller pair 58. With this, the second printing region 92 is formed on the medium P. Further, the control unit 53 terminates printing on the second surface in a state in which the medium P is nipped between the first nipping roller pair 59 and the second nipping roller pair 58. With this control, the posture of the cutform paper CP on the support unit 65 is straight, and a transport amount of the cutform paper CP during printing is accurate. Further, the third end 83 of the cutform paper CP is easily formed at the position corresponding to the second end 82. Thus, deviation between the first printing region 91 and the second printing region 92 is suppressed.

In duplex printing, as printing on the first surface, the control unit 53 causes the printing unit 54 to form the first printing region 91 having the second end 82 being the downstream end at the position away from the end of the medium P. Further, after causing the cutting unit 56 to cut the medium P at the position upstream of the first printing region 91, and causing the printing unit 54 to perform printing on the second surface of the medium P, the control unit 53 causes the cutting unit 56 to cut the medium P at the second end 82. The second end 82 being the downstream end is the start position of the first printing region 91. In printing on the first surface, in a case where printing is performed on the inner circumferential surface, when the medium P passes on the support unit 65, the end of the medium P is curled toward the liquid jetting unit 64 due to curling of the roll body RP, and a deformation amount in the Z direction is largest at the leading end of the medium P. When the first printing region 91 of the first surface is formed, the control unit 53 causes the printing unit 54 to form the leading end margin 86 at the leading end of the medium P. With this, printing on the first surface can be started in a state in which the leading end of the medium P having the largest deformation amount is positioned downstream of the position of the most downstream nozzle 64*b* in the transport direction D3. Further, a risk that the leading end of the medium P contacts with the nozzle surface 64*c* when the carriage 63 scans in the width direction X can be lowered.

Similarly to the first exemplary embodiment, after printing on the second surface is terminated in the subsequent steps from Step S512 to Step S518, the discharge roller pair 62 illustrated in FIG. 20 discharges the printed object OP illustrated in FIG. 11 to the outside of the housing unit 12, and the cut piece WP and the shredded piece SP as cutting chips are accommodated in the accommodation portion 28.

The flow of control in duplex printing and the effect in each operation in the present exemplary embodiment are described above.

Hereinafter, with reference to the flowchart in FIG. 19, a flow of control in simplex printing and an effect in each operation in the present exemplary embodiment are described. Note that description overlapping the description for duplex printing is omitted.

In simplex printing, the control unit 53 executes Step S501 to Step S504. Further, in Step S504, after the control unit 53 causes the printing unit 54 to terminate printing on the first surface, the control unit 53 causes the cutting unit 56 to cut the medium P at the second end 82 illustrated in FIG. 4. With this, the leading end margin 86 of the medium P is cut off as the cut piece WP. Moreover, the control unit 53 causes the cutting unit 56 to cut the medium P at the first end 81 positioned on the opposite side of the second end 82 across the first printing region 91 in the transport direction D3. After the cutform paper CP is cut off from the medium P, the control unit 53 causes the transport unit 48 to discharge the cutform paper CP to the outside of the housing unit 12. Specifically, the printed object OP is output.

As illustrated in FIG. 3, in Step S504, the control unit 53 causes the printing unit 54 to start simplex printing in a state in which the leading end of the medium P is nipped between the first nipping roller pair 59.

In simplex printing on the medium P in the present exemplary embodiment, when the medium P passes on the support unit 65, the end of the medium P is curled toward the liquid jetting unit 64 due to curling of the roll body RP, and a deformation amount in the Z direction is largest at the leading end of the medium P. Thus, in a state in which the transport unit 48 is caused to position the leading end of the medium P at the printing start position P1 downstream of the first nipping position, the printing unit 54 is caused to start printing on the first surface. Specifically, a curl at the leading end of the medium P is suppressed by the first nipping roller pair 59. Thus, a risk that the leading end of the medium P contacts with the nozzle surface 64*c* when the carriage 63 scans in the width direction X can be lowered.

Further, the control unit 53 causes the printing unit 54 to start simplex printing in a state in which the leading end position of the medium P is positioned downstream of the position of the most downstream nozzle 64*b* in the transport direction D3. At this moment, even when liquid is jetted from any one of the nozzles from the most downstream nozzle 64*b* to the most upstream nozzle 64*a*, the liquid reaches the surface of the medium P, and the second end 82 being the start position of the printing region on the first surface is formed on the medium P. Further, the control unit 53 causes the printing unit 54 to start printing in a state in which the leading end of the medium P having the largest deformation amount to the most Z side is positioned downstream of the position of the most downstream nozzle 64*b* in the transport direction D3. Thus, a risk that the leading end of the medium P contacts with the nozzle surface 64*c* when the carriage 63 scans in the width direction X is lowered.

Effects of the present exemplary embodiment are described.

(11) In printing on the first surface, the control unit 53 causes the transport unit 48 to position the leading end of the medium P at the printing start position P1 being the position downstream of the position facing the most downstream nozzle 64*b* of the nozzle surface 64*c* in the transport direction D3, and causes the printing unit 54 to start formation of the printing region on the medium P having the leading end positioned at the printing start position P1. The first surface is the inner circumferential surface of the roll body RP. The end of the medium P is curled toward the liquid jetting unit 64 due to curling of the roll body RP, and a deformation amount in the Z direction is largest at the leading end of the medium P. In a state in which the leading end position of the medium P is positioned downstream of the position of the most downstream nozzle 64*b* in the transport direction D3, the printing unit 54 starts printing on the first surface. At this moment, even when liquid is jetted from any one of the nozzles from the most downstream nozzle 64*b* to the most upstream nozzle 64*a*, the liquid reaches the surface of the medium P, and the second end 82 being the start position of the printing region on the first surface can be formed on the medium P. Further, in a state in which the leading end of the medium P is positioned downstream of the most downstream nozzle 64*b* in the transport direction D3, the control unit 53 causes the printing unit 54 to start printing on the first surface. Thus, in printing on the first surface, when the carriage 63 scans in the width direction X, the leading end of the medium P is less likely to contact with the nozzle surface 64*c*. Thus, a risk of degrading printing quality can be lowered.

(12) The transport unit 48 includes the first nipping roller pair 59 that nips the medium P at the first nipping position downstream of the printing unit 54. In printing on the first surface, the printing start position P1 at which the leading end of the medium P is positioned is downstream of the nipping position. In printing on the first surface, the end of the medium P is curled toward the liquid jetting unit 64 due to curling of the roll body RP when the medium P passes on the support unit 65, and a deformation amount in the Z direction is largest at the leading end of the medium P. The control unit 53 causes the transport unit 48 to position the leading end of the medium P at the printing start position P1 downstream of the first nipping position, and in this state, causes the printing unit 54 to start printing on the first surface. Specifically, a curl at the leading end of the medium P is suppressed by the first nipping roller pair 59. Thus, in printing on the first surface, when the carriage 63 scans in the width direction X, the leading end and the medium surface of the medium P is less likely to contact with the nozzle surface 64*c*. Thus, a risk of degrading printing quality can be lowered.

(13) In duplex printing, as printing on the first surface, the control unit 53 causes the printing unit 54 to form the first printing region 91 having the second end 82 being the downstream end at the position away from the end of the medium P. Further, after causing the cutting unit 56 to cut the medium P at the position upstream of the first printing region 91, and causing the printing unit 54 to perform printing on the second surface of the medium P, the control unit 53 causes the cutting unit 56 to cut the medium P at the second end 82. In printing on the first surface, in a case where printing is performed on the inner circumferential surface, when the medium P passes on the support unit 65, the end of the medium P is curled toward the liquid jetting unit 64 due to curling of the roll body RP, and a deformation amount in the Z direction is largest at the leading end of the medium P. When the first printing region 91 of the first surface is formed, the control unit 53 causes the printing unit 54 to form the leading end margin 86 at the leading end of the medium P. With this, printing on the first surface can be started in a state in which the leading end of the medium P having the largest deformation amount is positioned downstream of the position of the most downstream nozzle 64*b* in the transport direction D3. Thus, in printing on the first surface, when the carriage 63 scans in the width direction X, the leading end of the medium P is less likely to contact with the nozzle surface 64*c*. Thus, a risk of degrading printing quality can be lowered.

(14) In printing on the second surface, in a state in which the transport unit 48 is caused to position the leading end of the medium P at the printing start position P2 downstream of the first nipping position, the control unit 53 causes the printing unit 54 to start printing on the second surface. Thus, even when curling of the roll body RP is strong, a curl at the leading end of the medium P is suppressed by the first nipping roller pair 59. In printing on the second surface, when the leading end of the medium P passes on the support unit 65, the leading end of the medium P is to be curled toward the support unit 65 due to curling of the roll body RP, but a curl is suppressed by the support unit 65. However, curling of the roll body RP is strong, and a curl at the leading end of the medium P is large, the curl makes the leading end of the medium P to have a shape protruding toward the liquid jetting unit 64. Thus, the leading end of the medium P is easily lifted up from the support unit 65. In a case where the medium P is lifted up from the support unit 65, when the carriage 63 scans in the width direction X, the leading end of the medium P may contact with the nozzle surface 64*c* of the liquid jetting unit 64 in some cases. The control unit 53 sets the cut position 97 in such a way that the distance between the first end 81 and the cut position 97 is greater than the most downstream nozzle distance L2. With this setting, when the first end 81 is positioned at the position corresponding to the most downstream nozzle 64*b* in the transport direction D3, the cut position 97 being the leading end of the medium P when the second surface faces vertically upward is positioned downstream of the first nipping position. Thus, in a state in which the cut position 97 is positioned downstream of the first nipping position, the fourth end 84 can be formed at the position corresponding to the position of the first end 81 on the inside and the outside of the medium P. Therefore, even when the second printing region 92 is formed at the position corresponding to the first printing region 91 on the inside and the outside of the medium P, formation of the second printing region 92 can be started in a state in which the leading end of the medium P is positioned downstream of the first nipping position. Thus, in printing on the second surface, when the carriage 63 scans in the width direction X, the leading end and the medium surface of the medium P is less likely to contact with the nozzle surface 64*c*. Thus, a risk of degrading printing quality can be lowered.

(15) The distance between the second end 82 and the reference end 96 is greater than the distance between the position of the second nipping roller pair 58 and the most downstream nozzle 64*b* in the transport direction D3. Thus, in printing on the second surface, the rear end of a curl of the medium P is suppressed by the second nipping roller pair 58. In printing on the second surface, when the leading end of the medium P passes on the support unit 65, the leading end of the medium P is to be curled toward the support unit 65 due to curling of the roll body RP, but a curl is suppressed by the support unit 65. However, curling of the roll body RP is strong, and a curl at the leading end of the medium P is large, the curl makes the leading end of the medium P to have a shape protruding toward the liquid jetting unit 64. Thus, the leading end of the medium P is easily lifted up from the support unit 65. In a case where the medium P is lifted up from the support unit 65, when the carriage 63 scans in the width direction X, the leading end of the medium P may contact with the nozzle surface 64*c* of the liquid jetting unit 64 in some cases. The rear end of the medium P in printing on the second surface is the reference end 96 being the leading end in printing on the first surface. The control unit 53 sets the printing start position P1 on the first surface in such a way that the distance between the second end 82 and the reference end 96 is greater than the distance between the position of the second nipping roller pair 58 and the most downstream nozzle 64*b* in the transport direction D3. With this setting, when the second surface faces vertically upward, and the second end 82 is at the position corresponding to the most downstream nozzle 64*b* in the transport direction D3, the reference end 96 is positioned upstream of the second nipping roller pair 58. Thus, even when the third end 83 being the termination position of the printing region on the second surface is formed by jetting liquid from any one of the nozzles from the most downstream nozzle 64*b* to the most upstream nozzle 64*a*, the third end 83 can be formed at the position corresponding to the position of the second end 82 on the inside and the outside of the medium P, in a state in which the reference end 96 is positioned upstream of the second nipping roller pair 58. Further, in printing on the second surface, the rear end of the medium P is less likely to contact with the nozzle surface 64*c* when the carriage 63 in the width direction X. Thus, a risk of degrading printing quality can be lowered.

(16) Effects similar to the effects of the printer 11 described in the item (8) of the first exemplary embodiment can also be obtained in the second exemplary embodiment.

(17) Effects similar to the effects of the printer 11 described in the item (9) of the first exemplary embodiment can also be obtained in the second exemplary embodiment.

(18) In the control method of the printer 11 of the second exemplary embodiment, effects similar to the effects of the printer 11 described in the items (11) to (17) can also be obtained.

The present exemplary embodiment described above may be modified as follows. The present exemplary embodiment and modified examples thereof to be described below may be implemented in combination within a range in which a technical contradiction does not arise.

After the second sensor 73 detects passing of the leading end of the medium P, the second nipping roller pair 58 transports the leading end of the medium P by the transport amount M, to the position downstream of the position of the most downstream nozzle 64*b* in the transport direction D3. The transport amount M may be set depending on a type of the roll body RP to be used. A curl amount of the medium P differs depending on a type of the medium P included in the roll body RP or a diameter of a core member being the center of the roll body RP that is wound in a roll shape. Specifically, when a curl of the medium P is large, a transport amount is set to be greater than that in a case where a curl of the medium P is small. Otherwise, the leading end of the medium P may not be transported to the position downstream of the position of the most downstream nozzle 64*b* in the transport direction D3 in some cases. The transport amount M is set depending on a type of the roll body RP to be used. With this, when causing the printing unit 54 to start printing, the control unit 53 can cause the transport unit 48 to transport the leading end of the medium P to the position downstream of the position of the most downstream nozzle 64*b* in the transport direction D3.

After the second sensor 73 detects passing of the leading end of the medium P, the second nipping roller pair 58 transports the leading end of the medium P by the transport amount M, to the position downstream of the position of the most downstream nozzle 64*b* in the transport direction D3. The transport amount M may be set by detecting a curl amount of the medium P to be used. A sensor that measures a curl amount may be provided in the vicinity of the second sensor 73, and the control unit 53 may determine the transport amount M in accordance with an output from the sensor.

After the second sensor 73 detects passing of the leading end of the medium P, the second nipping roller pair 58 transports the leading end of the medium P by the transport amount M, to the position downstream of the position of the most downstream nozzle 64*b* in the transport direction D3. The transport amount M may be set by detecting an outer diameter of the roll body RP to be used. A curl amount of the medium P differs depending on the outer diameter of the roll body RP wound in a roll shape. Thus, when the roll body RP is used, a curl amount is increased as the diameter is reduced. Thus, a sensor that detects the diameter of the roll body RP wound in a roll shape may be provided, and the control unit 53 may determine the transport amount M in accordance with an output from the sensor.

As illustrated in FIG. 9, duplex printing is not limited to a case where the start position of the printing region on the first surface and the termination position of the printing region on the second surface are positions corresponding to each other on the inside and the outside of the medium, and where the termination position of the printing region on the first surface and the start position of the printing region on the second surface are positions corresponding to each other on the inside and the outside of the medium. For example, in some cases, only a region that is a part of the printing image region is printed on the second surface, and a region without printing continues upstream of the leading end margin amount in the printing image region on the second surface. In this case, the leading end margin 88 of the second surface is additionally secured by the region without printing. Specifically, the control unit 53 may cause the cutting unit 56 to cut the medium P at the cut position 97 that is close to the first end 81 by an amount equivalent to the region without printing. With this, an amount of the cut piece WP that is cut from the medium P is reduced, and hence an amount of the medium P, which is used for printing on one sheet, can be reduced.

A sensor that detects arrival of the leading end of the medium P at the first nipping roller pair 59 may be provided. A sensor that detects paper may be provided downstream of the first nipping roller pair 59 and in the vicinity of the first nipping roller pair 59, and the sensor may detect arrival of the leading end of the medium P at the downstream of the first nipping roller pair 59. Further, a sensor that detects a thickness of the medium P may be provided to the first nipping roller pair 59, and the sensor may detect that the leading end of the medium P is nipped between the first nipping roller pair 59. In a state in which the sensor detects that the leading end of the medium P is nipped between the first nipping roller pair 59, printing is started. With this, the leading end and the medium surface of the medium P is less likely to contact with the nozzle surface when the carriage scans in the width direction X, and hence the length of the leading end margin can be reduced while lowering a risk of degrading printing quality.

In the present exemplary embodiment, the medium P is nipped between the roller pairs at the first nipping position and the second nipping position, but the method of nipping the medium P is not limited to the roller pairs. For example, the medium P may be nipped between a roller and the transport surface 50, the medium P may be nipped between a belt pair, or the medium P may be nipped between a belt and the transport surface 50.

The most downstream nozzle distance L2 being the distance between the first nipping roller pair 59 and the most downstream nozzle 64*b* and the distance between the second nipping roller pair 58 and the most upstream nozzle 64*a* may be set to be equal to each other. Liquid jetted from the most downstream nozzle 64*b* determines the start position of the printing region on the first surface or the second surface, and liquid jetted from the most upstream nozzle 64*a* determines the termination position of the printing region on the first surface or the second surface. At this moment, the length by which the leading end of the medium P has already passed through the first nipping roller pair 59 at the start of printing and the length by which the rear end of the medium P has not yet passed through the second nipping roller pair 58 at the termination of printing on the second surface can be equal to each other.

In the present exemplary embodiment, the discharge roller pair 62 has a configuration of solely rotating in both forward and backward directions and stopping, but instead of solely rotating, the discharge roller pair 62 may rotate in synchronization with the second nipping roller pair 58, the first nipping roller pair 59, and the transport roller pair 60. Particularly, in a case where the cut piece WP is not further shredded, after the cut piece WP is cut and divided from the leading end of the medium P, the discharge roller pair 62 transports the cut piece WP upstream in a state in which the position of the upper blade is at the cutting position. With this, the cut piece WP falls downs, and is accommodated in the accommodation container 17. Further, also in a case where the cut piece WP is cut and divided from the rear end of the cutform paper CP, the discharge roller pair 62 transports the cut piece WP upstream in a state in which the position of the upper blade is at the cutting position. With this, the cut piece WP falls downs, and is accommodated in the accommodation container 17. Thus, a risk in that the end of the cut piece WP and the end of the cutform paper CP abut on each other is avoided.

In the present exemplary embodiment, the cut piece WP is shredded into two, but the number of shredded pieces is not limited to two. The cut piece WP may be shredded into smaller pieces. When the distance between the transport roller pair 60 and the cutting unit 56 and the distance between the discharge roller pair 62 and the cutting unit 56 is set to be small, the cut piece WP can be shredded into smaller pieces.

In the present exemplary embodiment, the discharge roller pair 62 has a configuration of performing nipping at an angle with respect to the vertical direction Z, and hence the discharge roller pair 62 can cause the shredded piece SP to fall down along the surface of the upper blade. However, a plurality of roller pairs may be provided downstream of the cutting unit 56 to achieve a configuration of securely transporting the shredded piece SP downward. Further, an inclination surface is provided on the surface of the upper blade, specifically, at a part on which the upstream end of the shredded piece SP is caused to abut by the discharge roller pair 62 when the discharge roller pair 62 causes the shredded piece SP to fall down along the surface of the upper blade, and the upstream end of the shredded piece SP moves along the inclination surface. With this, a configuration of transporting the shredded piece SP downward may be achieved.

In the present exemplary embodiment, the control unit 53 controls the position of the medium P with the two sensors including the first sensor 71 and the second sensor 73, but the positions and the number of sensors that detect the medium P are not limited. For example, the position of the second sensor 73 may be in the vicinities of the pinch rollers 67, 68, and 69. In the present exemplary embodiment, the printer 11 includes the second sensor 73 at the position between the second nipping roller pair 58 and the liquid jetting unit 64 and in the vicinity of the second nipping roller pair 58. Thus, the printing position can be controlled accurately. Further, a sensor that enables the control unit 53 to stop the leading end of the medium P at the standby position more accurately may be provided in the vicinity of the outlet 42. Alternatively, a sensor that enables the control unit 53 to stop the medium P at the cutting position more accurately may be provided upstream of the cutting unit 56 and in the vicinity of the cutting unit 56.

Hereinafter, technical concepts and effects thereof that are understood from the above-described exemplary embodiments and modified examples will be described.

(A) A printer includes a transport unit configured to transport a medium in a transport direction, the medium being fed from a state of being wound up in a roll shape, a printing unit configured to move to a position at which a nozzle surface does not face the medium being transported by the transport unit, and a control unit configured to control the transport unit and the printing unit. In inner circumferential surface printing for performing printing on an inner circumferential surface of the medium positioned inside when the medium is in the state of being wound up in a roll shape, the control unit causes the transport unit to position a leading end of the medium at a printing start position being a position downstream of a position facing a most downstream nozzle of the nozzle surface in the transport direction, in a state in which the printing unit is at a position at which the nozzle surface does not face the medium being transported by the transport unit, and causes the printing unit to start formation of a printing region on the medium having the leading end positioned at the printing start position.

According to this configuration, in a state in which the leading end position of the medium is positioned downstream of the most downstream nozzle, the printing unit starts formation of the printing region. When printing is performed on the inner circumferential surface, the leading end of the medium is curled toward the nozzle surface due to curling of the roll body. Further, a deformation amount is largest at the leading end of the medium. Thus, printing is started in a state in which the part with the largest deformation amount is at the position that the region of the nozzle surface, which ejects ink, does not pass through when the carriage scans. Therefore, when the carriage scans, the leading end of the medium is less likely to contact with the nozzle surface. Thus, a risk of degrading printing quality can be lowered.

(B) In the printer described above, the transport unit may include a nipping roller configured to nip the medium at a nipping position downstream of the printing unit, and the printing start position may be downstream of the nipping position.

According to this configuration, in a state in which the leading end position of the medium is positioned downstream of the nipping position, the control unit starts printing. Thus, in a state in which a curl at the leading end of the medium is suppressed by the nipping roller, the printing unit starts formation of the printing region. Therefore, when the carriage scans, the leading end of the medium is less likely to contact with the nozzle surface. Thus, a risk of degrading printing quality can be lowered.

(C) The printer described above may include a cutting unit configured to cut the medium. The control unit may execute duplex printing by causing the printing unit to perform printing on a first surface of the medium and a second surface of the medium after printing on the first surface. The circumferential surface may be the second surface. In the duplex printing, the control unit may cause the cutting unit to cut the medium at a cut position upstream of a first end being an upstream end of a first printing region that is formed at the first surface by the printing unit. A distance between the first end and the cut position may be greater than a distance between a most upstream nozzle and the most downstream nozzle of the printing unit.

According to this configuration, in printing on the first surface, a margin is provided between the first end of the first printing region and the cut position. After printing on the first surface, the cut position is set at the leading end of the medium, and printing on the second surface is performed as printing on the inner circumferential surface. Specifically, in this configuration, a deformation amount of a curl toward the nozzle surface is largest at the cut position of the first surface. Therefore, the distance between the first end and the cut position is controlled to be greater than the distance between the most upstream nozzle and the most downstream nozzle. With this, in printing on the second surface, when the first end is positioned between the most upstream nozzle and the most downstream nozzle, a non-cutting position at which a deformation amount of a curl toward the nozzle surface is largest is positioned downstream of the most downstream nozzle in the transport direction. Specifically, in printing on the second surface, in a case where the printing region is formed at the position corresponding to the first printing region on the inside and the outside, even when liquid is jetted from any one of nozzles from the most downstream nozzle to the most upstream nozzle to start printing on the second surface, printing can be started in a state in which the leading end of the medium is positioned downstream of the most downstream nozzle. Therefore, in printing on the second surface, when the carriage scans, the leading end of the medium is less likely to contact with the nozzle surface. Thus, a risk of degrading printing quality can be lowered.

(D) The printer described above may include a cutting unit configured to be controlled by the control unit and to cut the medium. The control unit may execute duplex printing by causing the printing unit to perform printing on a first surface of the medium and a second surface of the medium after printing on the first surface. The circumferential surface may be the first surface. In the duplex printing, the control unit may cause the printing unit to form a first printing region as printing on the first surface, the first printing region having a second end being a downstream end at a position away from an end of the medium, the cutting unit to cut the medium at a position upstream of the first printing region, and the cutting unit to cut the medium at the second end after causing the printing unit to perform printing on the second surface of the medium.

According to this configuration, in printing on the first surface, printing is started in a state in which the leading end of the medium, which has the largest deformation amount of a curl toward the nozzle surface, is positioned downstream of the most downstream nozzle. With this, a margin formed between the leading end of the medium and the first printing region is removed after printing on the second surface. Therefore, a printed object from which a margin is cut can be obtained while lowering a risk that the medium and the region of the nozzle surface, which ejects ink, contact with each other when the carriage scans in printing on the first surface.

(E) In the printer described above, the medium may be a medium including an ink reception layer on the inner circumferential surface.

The ink reception layer fixes dye near the surface of the medium, and hence a printed object excellent in color development can be output. However, when the medium is curved with the ink reception layer on the outside, there is a risk of generating a crack in the ink reception layer. Particularly, the medium unwound from the roll body is curved in a direction reversed to a curved direction in a state of being held as the roll body. With this, a curl due to curling can be corrected. Thus, when the ink reception layer is provided on the inner circumferential surface of the roll body, it is difficult to sufficiently correct a curl while preventing generation of a crack in the ink reception layer. According to this configuration, even in a case where the medium is curled to a certain extent, when the ink-jet type printing unit performs printing on the medium, the medium is less likely to contact with the nozzle surface. Thus, on the medium including the ink reception layer on the inner circumferential surface, a risk of degrading printing quality can also be lowered.

(F) In the printer described above, the medium may be a medium including an ink reception layer on each of the first surface and the second surface.

In a case where the medium has the ink reception layer on each of the first surface and the second surface, when a curl is corrected, the medium is curved with any one of the first surface and the second surface on the outside. Thus, it is difficult to sufficiently correct a curl while preventing generation of a crack in the ink reception layer. According to this configuration, even in a case where the medium is curled to a certain extent, when the ink-jet type printing unit performs printing on the first surface and the second surface of the medium, the medium is less likely to contact with the nozzle surface. Thus, on the medium including the ink reception layer on each of the first surface and the second surface, a risk of degrading printing quality can be lowered.

(G) A control method of a printer is a control method of a printer including a transport unit configured to transport a medium in a transport direction, the medium being fed from a state of being wound up in a roll shape, a printing unit configured to move to a position at which a nozzle surface does not face the medium being transported by the transport unit, and a control unit configured to control the transport unit and the printing unit. In inner circumferential surface printing for performing printing on an inner circumferential surface of the medium positioned inside when the medium is in the state of being wound up in a roll shape, the control method includes positioning a leading end of the medium at a printing start position being a position downstream of a position facing a most downstream nozzle of the nozzle surface in the transport direction, in a state in which the printing unit is at a position at which the nozzle surface does not face the medium being transported by the transport unit, and starting formation of a printing region by the printing unit, on the medium having the leading end positioned at the printing start position.

According to this method, an action effect similar to the item (A) described above can be obtained.

What is claimed is:

1. A printer, comprising:

a transport unit configured to transport a medium in a transport direction, the medium being fed from a state of being wound up in a roll shape;

a printing unit configured to move to a position at which a nozzle surface does not face the medium being transported by the transport unit;

a pair of rollers positioned downstream of the printing unit along the transport direction; and a control unit configured to control the transport unit and the printing unit, wherein during inner circumferential surface printing for performing printing on an inner circumferential surface of the medium positioned inside when the medium is in the state of being wound up in a roll shape, the controller is further configured to:

cause the transport unit to move a leading end of the medium to a printing start position, which is positioned downstream of the pair of rollers along the transport direction, in a state in which the printing unit is at the position at which the entirety of the nozzle surface does not face the medium being transported by the transport unit, when the leading end of the medium has moved to the printing start position, cause the transport unit to stop movement of the leading end of the medium so that the leading end of the medium is stationary at the printing start position and cause the pair of rollers to nip the medium;

while the leading end of the medium is stationary at the printing start position and the medium is nipped by the pair of rollers, cause the printing unit to move to a print position at which the nozzle surface faces the medium, and after the printing unit has moved to the print position at which the nozzle surface faces the medium, cause the start of formation of a printing region on the medium by both causing the printing unit to start printing while causing the transport unit to resume movement of the medium.

2. The printer according to claim 1, comprising:

a cutting unit configured to cut the medium, wherein the control unit is configured to execute duplex printing by causing the printing unit to perform printing on a first surface of the medium and a second surface of the medium after printing on the first surface, the inner circumferential surface being the second surface, the control unit being further configured to, during the duplex printing, cause the cutting unit to cut the medium at a cut position upstream of a first end being an upstream end of a first printing region that is formed at the first surface by the printing unit, and a distance between the first end and the cut position is greater than a distance between a most upstream nozzle and the most downstream nozzle of the printing unit.

3. The printer according to claim 2, wherein the medium is a medium including an ink reception layer at the first surface and the second surface.

4. The printer according to claim 1, comprising:

a cutting unit configured to be controlled by the control unit and to cut the medium, wherein the control unit is configured to execute duplex printing by causing the printing unit to perform printing on a first surface of the medium and a second surface of the medium after printing on the first surface, the inner circumferential surface is the first surface, and the control unit being further configured to, during the duplex printing, cause the following the printing unit to form a first printing region as printing on the first surface, the first printing region having a second end being a downstream end at a position away from an end of the medium, the cutting unit to cut the medium at a position upstream of the first printing region, and the cutting unit to cut the medium at the second end after causing the printing unit to perform printing on the second surface of the medium.

5. The printer according to claim 1, wherein the medium is a medium including an ink reception layer at the inner circumferential surface.

6. The printer according to claim 1, wherein the control unit causes the printing unit to print on a first surface of the medium and causes the printing unit which printed on the first surface of the medium to print a second surface of the medium after printing on the first surface.

7. The printer according to claim 1, comprising:

a cutting unit configured to cut the medium; and an intermediate roller, wherein the control unit causes the cutting unit to cut the medium printed on a first surface and causes the intermediation roller to reverse a cutform medium cut by the cutting unit inside out.

8. A control method of a printer including a transport unit configured to transport a medium in a transport direction, the medium being fed from a state of being wound up in a roll shape;

a printing unit configured to move to a position at which a nozzle surface does not face the medium being transported by the transport unit;

a pair of rollers positioned downstream from the printing unit along the transport direction; and a control unit configured to control the transport unit and the printing unit, so as to perform inner circumferential surface printing, for performing printing on an inner circumferential surface of the medium positioned inside when the medium is in the state of being wound up in a roll shape, the method comprising:

moving a leading end of the medium to a printing start position, which is positioned downstream of the pair of rollers along the transport direction, in a state in which the printing unit is at the position at which the nozzle surface does not face the medium being transported by the transport unit;

when the leading end of the medium has moved to the printing start position, causing the transport unit to stop movement of the leading end of the medium so that the leading end of the medium is stationary at the printing start position and causing the pair of rollers to nip the medium;

while the leading end of the medium is stationary at the printing start position and the medium is nipped by the pair of rollers, causing the printing unit to move to a print position at which the entirety of the nozzle surface faces the medium, and after the printing unit has moved to the print position at which the nozzle surface faces the medium, causing the start of formation of a printing region on the medium by both causing the printing unit to start printing while causing the transport unit to resume movement of the medium.

* * * * *